US009114638B2

(12) United States Patent
Ogasawara et al.

(10) Patent No.: US 9,114,638 B2
(45) Date of Patent: Aug. 25, 2015

(54) DROPLETS DRYING DEVICE, COMPUTER READABLE MEDIUM STORING PROGRAM FOR DROPLETS DRYING, AND IMAGE FORMING APPARATUS

(71) Applicant: FUJI XEROX CO., LTD., Tokyo (JP)

(72) Inventors: Yasuhiro Ogasawara, Kanagawa (JP); Naoki Morita, Kanagawa (JP); Manabu Numata, Kanagawa (JP); Akira Sakamoto, Kanagawa (JP); Mami Hatanaka, Kanagawa (JP); Yukari Motosugi, Kanagawa (JP); Takeshi Zengo, Kanagawa (JP); Jun Isozaki, Kanagawa (JP); Takehiro Niitsu, Kanagawa (JP); Atsushi Murakami, Kanagawa (JP); Masaki Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/300,459

(22) Filed: Jun. 10, 2014

(65) Prior Publication Data

US 2015/0158311 A1 Jun. 11, 2015

(30) Foreign Application Priority Data

Dec. 11, 2013 (JP) ..... 2013-256260

(51) Int. Cl.

| | |
|---|---|
| ***B41J 29/38*** | (2006.01) |
| ***B41J 11/00*** | (2006.01) |
| ***B41J 2/01*** | (2006.01) |

(52) U.S. Cl.

CPC . *B41J 11/002* (2013.01); *B41J 2/01* (2013.01)

(58) Field of Classification Search

CPC ..... B41J 11/002; B41J 11/42; B41J 11/46
USPC ..... 347/5, 9, 16, 19, 101, 102, 104; 430/320

See application file for complete search history.

(56) References Cited

U.S. PATENT DOCUMENTS

| | | | | |
|---|---|---|---|---|
| 7,059,705 | B2 * | 6/2006 | Iwata | 347/37 |
| 7,510,277 | B2 * | 3/2009 | Konno et al. | 347/102 |
| 7,794,073 | B2 * | 9/2010 | Shoki | 347/101 |
| 2006/0214993 | A1 | 9/2006 | Iwata | |

FOREIGN PATENT DOCUMENTS

| | | |
|---|---|---|
| JP | 2004-042393 | 2/2004 |
| JP | 2004-291414 | 10/2004 |
| JP | 2006-263559 | 10/2006 |

OTHER PUBLICATIONS

Abstract and machine translation of JP 2004-042393.
Abstract and machine translation of JP 2004-291414.

* cited by examiner

*Primary Examiner* — An Do
(74) *Attorney, Agent, or Firm* — Fildes & Outland, P.C.

(57) ABSTRACT

A droplets drying device includes: an illuminating unit that applies infrared laser light to droplets that have been ejected onto a recording medium by an ejecting unit that ejects droplets in accordance with an image to be formed; and a control unit that controls at least one of timing, a position or positions, and an amount or amounts of application of infrared laser light to the droplets by the illuminating unit in accordance with an attribute that influences image quality of an image formed.

26 Claims, 44 Drawing Sheets

CURRENT-DENSITY TABLE

| LASER LIGHT EMITTING ELEMENT NO. / CURRENT | 1 | 2 | 3 | ··· | m−1 | m |
|---|---|---|---|---|---|---|
| A1 | D1(1) | D1(2) | D1(3) | ··· | D1(n−1) | D1(n) |
| A2 | D2(1) | D2(2) | D2(3) | ··· | D2(n−1) | D2(n) |
| A3 | D3(1) | D3(2) | D3(3) | ··· | D3(n−1) | D3(n) |

| LASER LIGHT EMITTING ELEMENT NO. / DENSITY | 1 | 2 | 3 | ··· | m−1 | m |
|---|---|---|---|---|---|---|
| Do | Ao(1) | Ao(2) | Ao(3) | ··· | Ao(m−1) | Ao(m) |

FIG. 30

| NOZZLE NO. | 1 | 2 | 3 | ··· | n1-1 | n1 | n1+1 | ··· | n-1 | n |
|---|---|---|---|---|---|---|---|---|---|---|
| LASER LIGHT EMITTING ELEMENT NO. | m1-n1 | m1-n1+1 | m1-n1+2 | ··· | m1-1 | m1 | m1+1 | ··· | m1+n-n1-1 | m1+n-n1 |

WITH LASER LIGHT ILLUMINATION (1.5 J/cm2)

WITHOUT LASER LIGHT ILLUMINATION

DROPLETS DRYING DEVICE, COMPUTER READABLE MEDIUM STORING PROGRAM FOR DROPLETS DRYING, AND IMAGE FORMING APPARATUS

CROSS-REFERENCE TO RELATED APPLICATIONS

This application is based on and claims priority under 35 USC 119 from Japanese Patent Application No. 2013-256260 filed on Dec. 11, 2013.

BACKGROUND

Technical Field

The present invention relates to a droplets drying device, a computer readable medium storing a program for droplets drying, and an image forming apparatus.

SUMMARY

According to an aspect of the invention, there is provided a droplets drying device comprising: an illuminating unit that applies infrared laser light to droplets that have been ejected onto a recording medium by an ejecting unit that ejects droplets in accordance with an image to be formed; and a control unit that controls at least one of timing, a position or positions, and an amount or amounts of application of infrared laser light to the droplets by the illuminating unit in accordance with an attribute that influences image quality of an image formed.

BRIEF DESCRIPTION OF THE DRAWINGS

Exemplary embodiments of the present invention will be described in detail based on the following figures, wherein:

FIG. 30 shows an example laser light illumination correspondence table used in the eighth exemplary embodiment;

REFERENCE SIGNS LIST

Figure 1:
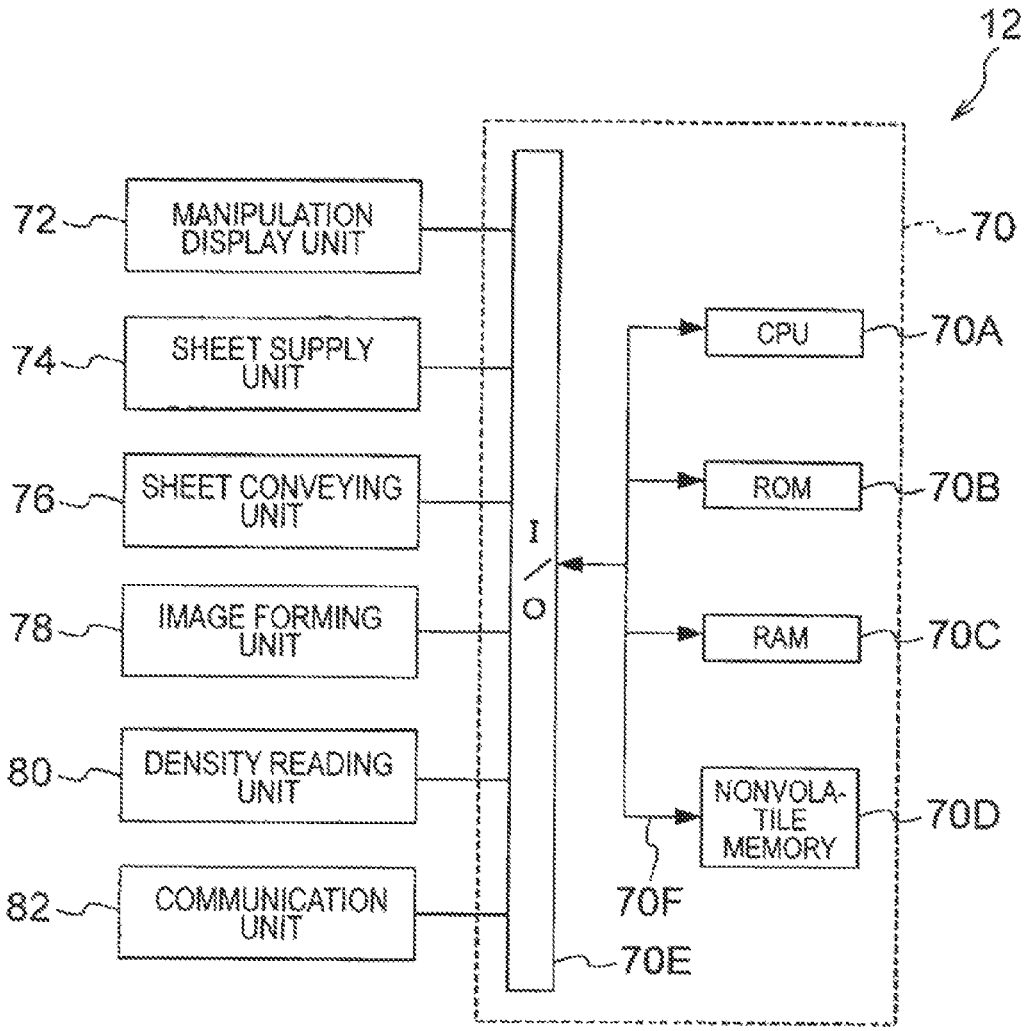
FIG. 1 is a block diagram showing the configuration of an essential part, common to exemplary embodiments, of an electrical system of an inkjet recording apparatus.

12, 13: Inkjet recording apparatus
30: Head array
32: Ink head
56: Laser drying unit
58: Density reading sensor
70: Computer
72: Manipulation display unit
74: Sheet supply unit
76: Sheet conveying unit
78: Image forming unit
80: Density reading unit
82: Communication unit
84: Sheet conveying motor
88: Laser drying unit conveying motor
P: Sheet

DETAILED DESCRIPTION

Modes for carrying out the present invention will be hereinafter described in detail with reference to the drawings. Constituent elements or pieces of processing that work or function in the same manner will be given the same reference symbol throughout the drawings and will not be described redundantly where appropriate.

FIG. 1 is a block diagram showing the configuration of an essential part, common to exemplary embodiments of the invention, of an electrical system of an inkjet recording apparatus 12.

As shown in FIG. 1, the inkjet recording apparatus 12 includes, for example, a computer 70, a manipulation display unit 72, a sheet supply unit 74, a sheet conveying unit 76, an image forming unit 78, a density reading unit 80, and a communication unit 82.

The computer 70 is configured in such a manner that a CPU (central processing unit) 70A, a ROM (read-only memory) 70B, a RAM (random access memory) 70C, a nonvolatile memory 70D, and an input/output interface (I/O) 70E are connected to each other via a bus 70F. The manipulation display unit 72, the sheet supply unit 74, the sheet conveying unit 76, the image forming unit 78, the density reading unit 80, and the communication unit 82 are connected to the I/O 70E. The computer 70 realizes image formation of the inkjet recording apparatus 12 by controlling the individual units 72-82 as the CPU 70A runs programs that are preinstalled, for example, in the ROM 70B and performs mutual data communications with the individual units 72-82 according to the programs.

The manipulation display unit 72 receives an instruction from the user of the inkjet recording apparatus 12, and notifies the user of various kinds of information relating to an operation status etc. of the inkjet recording apparatus 12. For example, the manipulation display unit 72 is configured so as to include display buttons that enable reception of a manipulation instruction according to a program, a touch panel display on which various kinds of information are displayed, and hardware keys such as a ten-key unit and a start button.

For example, the sheet supply unit 74 is configured so as to include a sheet housing unit for housing sheets and a supply mechanism for supplying sheets to the sheet conveying unit 76 (described below).

The sheet conveying unit 76 conveys a sheet supplied from the sheet supply unit 74 to the image forming unit 78 and the density reading unit 80 (described below), and ejects a sheet on which an image has been formed by the image forming unit 78 to outside the body of the inkjet recording apparatus 12. For example, the sheet conveying unit 76 is configured so as to include a drive motor and roller pairs which is driven by the drive motor and conveys a sheet by holding it between them.

The image forming unit 78 forms an image on a sheet being conveyed by operation of the sheet conveying unit 76 by ejecting inks by amounts commanded by the computer 70 from a commanded ejecting position toward the sheet. Furthermore, the image forming unit 78 fixes the image by drying droplets on the sheet using a drying device incorporating an infrared laser. For example, the image forming unit 78 is configured so as to include an ink ejecting device, a laser drying device, and at least one of a voltage source and a current source for supplying a voltage or current to individual devices.

Inks are classified into water-based inks, oil-based inks whose solvents evaporate, ultraviolet-curing inks, etc. In the following exemplary embodiments, use of water-based inks are assumed. In the following exemplary embodiments, the terms "ink" and "ink droplet" as used singly mean a water-based ink and a water-based ink droplet, respectively. And an infrared laser will be referred to simply as a "laser."

Laser light in a wavelength range of approximately 800 to 12,000 nm, in particular, 800 to 1,200 nm, is used.

The density reading unit 80 reads densities of an image that has been formed on a sheet by the image forming unit 78, and communicates resulting density information of the image to the computer 70. The computer 70 compares the received density information with image information of a user-specified image (original image) which includes an image type, image density information, droplet ejecting position information, etc., and corrects controls on the sheet conveying unit 76, the image forming unit 78, etc. so that the densities of the image formed on the sheet come closer to densities indicated by density information included in the image information of the original image. The image type is information indicating whether an element of the image represented by the image information is, for example, a photograph, graphic information such as a figure, a table, or a graph, or a text, symbols, or the like.

The communication unit 82, which is connected to a communication line (not shown), is an interface for performing mutual data communications with a terminal apparatus such as a personal computer (not shown) connected to the communication line. The communication line may be either a wired line or a wireless line. For example, the communication unit 82 receives an image formation request and image information of an original image from the terminal apparatus.

The form of providing various programs relating to image formation is not limited to preinstalling them in the ROM 70B. For example, those programs may be provided in such a manner as to be stored in a computer-readable storage medium such as a CD-ROM or a memory card or delivered by wire or wirelessly through the communication unit 82.

Inkjet recording apparatus 12 and 13 according to various exemplary embodiments will be described below in which the densities of an image to be formed on a sheet is controlled on the basis of at least one of attributes that influence the image quality of the image by the inkjet recording apparatus 12, such as a sheet type, a printing speed, an arrangement and operation statuses of various devices included in the image forming unit 78, and image type and densities.

Exemplary Embodiment 1

Figure 2:
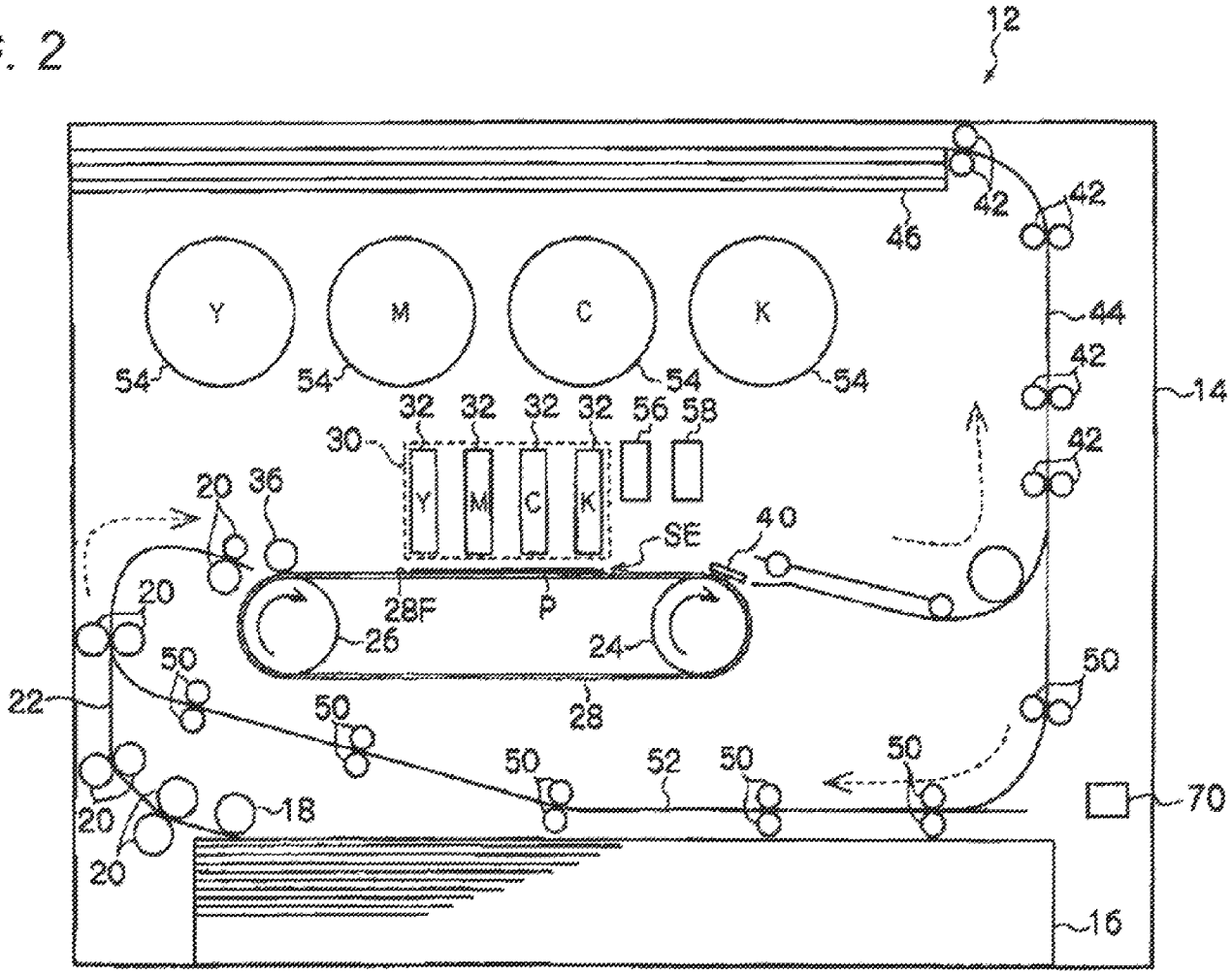
FIG. 2 is a schematic sectional view showing the configuration of an essential part of an inkjet recording apparatus 12 according to a first exemplary embodiment.

FIG. 2 is a schematic sectional view showing the configuration of an essential part of an inkjet recording apparatus 12 according to a first exemplary embodiment.

Sheets P which are a stack of A4 cut sheets, for example, are housed in a sheet supply tray 16 which is disposed under a body 14 of the inkjet recording apparatus 12. The sheets P housed in the sheet supply tray 16 are picked up one by one by a pickup roll 18. A picked-up sheet P is conveyed by plural conveyance roller pairs 20 which constitute a predetermined conveyance path 22. In the following description, it is assumed that the term "conveying direction" as used singly means a conveying direction (auxiliary scanning direction) of a sheet (recording medium). The term "width direction" as used singly means a width direction (main scanning direction) of a sheet. The term "upstream" or "downstream" means upstream or downstream in a conveying direction.

An endless conveyance belt 28 is disposed over the sheet supply tray 16 so as to be stretched between a driver roll 24 and a follower roll 26. A head array 30 is disposed over the conveyance belt 28 so as to be opposed to a flat portion 28F of the conveyance belt 28. The area in which the head array 30 is opposed to the flat portion 28F is an ejecting area SE where ink droplets are ejected from the head array 30.

On the other hand, a charging roll 36 to which a power source (not shown) is connected is disposed upstream of the head array 30. The charging mil 36 is movable between a pressing position where it pressing a sheet P against the conveyance belt 28 and a separated position where it is spaced from the conveyance belt 28, and follows the rotation of the follower roll 26 while holding the conveyance belt 28 and the sheet P between itself and the follower roll 26. When the charging roll 36 is located at the pressing position, a predetermined potential difference occurs between itself and the grounded follower roll 26, the sheet P is given charge from the charging roll 36 and thereby absorbed on the conveyance belt 28 electrostatically.

A sheet P that has been conveyed along the conveyance path 22 reaches the ejecting area SE while being held on the conveyance belt 28, and ink droplets are ejected from the head array 30 onto the sheet P opposed to it by amounts corresponding to image information of an original image.

The means or conveying a sheet P is not limited to the conveyance belt 28. For example, a cylindrical conveyance roller may be employed which is rotated while a sheet P is absorbed and held on its circumferential surface. Although in this exemplary embodiment is directed to the case of using cut sheets as sheets P, the concept of this exemplary embodiment is also applicable to a configuration in which continuous paper that is long in the conveying direction is conveyed to the ejecting area SE by conveyance roller pairs 20, a drive roll 24, etc.

In this exemplary embodiment, the head array 30 is a long one the width of whose effective droplets ejecting area is greater than or equal to the width (in the direction perpendicular to the conveying direction) of a sheet P. In the head array 30, four ink heads 32 corresponding to four respective colors of yellow (Y), magenta (M), cyan (C), and black (K) are arranged in the conveying direction for recording of a full-color image. There are no limitations on the method by which each ink head 32 ejects ink droplets; any of known methods such as the thermal method and the piezoelectric method may be employed. Although only one head array 30 is shown in FIG. 1, plural head arrays 30 may be arranged so as to be opposed to the conveyance belt 28 if necessary.

A laser drying unit 56 which is a long one the width of whose laser illumination area is greater than or equal to the width of a sheet P is disposed downstream of the head array 30 in the conveying direction so as to be opposed to the conveyance belt 28. The laser drying unit 56 accelerates fixing of an image on a sheet P by drying ink droplets on the sheet P being conveyed by the conveyance belt 28 by applying laser light to them. Although only one laser drying unit 56 is shown in FIG. 1, plural laser drying units 56 may be arranged so as to be opposed to the conveyance belt 28 if necessary.

A density reading sensor 58 which is a long one the width of whose effective density reading area is greater than or equal to the width of a sheet P is disposed downstream of the head array 30 in the conveying direction in such a manner that its density reading surface is opposed to the conveyance belt 28. For example, the density reading sensor 58 applies light to the image forming area of a sheet P being conveyed by the conveyance belt 28 from light-emitting elements incorporated in the density reading sensor 58 and receives reflection light by photodetecting elements incorporated in the density reading sensor 58, and thereby reads image densities using intensities of spectral components of the reflection light.

The image densities that have been read by the density reading sensor 58 are communicated to the computer 70 and will be used as a feedback control quantity for correction of the densities of an image to be formed on the sheet P in subsequent image formation processing. The density reading sensor 58 is not indispensable for the inkjet recording apparatus 12. The inkjet recording apparatus 12 according to this exemplary embodiment is an example that employs the density reading sensor 58.

A peeling plate 40, which is disposed downstream of the density reading sensor 58, peels a sheet P being conveyed off the conveyance belt 28 by going into the gap between the sheet P and the conveyance belt 28.

The sheet P thus peeled off is conveyed by plural ejection roller pairs 42 which are disposed downstream of the peeling plate 40 and constitute an ejection path 44, and is thereby ejected to an ejected sheet tray 46 which is disposed at the top of the body 14.

A flipping path 52 which consists of plural flip roller pairs 50 is provided between the sheet supply tray 16 and the conveyance belt 28. The flipping path 52 is provided with a mechanism for forming an image on the other surface of a sheet P that has been formed with an image on one surface (double-sided printing) by flipping the sheet P and having it held by the conveyance belt 28 again.

Ink tanks 54 for storing inks of the respective colors (C, M, Y, and K) are disposed between the conveyance belt 28 and the ejected sheet tray 46. Inks are supplied from the ink tanks to the head array 30 by ink supply pipes (not shown), respectively.

The above-described series of processing for image formation is controlled by the computer 70. Although only one sheet supply tray 16 is shown in FIG. 2, plural sheet supply trays 16 may be provided, in which case sets of sheets P that are different in size or type are housed in the respective sheet supply trays 16. According to a user instruction, a pickup roll 18 for picking up a sheet P of a specified kind is driven to convey the sheet P to the conveyance path 22.

Figure 3:
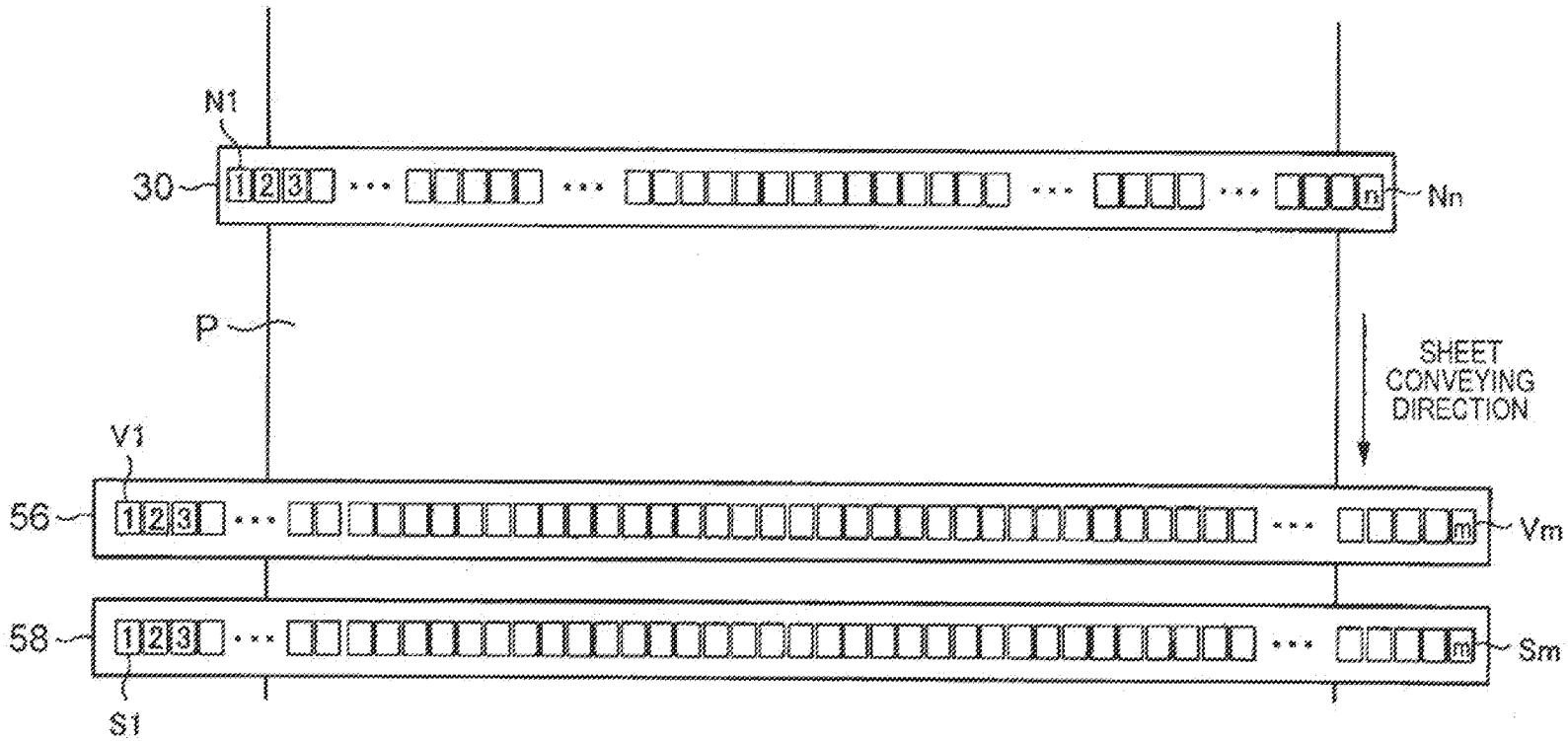
FIG. 3 is a schematic diagram illustrating the structures of a head array, a laser drying unit, and the density reading sensor in the first exemplary embodiment.

FIG. 3 is a schematic diagram illustrating the structures of the head array 30, the laser drying unit 56, and the density reading sensor 58. To simplify the description, FIG. 3 shows one of the ink heads 32 corresponding to the respective colors (e.g., the ink head 32 for ejecting ink droplets of K).

For example, the head array 30 is configured in such a manner that the ink ejecting surfaces of n ink ejecting nozzles for ejecting ink droplets are arranged in the width direction at predetermined intervals so as to be opposed to a sheet P. Since the distance between nozzles N1 and Nn is longer than or equal to the width of a sheet P, ink droplets can be ejected onto the entire surface of a sheet P.

For example, the laser drying unit 56 is configured in such a manner that the laser emitting surfaces of m laser light emitting elements V are arranged in the width direction at predetermined intervals so as to be opposed to a sheet P. Since the distance between laser light emitting elements V1 and Vm is longer than or equal to the width of a sheet P, laser light can be applied to the entire surface of a sheet P.

For example, the laser light emission amount of each laser light emitting element V of the laser drying unit 56 is adjusted in accordance with a current that is supplied to the laser light emitting element V. More specifically, the laser light emission amount of each laser light emitting element V increases as the current supplied to it is increased. Although this exemplary embodiment is directed to the case that the laser light emission amounts of the respective laser light emitting elements V are controlled by varying the currents supplied to them by controlling a current source (not shown), the laser light emission amounts of the respective laser light emitting elements V may be controlled by, for example, varying the voltages supplied to them by controlling a voltage source (not shown).

For example, the density reading sensor 58 is configured in such a manner that the density reading surfaces of m density sensors S each including a light emitting element and a photodetecting element are arranged in the width direction so as to be opposed to a sheet P. Since the distance between density sensors S1 and Sm is longer than or equal to the width of a sheet P, densities can be read over the entire surface of a sheet P.

The laser light emitting elements V and the density sensors S are correlated with each other in advance. For example, a density of a region illuminated with laser light emitted from the laser light emitting element V1 is read by the density sensor S1 and a density of a region illuminated with laser light emitted from the laser light emitting element V2 is read by the density sensor S2.

Although this exemplary embodiment employs the n nozzles N, the m laser light emitting elements V, and the m density sensors S, the invention is not limited to such a case. For example, the numbers of nozzles N, laser light emitting elements V, and density sensors S may be the same. And the numbers of laser light emitting elements V and density sensors S may be different from each other. Although in FIG. 3 the set of nozzles N, the set of laser light emitting elements V, and the set of density sensors S are each arranged in a single row in the width direction, each of those sets of elements may be arranged in plural rows, the rows arranged in the conveying direction.

Furthermore, the positions of the head array 30 and the laser drying unit 56 may be either fixed or not fixed; that is, a motor etc. may be provided which moves at least one of the head array 30 and the laser drying unit 56.

Figure 4:
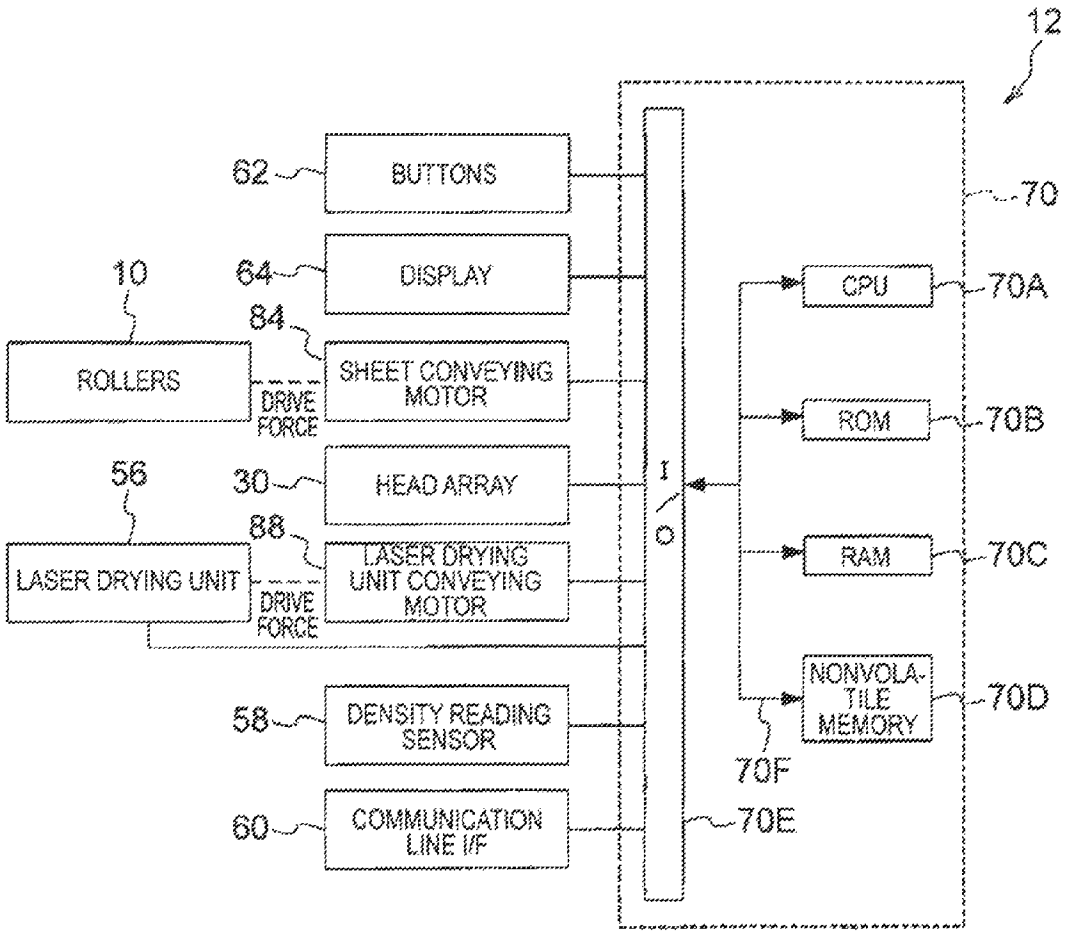
FIG. 4 is a block diagram showing the configuration of an essential part of an electrical system of the inkjet recording apparatus according to the first exemplary embodiment.

FIG. 4 is a block diagram showing the configuration of an essential part of an electrical system of the inkjet recording apparatus 12 according to this exemplary embodiment.

In this exemplary embodiment, buttons 62 and a display 64 as the manipulation display unit 72 shown in FIG. 1 and a sheet conveying motor 84 (not shown in FIG. 2) as part of each of the sheet supply unit 74 and the sheet conveying unit 76 shown in FIG. 1 are connected to the I/O 70E.

Furthermore, a laser drying unit conveying motor 88 (not shown in FIG. 2), the head array 30, and the laser drying unit 56 as part of the image forming unit 78 shown in FIG. 1 are connected to the I/O 70E. And the density reading sensor 58 as the density reading unit 80 shown in FIG. 1 and a communication line I/F 60 (not shown in FIG. 2) as the communication unit 82 shown in FIG. 1 are connected to the I/O 70E.

Drive force of the sheet conveying motor 84 is transmitted to rollers 10 via gears etc. and the rollers 10 are thereby driven rotationally. For example, the rollers 10 are various roll members relating to the supply and conveyance of a sheet P, such as the pickup roll 18, the conveyance roller pairs 20, the drive roll 24, the ejection roller pairs 42, and the flip roller pairs 50. Likewise, drive force of the laser drying unit conveying motor 88 is transmitted to the laser drying unit 56 via gears etc., whereby the laser drying unit 56 is moved in the conveying direction.

Incidentally, after making investigations diligently, the inventors have found that the optical density of an image is varied by varying the time from ejecting of ink droplets onto a sheet by the head array 30 to application of laser light to the ink droplets on the sheet P from the laser drying unit 56 (i.e., time to a start of illumination).

Figure 5:
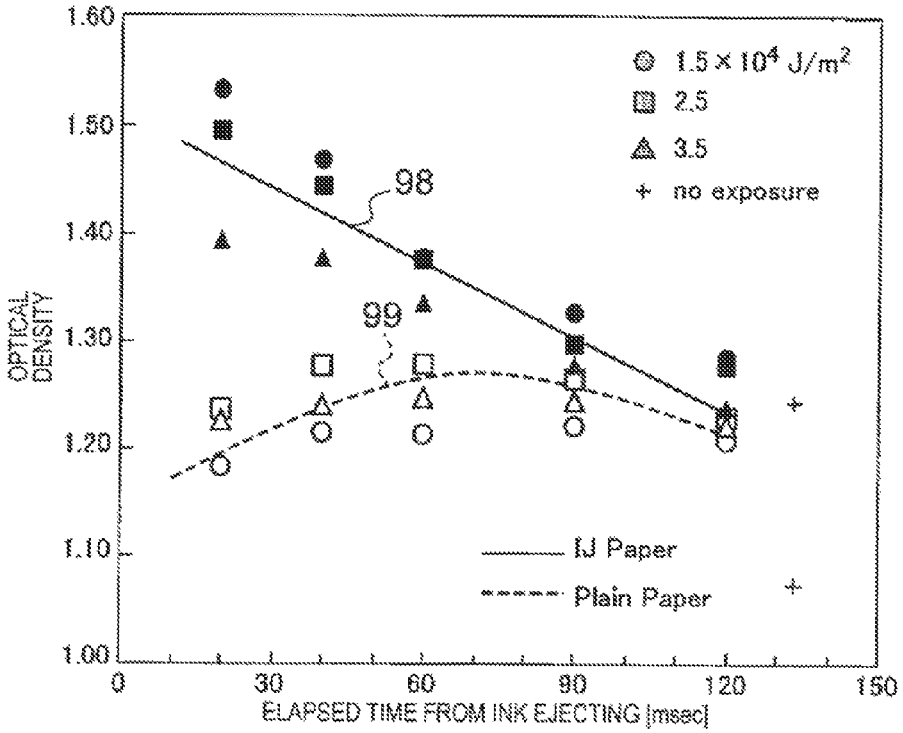
FIG. 5 is a graph showing relationships between the time to a start of illumination and the optical density for two types of sheet.

FIG. 5 is a graph showing this phenomenon, that is, experimental results showing optical density variations in cases that the printing speed was set at 1,000 mm/s and the laser light illumination amount of the laser drying unit 56 was set at 0, $1.5\times10^4$, $2.5\times10^4$, and $3.5\times10^4$ J/m$^2$. The horizontal axis and the vertical axis of the graph represent the time to a start of illumination and the optical density, respectively. The optical density is a logarithmic representation of the degree of absorption of light by ink droplets. The larger the optical density, the lower the light transmittance of ink droplets, that is, the higher the density of the ink droplets.

Curve 98 represents an optical density characteristic of a case that inkjet-dedicated sheets which were subjected to treatment for accelerating absorption/permeation while suppressing blooming were used as sheets P. The optical density is highest when the time to a start of illumination is equal to about 20 ms, and tends to decrease as the time to a start of illumination increases. When the time to a start of illumination is approximately equal to 120 ms, the optical density is approximately the same as in the case of no illumination with laser light.

On the other hand, curve 99 represents an optical density characteristic of a case that plain paper sheets which were not subjected to the treatment to be performed on inkjet-dedicated sheets and hence longer in ink permeation time than inkjet-dedicated sheets ware used as sheets P. In the case of plain paper sheets, the optical density increases with the time to a start of illumination until the latter reaches about 60 ms; that is, the optical density becomes highest when the time to a start of illumination is approximately equal to 60 ms. The optical density tends to decrease as the time to a start of illumination increases from about 60 ms.

As described above, it has become apparent that the time to a start of illumination that maximizes the optical density of an image depends on the type of sheet P, and that the time to a start of illumination that maximizes the optical density is equal to about 60 ms for plain paper sheets and about 20 ms for inkjet-dedicated sheets.

In the following, a detailed description will be made of how the inkjet recording apparatus 12 works in which the position of the laser drying unit 56 is controlled in accordance with a type of sheet P and an image printing speed so that laser light is applied to an image with the time to a start of illumination set to a time that maximizes the optical densities of the image.

Figure 6:
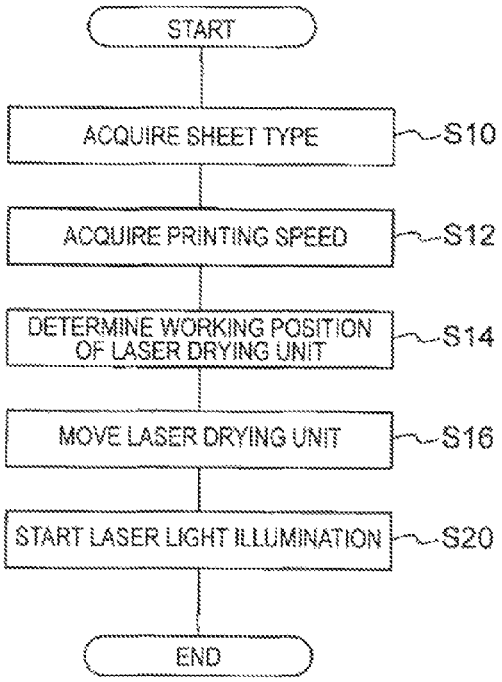
FIG. 6 is a flowchart of a time-to-start-of-illumination control program used in the first exemplary embodiment.

FIG. 6 is a flowchart of a time-to-start-of-illumination control program which is run by the CPU 70A of the computer 70 when, for example, an image formation request is received from the user.

First, at step S10, the CPU 70A acquires a type of sheet P to be used for image formation specified by the user from a predetermined storage location of the RAM 70C, for example. For example, a type of sheet P is contained in an image formation request that is received from a terminal apparatus (not shown) through communication line I/F 60. When receiving the image formation request from the communication line I/F 60, the CPU 70A stores the type of sheet P in the predetermined storage location of the RAM 70C. Alternatively, a type of sheet P commanded by a manipulation of a button 62 by the user may be received and stored in the predetermined storage location of the RAM 70C.

At step S12, the CPU 70A acquires one of predetermined printing speeds of the inkjet recording apparatus 12 from a predetermined storage location of the nonvolatile memory 70D, for example. The inkjet recording apparatus 12 is configured so as to enable selection of a printing speed to be used from plural predetermined printing speeds. For example, a printing speed to be used that is transmitted from a terminal apparatus (not shown) may be received through the communication line I/F 60 and stored in the predetermined storage location of the nonvolatile memory 70D. For another example, a printing speed to be used that is input by the user by manipulating the buttons 62 may be received and stored in the predetermined storage location of the nonvolatile memory 70D.

In the inkjet recording apparatus 12 according to this exemplary embodiment, a printing speed to be used is selected from 50, 100, and 200 m/min.

At step S14, the CPU 70A acquires a distance (maximum density distance) from a position (ink droplets ejecting position) on a sheet P in the conveying direction where ink droplets ejected from the nozzles of the head array 30 reach to the center (laser light illumination position) in the conveying direction of an illumination range laser light emitted from the laser light emitting elements of the laser drying unit 56 by referring to a laser light illumination position table on the basis of the type of sheet P acquired at step S10 and the printing speed of the inkjet recording apparatus 12 acquired at step S12.

The laser light illumination position table is a table of maximum density distances that were calculated as distances at which maximum optical densities can be given to an image, for the respective combinations from the predetermined printing speeds and the types of sheet P according to the experimental results of FIG. 5. The laser light illumination position table is stored in, for example, a predetermined storage location of the nonvolatile memory 70D in advance.

That is, it can be said that the laser light illumination position table shows such distances in the conveying direction from the ink droplets ejecting position of the head array 30 to a laser light illumination position that the time to a start of illumination becomes equal to about 20 ms for inkjet-dedicated sheets and about 60 ms for plain paper sheets.

Table 1 shows an example laser light illumination position table (unit: mm).

TABLE 1

| | | Sheet type | |
|---|---|---|---|
| | | Inkjet-dedicated | Plain paper |
| Printing speed (m/min) | 50 | 16.7 | 50 |
| | 100 | 33.3 | 100 |
| | 200 | 66.7 | 200 |

At step S16, the CPU 70A moves the laser drying unit 56 in the conveying direction by controlling the laser drying unit conveying motor 88 so that the density reading sensor 58 will be placed at the position of the maximum density distance acquired at step S14.

Figure 7:
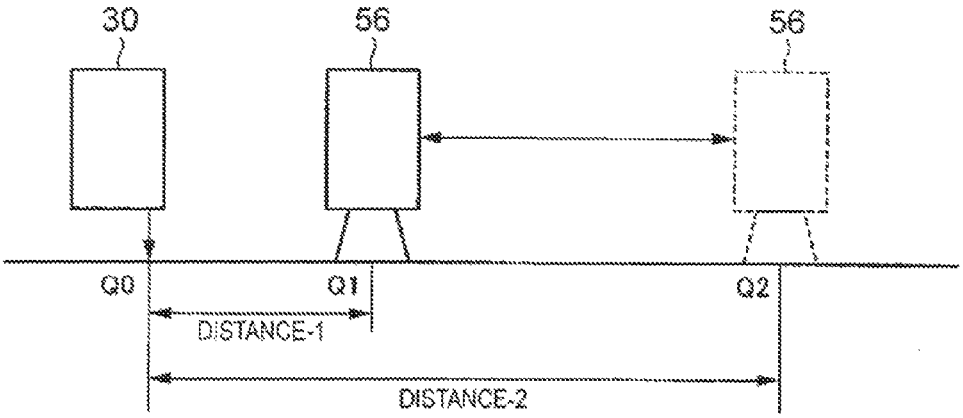
FIG. 7 is a schematic diagram illustrating how the laser drying unit is moved in the first exemplary embodiment.

FIG. 7 illustrates how the laser drying unit 56 is moved when step S16 is executed. As shown in FIG. 7, in this exemplary embodiment, the ink droplets ejecting position Q0 of the head array 30 is fixed and the laser light illumination position of the laser drying unit 56 is changed to position Q1 or Q2, for example. For example, when the printing speed is 50 m/min and the type of sheet P is the inkjet-dedicated sheet, the laser drying unit 56 is moved to position Q1 so that the distance from the ink droplets ejecting position Q0 to the laser light illumination position becomes equal to 16.7 mm. When the printing speed is 50 m/min and the type of sheet P is the plain paper sheet, the laser drying unit 56 is moved to position Q2 so that the distance from the ink droplets ejecting position Q0 to the laser light illumination position becomes equal to 50 mm.

At step S20, the CPU 70A controls the laser drying unit 56 to cause it to start laser light illumination to dry the ink droplets that constitute an image formed on the sheet P.

As described above, in this exemplary embodiment, the distance between the head array 30 and the laser drying unit 56 in the conveying direction is changed in accordance with a printing speed and a type of sheet P by moving the laser drying unit 56 so that laser light is applied to an image formed on a sheet P with such timing that the optical densities of the image are maximized.

Therefore, even if at least one of the printing speed and the type of sheet P is changed, it is expected that the effect of suppressing reduction of the optical densities of an image can be maintained. Since the optical densities of an image can be increased by illuminating the image with laser light, an advantage is expected that the amounts of inks necessary to realize a certain density is reduced and hence the running cost is lowered.

Since the laser light illumination timing is controlled by moving the laser drying unit 56 in the conveying direction, the number of laser drying units 56 can be made smaller than in a case that the laser light illumination timing is controlled by arranging plural laser drying units 56 in the conveying direction.

The laser light illumination timing is not limited to timing that maximizes the optical densities of an image. The laser drying unit 56 may be moved so that laser light is applied with such timing as to produce predetermined optical densities.

Although in this exemplary embodiment the laser drying unit 56 is moved in the conveying direction, the method for varying the distance in the conveying direction from the ink droplets ejecting position Q0 to the laser light illumination position is not limited to it. For example, in a mode in which the illuminating unit includes the laser drying unit 56 and an optical member such as a mirror and laser light is input from the laser drying unit 56 to the optical member and applied to a sheet P with the laser light illumination direction changed by the optical member, the distance in the conveying direction from the ink droplets ejecting position Q0 to the laser light illumination position may be varied by moving the optical member in the conveying direction. In a broad sense, this mode in which the laser light illumination position is varied by moving the optical member rather than the laser drying unit 56 is included in the mode in which the laser drying unit 56 is moved.

Exemplary Embodiment 2

Whereas in the first exemplary embodiment the timing of applying laser light to an image is varied by moving the laser drying unit 56, in a second exemplary embodiment the timing of applying laser light to an image is varied by using plural laser drying units 56.

Figure 8:
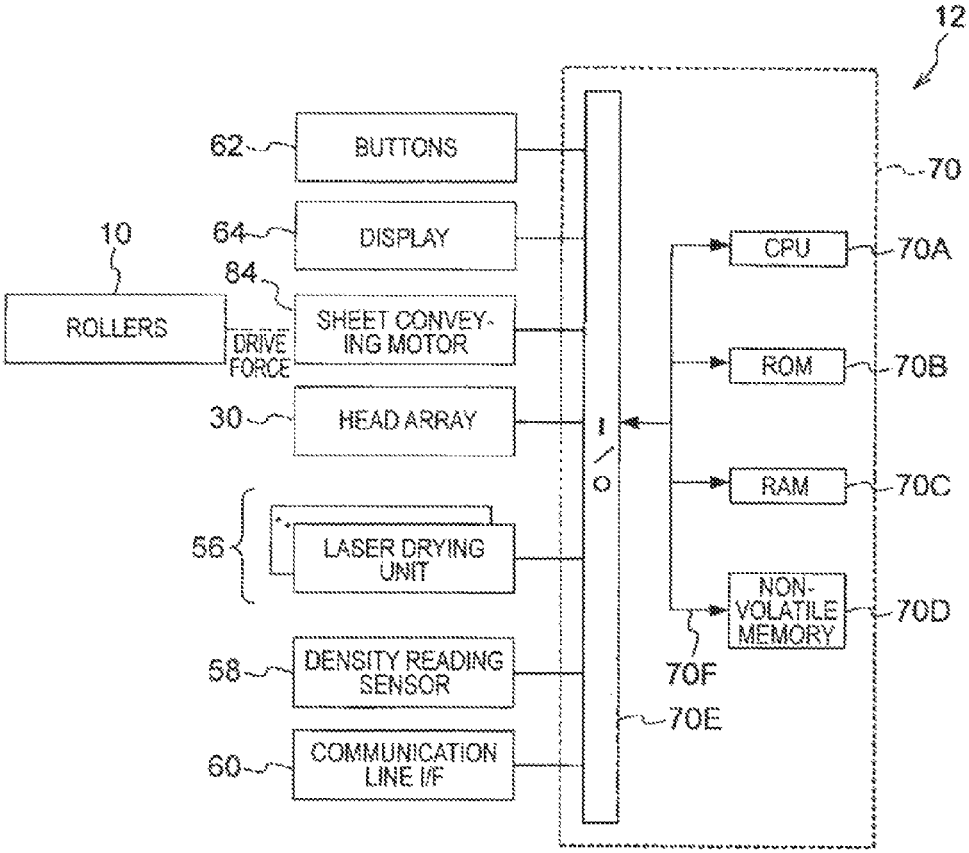
FIG. 8 is a block diagram showing the configuration of an essential part of an electrical system of an inkjet recording apparatus according to a second exemplary embodiment.

FIG. 8 is a block diagram showing the configuration of an essential part of an electrical system of an inkjet recording apparatus 12 according to this exemplary embodiment. The electrical system shown in FIG. 8 is different from that shown in FIG. 4 (first exemplary embodiment) in that the laser drying unit conveying motor 88 is eliminated and plural laser drying units 56 are connected to the I/O 70E.

Figure 9:
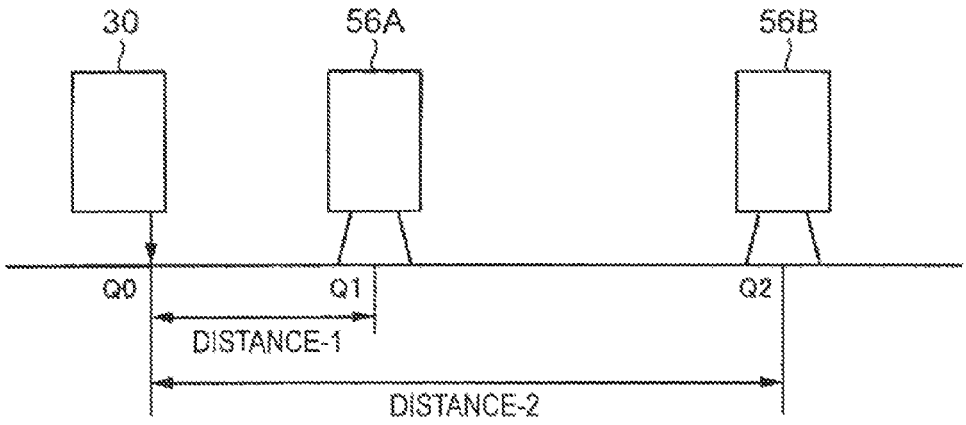
FIG. 9 is a schematic diagram illustrating positional relationships between a head array and laser drying units in the second exemplary embodiment.

First, arrangement positions of the plural laser drying units 56 in the conveying direction will be described with reference to FIG. 9. FIG. 9 illustrates positional relationships between the head array 30 and the laser drying units 56 when the inkjet recording apparatus 12 is viewed from the side.

In this exemplary embodiment, the head array 30 and the plural laser drying unit 56 are disposed at predetermined positions in the conveying direction. For example, a laser drying unit 56A is disposed at such a position that the distance from an ink droplets ejecting position Q0 of the head array 30 to its laser light illumination position Q1 is equal to distance-1.

Distance-1 is a maximum density distance in the case where the type of sheet P is the inkjet-dedicated sheet, that is, a distance corresponding to one of the printing speeds for the inkjet-dedicated sheet (type of sheet P) in the laser light illumination position table (Table 1). For example, when the printing speed is 100 m/min, the optical densities of an image are maximized by disposing the laser drying unit 56A so that its laser light illumination position is located at a position that is distant from the ink droplets ejecting position Q0 by 33.3 mm in the conveying direction.

Likewise, a laser drying unit 56B is disposed at such a position that the distance from the ink droplets ejecting position Q0 to its laser light illumination position Q2 is equal to distance-2.

Distance-2 is a maximum density distance in the case where the type of sheet P is the plain paper sheet, that is, a distance corresponding to one of the printing speeds for the plain paper sheet (type of sheet P) in the laser light illumination position table (Table 1). For example, when the printing speed is 100 m/min, the optical densities of an image are maximized by disposing the laser drying unit 56B so that its laser light illumination position is located at a position that is distant from the ink droplets ejecting position Q0 by 100 mm in the conveying direction.

To simplify the description, FIG. 9 shows only the two laser drying unit 56A and 56B. Actually, the laser drying units 56 are disposed in advance at such positions that the distances from the ink droplets ejecting position Q0 of the head array 30 to their laser light illumination positions are equal to the maximum density distances corresponding to all the combinations from the printing speeds and the types of sheet P, respectively, whereby laser light is applied to a sheet P with such timing that the optical densities of the image are maximized for every combination from the printing speeds and the types of sheet P to be employed by the inkjet recording apparatus 12.

In the following, a detailed description will be made of how the inkjet recording apparatus 12 works in which the laser light illumination position is controlled in accordance with a type of sheet P and an image printing speed so that laser light is applied to an image with the time to a start of illumination set to a time that maximizes the optical densities of the image.

Figure 10:
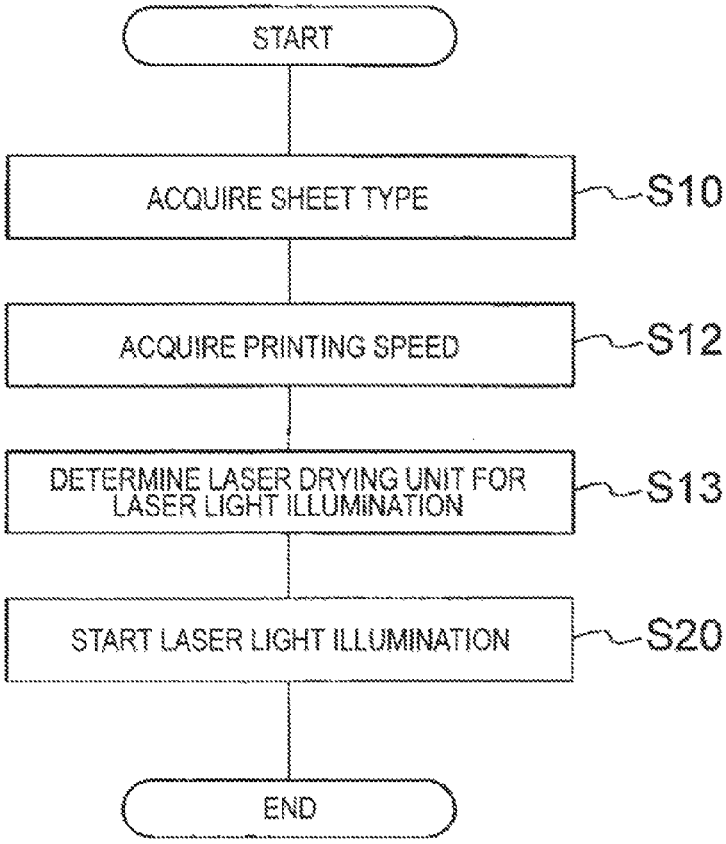
FIG. 10 is a flowchart of a time-to-start-of-illumination control program used in the second exemplary embodiment.

FIG. 10 is a flowchart of a time-to-start-of-illumination control program which is run by the CPU 70A of the computer 70 when, for example, an image formation request is received from the user. The flowchart of FIG. 10 is different from the flowchart of FIG. 6 (first exemplary embodiment) in that step S13 replaces steps S14 and S16.

At step S13, the CPU 70A acquires an identifier that uniquely indicates a laser drying unit 56 to apply laser light to a sheet P from identifiers of the plural laser drying units 56 by referring to a laser light illumination unit table on the basis of the type of sheet P acquired at step S10 and the printing speed of the inkjet recording apparatus 12 acquired at step S12.

The laser light illumination unit table is a table of identifiers of laser drying units 56 that are determined in advance as ones for applying laser light to an image with such timing that maximum optical densities can be given to the image for all the combinations from the predetermined printing speeds and the types of sheet P to be employed by the inkjet recording apparatus 12. The laser light illumination unit table is stored in, for example, a predetermined storage location of the non-volatile memory 70D in advance.

Table 2 shows an example laser light illumination unit table.

TABLE 2

| | | Sheet type | |
|---|---|---|---|
| | | Inkjet-dedicated | Plain paper |
| Printing speed (m/min) | 50 | 56A | 56B |
| | 100 | 56C | 56D |
| | 200 | 56E | 56F |

At step S20, the CPU 70A controls the laser drying unit 56 having the identifier acquired at step S13 to cause it to start laser light illumination and thereby dries an image.

As described above, in this exemplary embodiment, the laser drying units 56 are disposed in advance at the positions having the maximum density distances from the head array 30 for all the combinations from the predetermined printing speeds and the types of sheet P to be employed by the inkjet recording apparatus 12, whereby laser light is applied to an image with such timing that the optical densities of the image are maximized.

Therefore, no mechanism for driving a laser drying unit 56 is necessary and hence increase of failure resistance is expected. The laser light illumination timing is not limited to timing that maximizes the optical densities of an image. The laser drying units 56 may be disposed at such positions that laser light is applied with such timing as to produce predetermined optical densities.

Exemplary Embodiment 3

In the second exemplary embodiment, the timing of applying laser light to an image is varied by disposing the plural laser drying units 56 at the positions having the maximum density distances from the head array 30, respectively. In a third exemplary embodiment, the timing of applying laser light to an image is varied using a surface-emission laser device which replaces the plural laser drying units 56.

Figure 11:
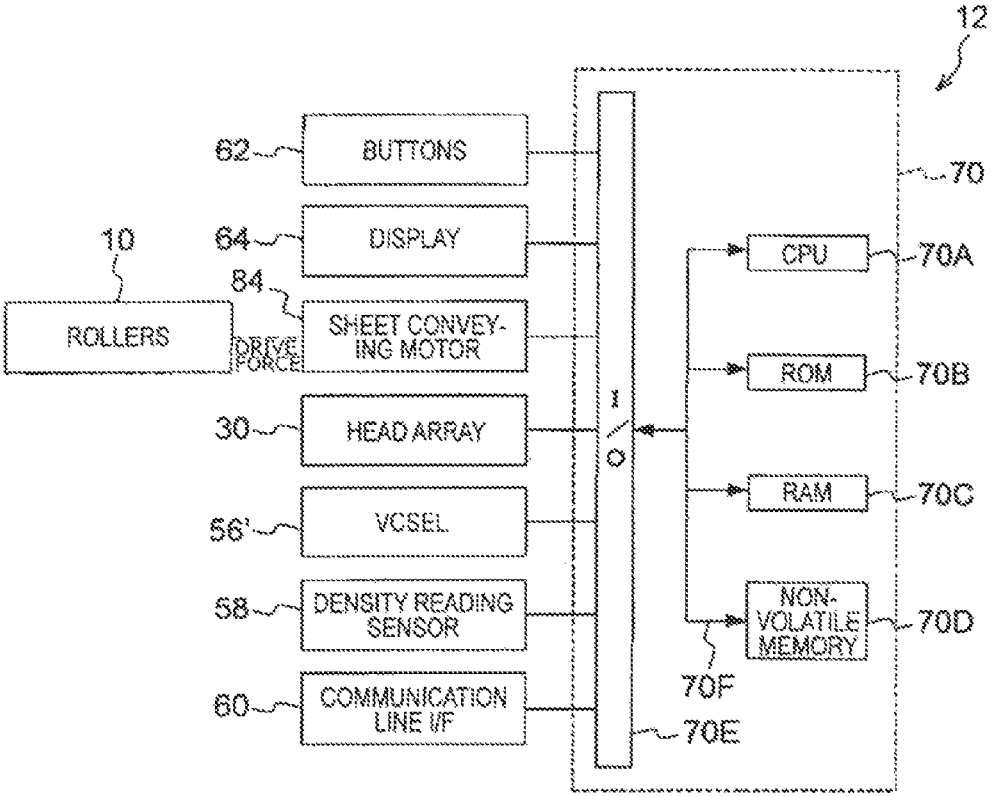
FIG. 11 is a block diagram showing the configuration of an essential part of an electrical system of an inkjet recording apparatus according to a third exemplary embodiment.

FIG. 11 is a block diagram showing the configuration of an essential part of an electrical system of an inkjet recording apparatus 12 according to this exemplary embodiment. The electrical system shown in FIG. 11 is different from that shown in FIG. 8 (second exemplary embodiment) in that a VCSEL (vertical cavity surface-emitting laser) 56' replaces the plural laser drying units 56.

Figure 12:
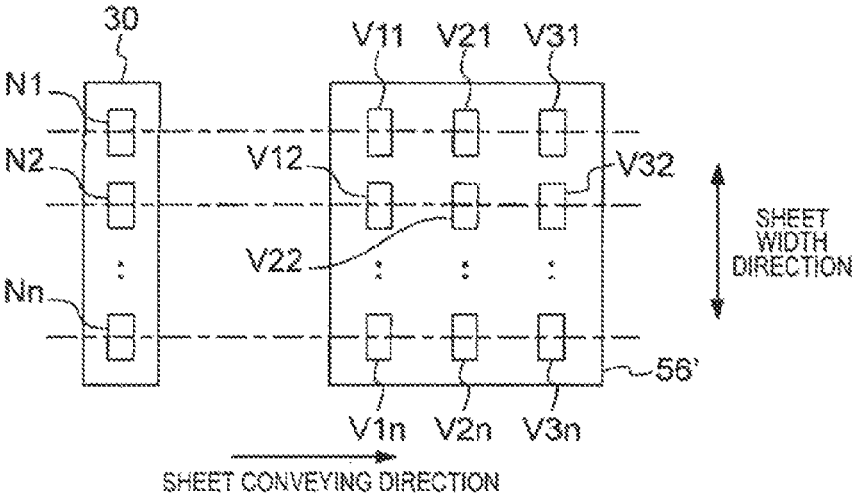
FIG. 12 is a schematic diagram illustrating positional relationships between the head array and surface-emission laser elements of a VCSEL in the third exemplary embodiment.

As shown in FIG. 12, the VCSEL 56' is a surface-emission semiconductor laser in which plural surface-emission laser elements are arranged in the conveying direction and the width direction on a surface that is opposed to a sheet P. For example, plural surface-emission laser elements V1*i*, V2*i*, and V3*i* are arranged along each of straight lines that extend in the conveying direction and pass the respective nozzles Ni (i=1, 2, . . . , n). An image portion formed by droplets ejected from the nozzle Ni is dried by illuminating the image portion with laser light beams emitted from the surface-emission laser elements V1*i*, V2*i*, or V3*i*

Although FIG. 12 shows an example VCSEL 56' having n×3 surface-emission laser elements, it goes without saying that the number of surface-emission laser elements arranged in the conveying direction is not limited to three.

Figure 13:
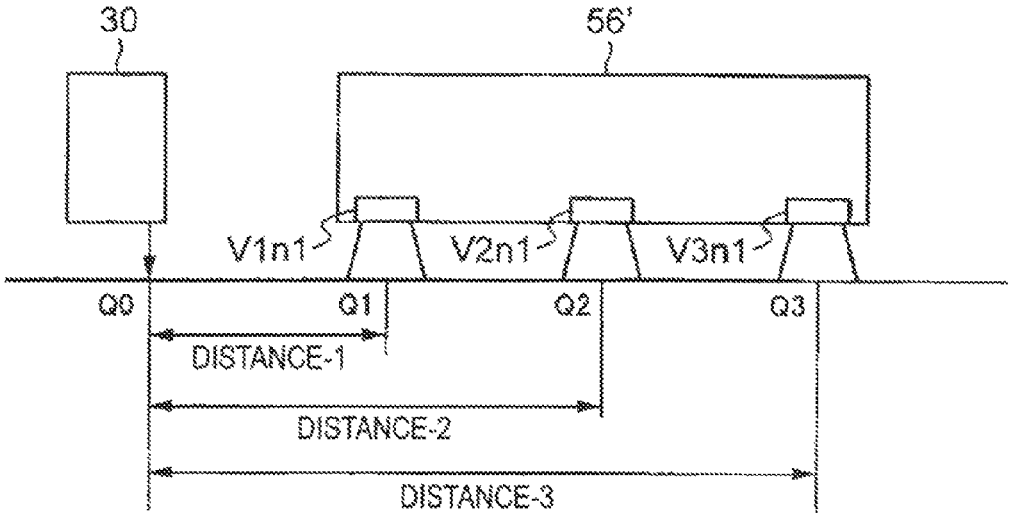
FIG. 13 is another schematic diagram illustrating positional relationships between the head array and the surface-emission laser elements of the VCSEL in the third exemplary embodiment.

Next, arrangement positions of the surface-emission laser elements of the VCSEL 56' in the conveying direction will be described with reference to FIG. 13. FIG. 13 illustrates positional relationships between the head array 30 and the surface-emission laser elements of the VCSEL 56' when the inkjet recording apparatus 12 is viewed from the side.

In this exemplary embodiment, the head array 30 and the surface-emission laser elements of the VCSEL 56' are disposed at predetermined positions in the conveying direction.

Since as described above with reference to FIG. 12 the plural surface-emission laser elements of the VCSEL 56' are arranged in the conveying direction, the distances to the ink droplets ejecting position Q0 of the head array 30 to the respective surface-emission laser elements V1$n_1$, V2$n_1$, and V3$n_1$ ($n_1$=1, 2, . . . , n) of the VCSEL 56' are different from each other.

Therefore, for example, where the type of sheet P is the inkjet-dedicated sheet and the printing speed is 100 m/min, an image is given maximum optical densities if surface-emission laser elements (e.g., surface-emission laser elements V1$n_1$) that are spaced from the ink droplets ejecting position Q0 by 33.3 mm in the conveying direction are selected according to Table 1 and laser light is applied to the image from the selected surface-emission laser elements V1$n_1$.

Therefore, for another example, where the type of sheet P is the inkjet-dedicated sheet and the printing speed is 200 m/min, an image is given maximum optical densities if surface-emission laser elements (e.g., surface-emission laser elements V2$n_1$) that are spaced from the ink droplets ejecting position Q0 by 66.7 mm in the conveying direction are selected according to Table I and laser light is applied to the image from the selected surface-emission laser elements V2$n_1$.

For a further example, where the type of sheet P is the plain paper sheet and the printing speed is 100 m/min, an image is given maximum optical densities if surface-emission laser elements (e.g., surface-emission laser elements V3$n_1$) that are spaced from the ink droplets ejecting position Q0 by 100 mm in the conveying direction are selected according to Table 1 and laser light is applied to the image from the selected surface-emission laser elements $V3n_1$.

That is, the VCSEL 56' is disposed so that the laser light illumination positions of its surface-emission laser elements are located at positions having the maximum density distances corresponding to all the combinations from the printing speeds and the types of sheet P to be employed by the inkjet recording apparatus 12.

In the following, a detailed description will be made of how the inkjet recording apparatus 12 works in which the laser light illumination position is controlled in accordance with a type of sheet P and an image printing speed so that laser light is applied to an image with the time to a start of illumination set to a time that maximizes the optical densities of the image.

Figure 14:
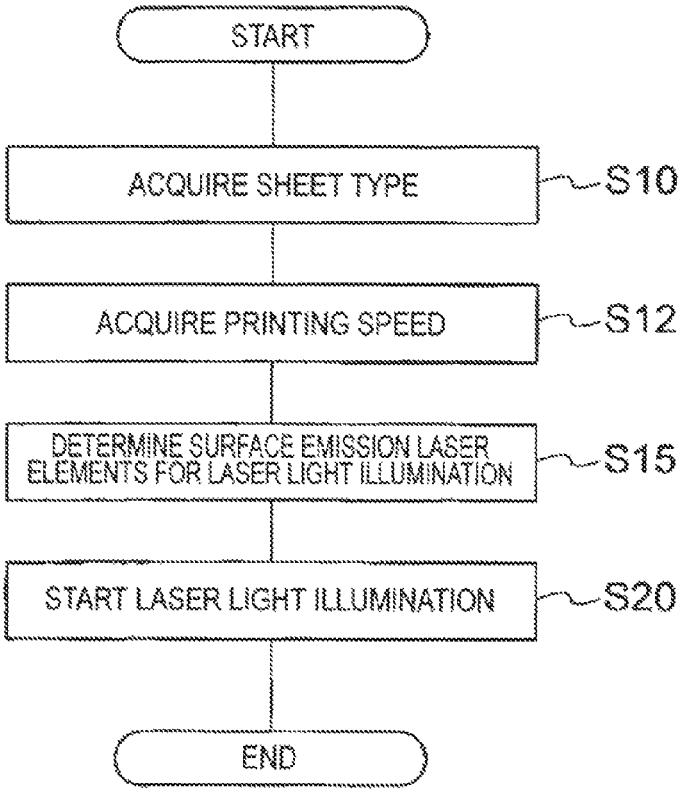
FIG. 14 is a flowchart of a time-to-start-of-illumination control program used in the third exemplary embodiment.

FIG. 14 is a flowchart of a time-to-start-of-illumination control program which is run by the CPU 70A of the computer 70 when, for example, an image formation request is received from the user. The flowchart of FIG. 14 is different from the flowchart of FIG. 10 (second exemplary embodiment) in that step S15 replaces step S13.

At step S15, the CPU 70A acquires identifiers that uniquely indicate surface-emission laser elements to emit laser light from identifiers of the surface-emission laser elements of the VCSEL 56' by referring to a VCSEL table on the basis of the type of sheet P acquired at step S10 and the printing speed of the inkjet recording apparatus 12 acquired at step S12.

The VCSEL table is a table of identifiers of surface-emission laser elements that are determined in advance as ones for applying laser light to an image with such timing that maximum optical densities can be given to the image for all the combinations from the predetermined printing speeds and the types of sheet P to be employed by the inkjet recording apparatus 12. The VCSEL table is stored in, for example, a predetermined storage location of the nonvolatile memory 70D in advance.

Table 3 shows an example VCSEL table.

TABLE 3

| | | Sheet type | |
|---|---|---|---|
| | | Inkjet-dedicated | Plain paper |
| Printing speed (m/min) | 50 | V11, . . . , V1n | V21, . . . , V2n |
| | 100 | V31, . . . , V3n | V41, . . . , V4n |
| | 200 | V51, . . . , V5n | V61, . . . , V6n |

At step S20, the CPU 70A controls the laser light emission by the VCSEL 56' so that surface-emission laser elements having the identifiers acquired at step S15 emit laser light among the surface-emission laser elements of the VCSEL 56'.

As described above, in this exemplary embodiment, the VCSEL 56' is disposed so that the laser light illumination positions of its surface-emission laser elements are located at the positions having the maximum density distances for all the combinations from the predetermined printing speeds of the inkjet recording apparatus 12 and the types of sheet P to be employed by the inkjet recording apparatus 12, whereby laser light is applied to an image with such timing that the optical densities of the image are maximized.

As a result, the number of components can be made smaller than in the second exemplary embodiment which employs the plural laser drying units 56. It is therefore expected that the inkjet recording apparatus 12 can be reduced in size and the number of assembling steps.

The laser light illumination timing is not limited to timing that maximizes the optical densities of an image. The VCSEL 56' may be disposed at such a position that laser light is applied with such timing as to produce predetermined optical densities.

Exemplary Embodiment 4

In the first to third exemplary embodiments, the time to a start of illumination is controlled by varying the distance from the ink droplets ejecting position Q0 to the laser light illumination position in accordance with a printing speed and a type of sheet P specified by the user in advance. In a fourth exemplary embodiment, the printing speed is varied in accordance with the distance from the ink droplets ejecting position Q0 to the laser light illumination position and a type of sheet P.

The essential part of the electrical system of an inkjet recording apparatus 12 according to this exemplary embodiment is different from that shown in FIG. 11 (third exemplary embodiment) in that the laser drying unit 56 replaces the VCSEL 56'.

Figure 15:
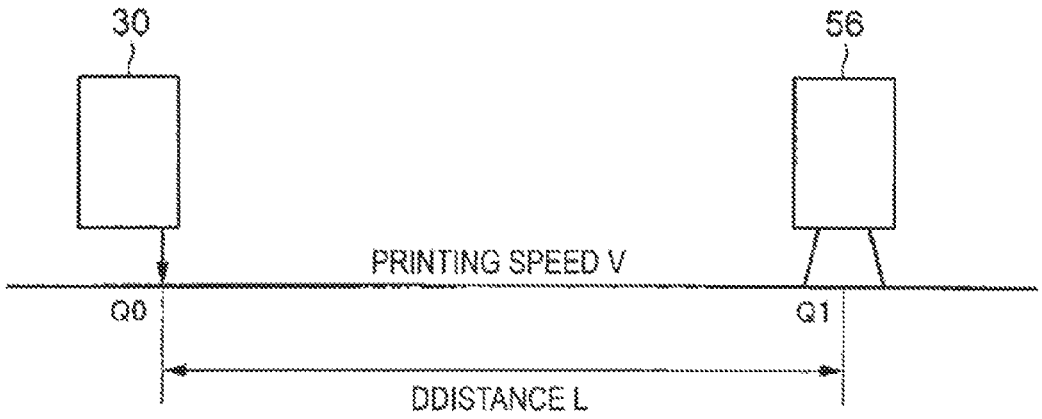
FIG. 15 is a schematic diagram illustrating a positional relationship between the head array and the laser drying unit in a fourth exemplary embodiment.

FIG. 15 illustrates a positional relationship between the head array 30 and the laser drying unit 56 when the inkjet recording apparatus 12 is viewed from the side. As shown in FIG. 15, the head array 30 and the laser drying unit 56 are attached to, for example, the body 14 of the inkjet recording apparatus 12 so that the distance from the ink droplets ejecting position Q0 to the laser light illumination position is set at a predetermined distance L, which is, for example, 40 mm in this exemplary embodiment.

Next, with reference to FIG. 16, a detailed description will be made of how the inkjet recording apparatus 12 configured as shown in FIG. 15 works in which the laser light illumination timing is controlled in accordance with a type of sheet P and the distance L so that laser light is applied to an image with the time to a start of illumination set to a time that maximizes the optical densities of the image.

Figure 16:
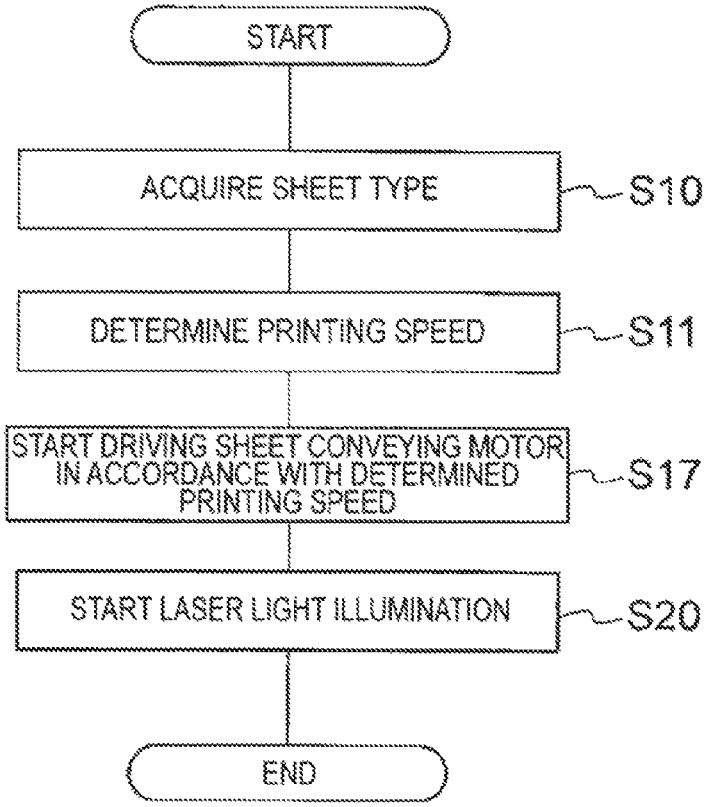
FIG. 16 is a flowchart of a time-to-start-of-illumination control program used in the fourth exemplary embodiment.

FIG. 16 is a flowchart of a time-to-start-of-illumination control program which is run by the CPU 70A of the computer 70 when, for example, an image formation request is received from the user.

First, at step S10, the CPU 70A acquires a type of sheet P in the same manner as in the first to third embodiments. At step S11, the CPU 70A determines a printing speed for image formation by, for example, by referring to a printing speed table on the basis of the distance L which is stored in, for example, a predetermined storage location of the nonvolatile memory in advance and the type of sheet P acquired at step S10.

The printing speed table is a table of printing speeds that were calculated as printing speeds at which maximum optical densities can be given to an image, for the respective combinations from the distance L and the types of sheet P according to the experimental results of FIG. 5. The printing speed table is stored in, for example, a predetermined storage location of the nonvolatile memory 70D in advance.

That is, it can be said that the printing speed table shows printing speeds at which the time to a start of illumination becomes equal to about 20 ms for inkjet-dedicated sheets and about 60 ms for plain paper sheets for the distance L.

Table 4 shows an example printing speed table (unit: m/min).

TABLE 4

| | | Sheet type | |
|---|---|---|---|
| | | Inkjet-dedicated | Plain paper |
| Distance L(mm) | 40 | 120 | 40 |

At step S17, the CPU 70A adjusts the conveying speed of a sheet P so that the printing speed becomes equal to the value determined at step S11 by controlling, for example, the voltage that is supplied to the sheet conveying motor 84.

Although in this exemplary embodiment the laser drying unit 56 is fixed, that is, attached at a predetermined position, the distance L may be varied by, for example, moving the laser drying unit 56 in the conveying direction as in the first exemplary embodiment.

In this case, a printing speed of the inkjet recording apparatus 12 may be determined in the following manner. A printing speed table showing printing speeds for respective combinations from the types of sheet P and plural distances L is stored in, for example, a predetermined storage location of the nonvolatile memory 70D in advance. After a distance L is calculated by, for example, measuring a physical quantity (e.g., the number of pulses) corresponding to a motor rotation angle that is communicated from the laser drying unit conveying motor 88, a printing speed is determined by referring to the printing speed table.

As described above, in this exemplary embodiment, laser light is applied to an image with such timing that maximum optical densities are given to the image by adjusting the printing speed of the inkjet recording apparatus 12 in accordance with a type of sheet P and the distance L between the head array 30 and the laser drying unit 56.

As a result, the devices as used in the first to third exemplary embodiments, such as the laser drying unit conveying motor 88, the plural laser drying units 56, and the VCSEL 56', are not necessary and hence cost reduction is expected.

The laser light illumination timing is not limited to timing that maximizes the optical densities of an image. The printing speed may be adjusted so that laser light is applied with such timing as to produce predetermined optical densities.

Exemplary Embodiment 5

In inkjet recording apparatus 12 according to the first to third exemplary embodiments, the timing of applying laser light to an image is controlled by varying the laser light illumination position of the laser drying unit(s) 56 or the VCSEL 56' with respect to the common ink droplets ejecting position Q0. An inkjet recording apparatus 12 according to a fifth exemplary embodiment is different from the inkjet recording apparatus 12 according to the first to third exemplary embodiments in that the timing of applying laser light to an image is controlled by varying the ink droplets ejecting position of the head array 30 with respect to a common laser light illumination position.

Figure 17:
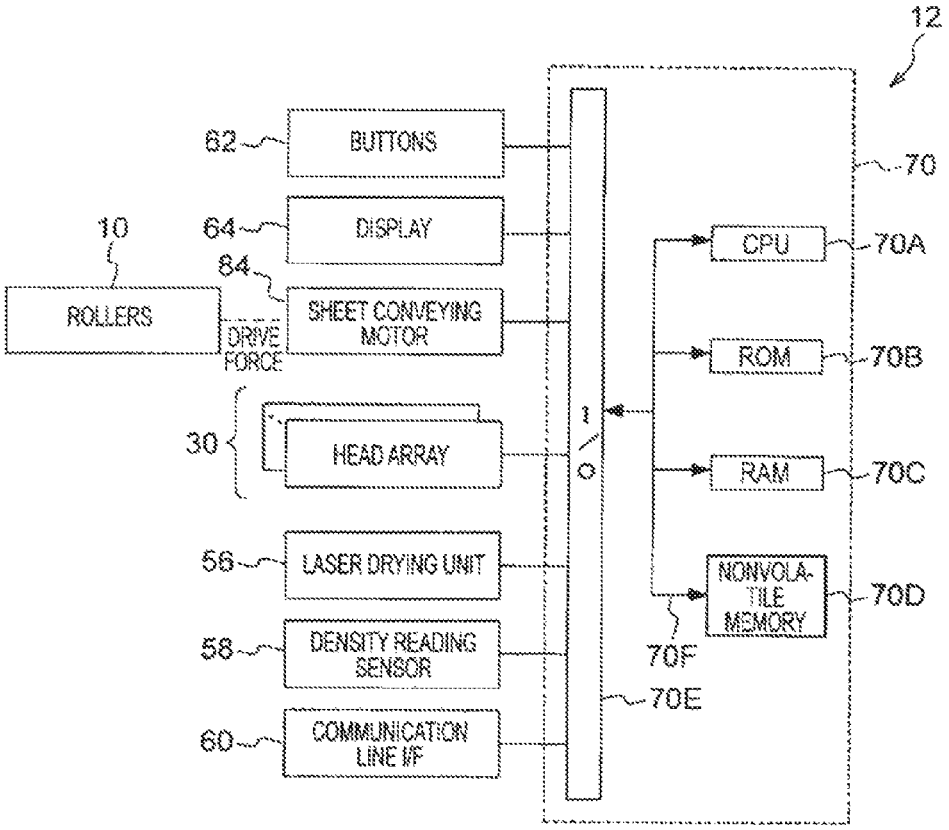
FIG. 17 is a block diagram showing the configuration of an essential part of an electrical system of an inkjet recording apparatus according to a fifth exemplary embodiment.

FIG. 17 is a block diagram showing the configuration of an essential part of the electrical system of an inkjet recording apparatus 12 according to this exemplary embodiment. As shown in FIG. 17, in this exemplary embodiment, plural head arrays 30 are connected to the I/O 70E.

Figure 18:
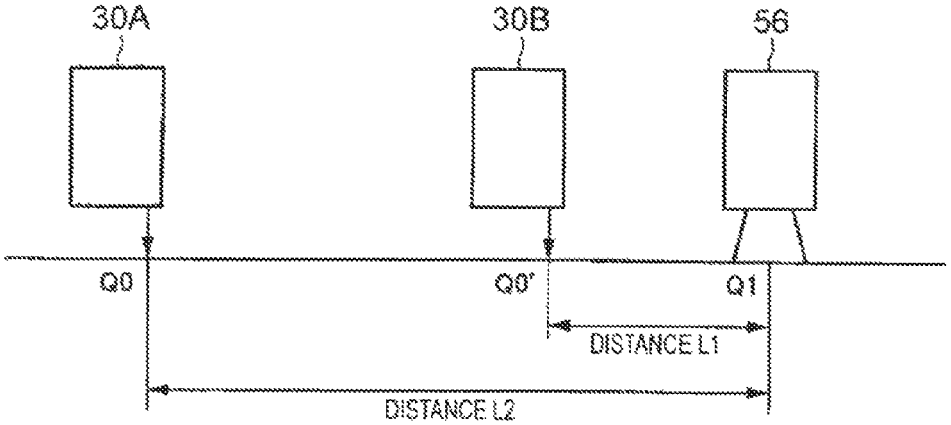
FIG. 18 is a schematic diagram illustrating positional relationships between the laser drying unit and plural head arrays in the fifth exemplary embodiment.

Next, a description will be made of arrangement positions, in the conveying direction, of the plural head arrays 30 used in this exemplary embodiment. FIG. 18 illustrates positional relationships between the laser drying unit 56 and the plural head arrays 30 when the inkjet recording apparatus 12 is viewed from the side. Although the following description will be directed to the inkjet recording apparatus 12 which is equipped with two head arrays 30A and 30B, the inkjet recording apparatus 12 may be equipped with three or more head arrays 30.

As shown in FIG. 18, the head array 30A is attached to, for example, the body 14 of the inkjet recording apparatus 12 so that the distance from the ink droplets ejecting position Q0 to the laser light illumination position Q1 of the laser drying unit 56 is set at a predetermined distance L2. The head array 30B is attached to, for example, the body 14 of the inkjet recording apparatus 12 so that the distance from the ink droplets ejecting position Q0 to the laser light illumination position Q1 of the laser drying unit 56 is set at a predetermined distance L1. For example, the distances L1 and L2 are 40 mm and 120 mm, respectively.

When the printing speed of the inkjet recording apparatus 12 is 120 m/min and the type of sheet P is the inkjet-dedicated sheet, laser light is applied to ink droplets from the laser drying unit 56 about 20 ms after ejecting of the ink droplets from the head array 30B. The time to a start of illumination, about 20 ms, is a time that maximizes the optical densities of an image formed on an inkjet-dedicated sheet.

When the printing speed of the inkjet recording apparatus 12 is 120 m/min and the type of sheet P is the plain paper sheet, laser light is applied to ink droplets from the laser drying unit 56 about 60 ms after ejecting of the ink droplets from the head array 30A. The time to a start of illumination, about 60 ms, is a time that maximizes the optical densities of an image formed on a plain paper sheet.

That is, the head arrays 30A and 30B are disposed at positions that provide maximum density distances to the laser drying unit 56 in accordance with the types of sheet P and a printing speed of the inkjet recording apparatus 12.

In the following, a detailed description will be made of how the inkjet recording apparatus 12 works in which the ink droplets ejecting position is controlled in accordance with a type of sheet P and an image printing speed so that laser light is applied to an image with the time to a start of illumination set to a time that maximizes the optical densities of the image.

Figure 19:
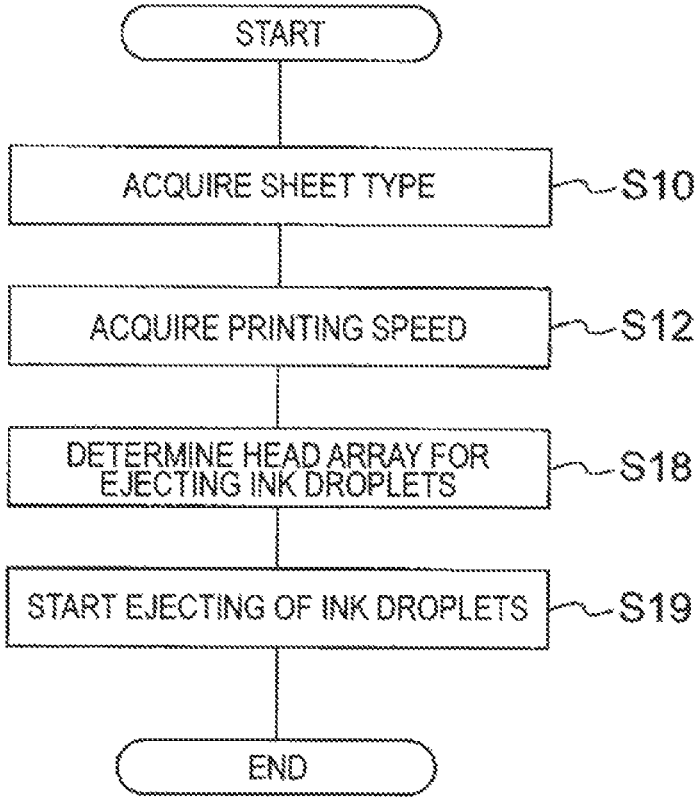
FIG. 19 is a flowchart of a time-to-start-of-illumination control program used in the fifth exemplary embodiment.

FIG. 19 is a flowchart of a time-to-start-of-illumination control program which is run by the CPU 70A of the computer 70 when, for example, an image formation request is received from the user. The flowchart of FIG. 19 is different from the flowchart of FIG. 10 (second exemplary embodiment) in that step S18 replaces step S13.

At step S18, the CPU 70A acquires an identifier that uniquely indicates a head array 30 to eject ink droplets from identifiers of the plural head arrays 30 by referring to a head array table on the basis of the type of sheet P acquired at step S10 and the printing speed of the inkjet recording apparatus 12 acquired at step S12.

The head array table is a table of identifiers of head arrays 30 that are located in advance at such positions that maximum optical densities can be given to an image for all the combinations from the printing speeds and the types of sheet P to be employed by the inkjet recording apparatus 12. The head array table is stored in, for example, a predetermined storage location of the nonvolatile memory 70D in advance.

Table 5 shows an example head array table.

TABLE 5

| | | Sheet type | |
|---|---|---|---|
| | | Inkjet-dedicated | Plain paper |
| Printing speed (m/min) | 120 | 30B | 30A |
| | 160 | 30D | 30C |

At step S19, the CPU 70A controls the head array 30 having the identifier acquired at step S18 to cause it to eject ink droplets and also controls the laser drying unit 56 to cause it to start laser light illumination.

As described above, in this exemplary embodiment, a head array 30 with which the distance from the ink droplets ejecting position to the laser light illumination position is equal to a maximum density distance is selected from the plural head arrays 30 in accordance with a printing speed of the inkjet recording apparatus 12 and a type of sheet P. Laser light is applied to an image with such timing that the optical densities of the image are maximized by causing the selected head array 30 to eject ink droplets.

The laser light illumination timing is not limited to timing that maximizes the optical densities of an image. The head arrays 30 may be arranged at such positions that laser light is applied with such timing as to produce predetermined optical densities.

It goes without saying that in the first, fourth, and fifth exemplary embodiments the laser drying unit 56 may be replaced by the VCSEL 56' as in the third exemplary embodiment which is different from the second embodiment in that the VCSEL 56' replaces the laser drying units 56.

Exemplary Embodiment 6

In the exemplary embodiments described so far, the laser light illumination timing is controlled so that maximum optical densities (hereinafter may be referred to simply as densities) are given to an image formed on a sheet P in accordance with at least one of a type of sheet P, a printing speed of the inkjet recording apparatus 12, and the distance from an ink droplets ejecting position to a laser light illumination position in the conveying direction.

However, if laser light emission amounts of the laser light emitting elements V of the laser drying unit 56 are not uniform, resulting non-uniformity of image drying may cause density unevenness in an image formed on sheet P.

Where non-uniformity of laser light emission amounts is due to, for example, differences between production lots of laser drying units 56, the following countermeasure may be taken. In a manufacturing process of laser drying units 56, data (initial data) relating to non-uniformity of laser light emission amounts of each laser drying unit 56 are acquired in advance. Correction data indicating, for example, currents to be supplied to the respective laser light emitting elements V that lower the non-uniformity of laser light emission amounts are stored in the nonvolatile memory 70D. The non-uniformity of laser light emission amounts of the laser drying unit 56 can be suppressed by supplying currents to the respective laser light emitting elements V according to the correction data in applying laser light to an image.

However, it is difficult for the correction using correction data to accommodate non-uniformity of laser light emission amounts of the laser drying unit 56 due to its deterioration with age after the incorporation into the inkjet recording apparatus 12, cooling non-uniformity inside the inkjet recording apparatus 12, etc.

One method for compensating for non-uniformity of laser light emission amounts of the respective laser light emitting elements V due to deterioration with age or the like would be to equip the inkjet recording apparatus 12 with emission amount sensors or the like for measuring laser light emission amounts of the respective laser light emitting elements V. However, the incorporation of the emission amount sensors or the like may increase the size or cost of the inkjet recording apparatus 12.

In view of the above, a sixth exemplary embodiment provides a inkjet recording apparatus 12 which compensates for, without using emission amount sensors or the like, not only non-uniformity of laser light emission amounts due to differences between production lots of laser light emitting elements V but also non-uniformity of laser light emission amounts due to deterioration with age of the laser drying unit 56, cooling non-uniformity, or the like. In the following, a detailed description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 20:
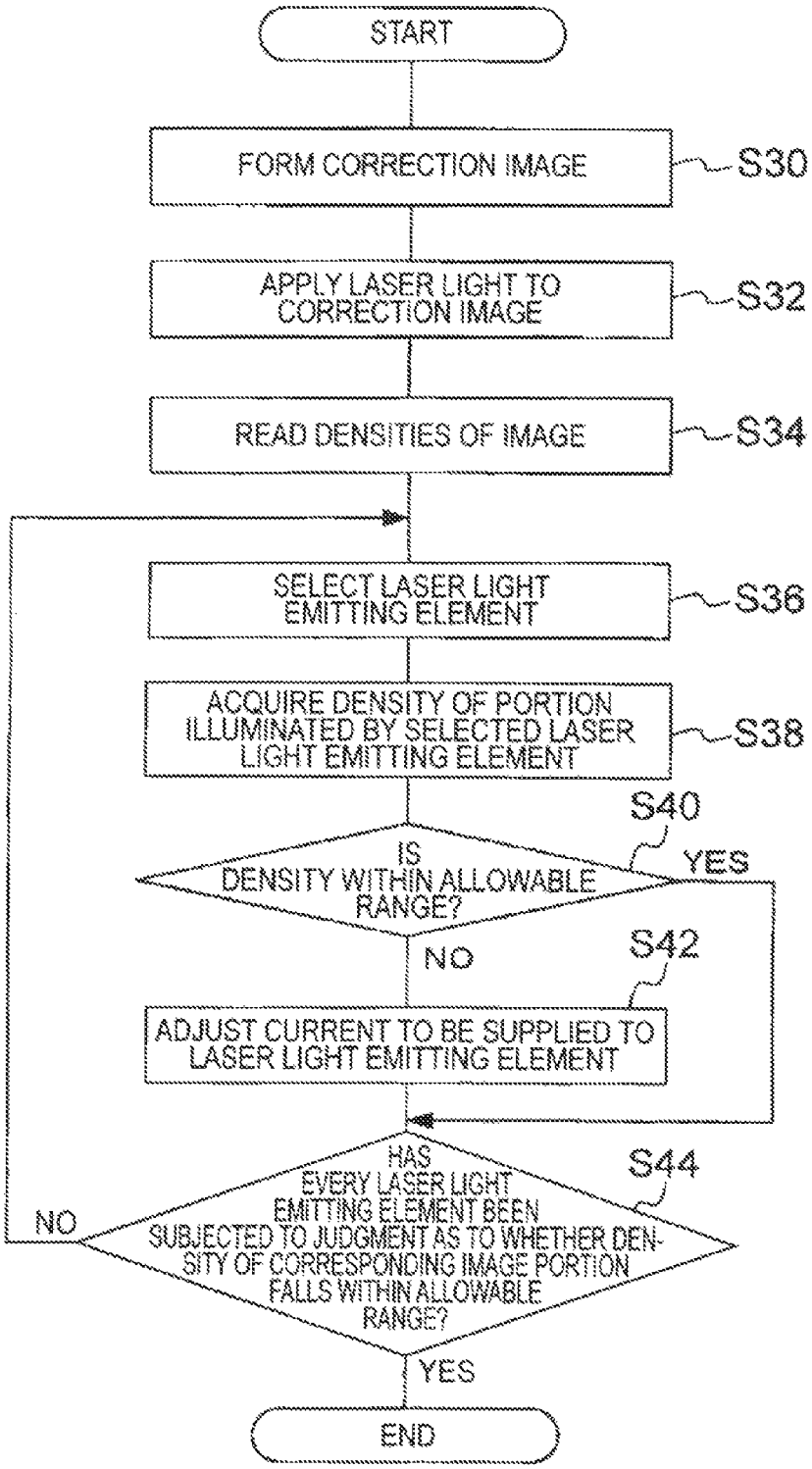
FIG. 20 is a flowchart of a laser light emission amounts correction program used in a sixth exemplary embodiment.

FIG. 20 is a flowchart of a laser light emission amounts correction program which is run by the CPU 70A of the computer 70 at a time other than some time in an image forming period, such as immediately after power-on of the inkjet recording apparatus 12 or before reception of an image formation request from the user (i.e., before a start of a job).

First, at step S30, the CPU 70A causes the head array 30 to eject, for example, K-color ink droplets onto a sheet P to form a correction image R on the sheet P. This is done while the ink droplets ejecting density is controlled so that the correction image R becomes equal to a predetermined intermediate density. Where the inkjet recording apparatus 12 has a resolution of 8 bits (256 gradations) for the density of an image to be formed, the intermediate density means a density other than the maximum and minimum densities of the 256-gradation densities, preferably a density around the center (i.e., 128th density) of the 256-gradation densities.

At step S32, the CPU 70A causes the laser drying unit 56 to apply laser light to the correction image R that was formed on the sheet P at step S30. This is done by supplying the same current (reference current) to all the laser light emitting elements V of the laser drying unit 56. It is assumed that the reference current value is stored in, for example, a predetermined storage location of the nonvolatile memory 70D.

Figure 21:
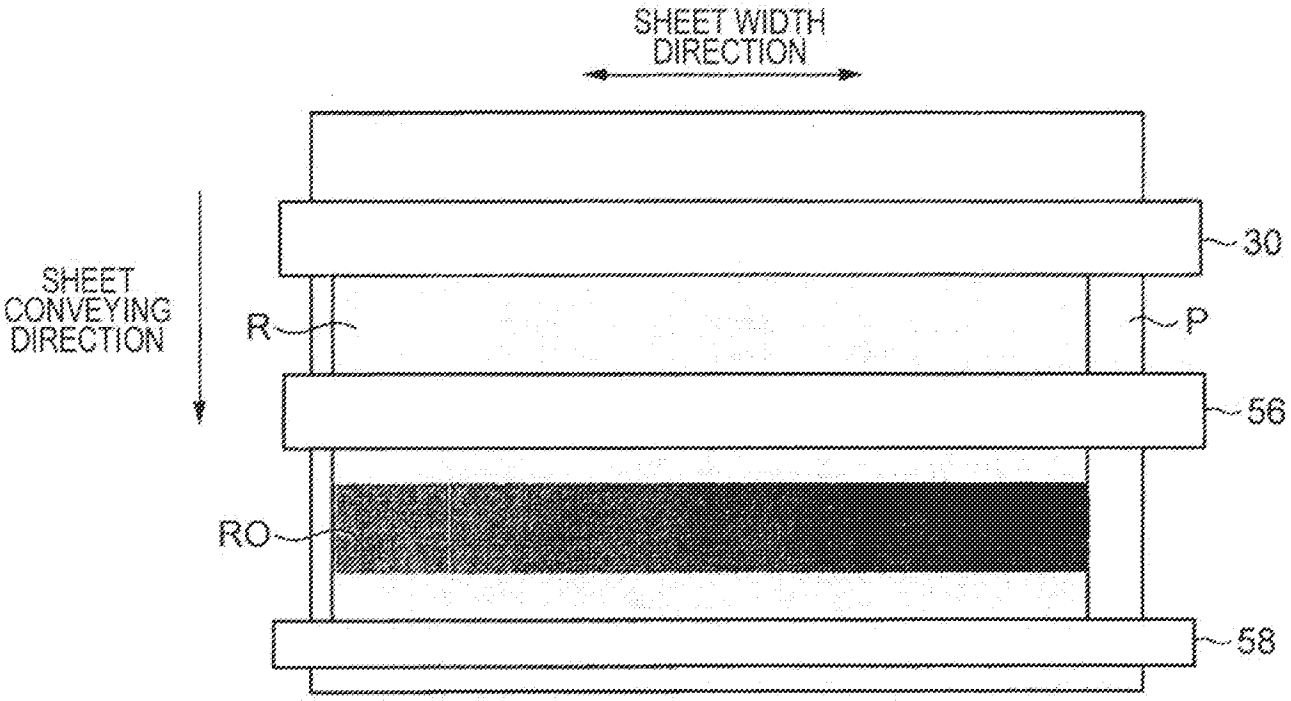
FIG. 21 is a schematic diagram illustrating densities of a laser-light-illuminated portion of a correction image in the sixth exemplary embodiment.

FIG. 21 shows the correction image R as subjected to step S32. As shown in FIG. 21, a portion illuminated with laser light emitted from the laser drying unit 56 (laser-light-illuminated portion R0) of the correction image R has a density that is different than the other portion. This is because if ink droplets are dried before permeation into the sheet P, the colorant contained in the ink droplets is fixed on the surface of the sheet P in a more cohesive manner.

If the laser light emission amounts are non-uniform due to non-uniformity of laser light emission amounts due to differences between production lots of laser light emitting elements V, deterioration with age of the laser drying unit 56, cooling non-uniformity, or the like, the non-uniformity affects the degree of drying of the image, resulting in density unevenness in the laser-light-illuminated portion R0. There are not limitations on the shape of the correction image R. this exemplary embodiment employs, as an example, a rectangular shape.

At step S34, the CPU 70A controls the density reading sensor 58 so that it reads densities of at least one line of the laser-light-illuminated portion R0 in the width direction, and acquires densities of the laser-light-illuminated portion R0 read by the respective density sensors S of the density reading sensor 58. The acquired densities are stored in, for example, a predetermined storage location of the RAM 70C so as to be correlated with identifiers that indicate the respective density sensors S uniquely.

At step S36, the CPU 70A selects one, not selected in this step yet, of the laser light emitting elements V of the laser drying unit 56.

At step S38, the CPU 70A acquires the density that was read by the density sensor S corresponding to the laser light emitting element V selected at step S36. More specifically, the CPU 70A acquires the density that was read by the density sensor S corresponding to the laser light emitting element V selected at step S36 from the predetermined storage location of the RAM 70C where the densities that were read by the respective density sensors S at step S34 are stored.

The corresponding relationship between the laser light emitting elements V and the density sensors S is stored in a predetermined storage location of the nonvolatile memory 70D in advance in the form of a laser element-density sensor correspondence table. The term "density sensor S corresponding to a laser light emitting element V" means the density sensor S to read a density of an image portion illuminated by the laser light emitting element V.

In this exemplary embodiment, as shown in FIG. 3, the number of laser light emitting elements V of the laser drying unit 56 and the number of density sensors S of the density reading sensor 58 are both equal to m and the laser drying unit 56 and the density reading sensor 58 are attached at the same position in the width direction. Therefore, the one-to-one correspondence between the laser light emitting elements V and the density sensors S (V1 to S1, V2 to S2, . . . ) is indicated by the laser element-density sensor correspondence table.

At step S40, the CPU 70A judges whether or not the density read by the density sensor S acquired at step S38 as a density corresponding to the laser light emitting element V selected at step S36 falls within a predetermined allowable range.

The predetermined allowable range is an allowable range for densities of the laser-light-illuminated portion R0 that are read by the density reading sensor 58 when the correction image R were illuminated with laser light having emission amounts corresponding to the reference current supplied to the individual laser light emitting elements V at step S32. The predetermined allowable range is stored in, for example, a predetermined storage location of the nonvolatile memory 70D in advance.

If the density, read by the density sensor S concerned, of the portion of the laser-light-illuminated portion R0 falls within the predetermined allowable range, the CPU 70A judges that the deviation of the laser light emission amount of the laser light emitting element V corresponding to the density sensor S concerned is within a predetermined deviation range and excludes the laser light emitting element V from the subjects of correction.

The process moves to step S44 if the judgment result at step S40 is affirmative, and to step S42 if it is negative. At step S42, the CPU 70A adjusts the current to be supplied to the laser light emitting element V concerned by a correction amount ΔI so that the density detected by the density sensor S corresponding to the laser light emitting element V will fall within the predetermined allowable range.

The correction amount ΔI is stored in, for example, a predetermined located of the nonvolatile memory 70D so as to be correlated with the corresponding laser light emitting element V. The correction amount ΔI is set at 0 for each laser light emitting element V for which an affirmative judgment was made at step S40.

At step S44, the CPU 70A judges whether or not all the laser light emitting elements V of the laser drying unit 56 have been subjected to steps S36-S42. The execution of this program is finished if the judgment result is affirmative. If the judgment result is negative, the process returns to step S36 to execute steps S36-S42 for another, unselected one of the laser light emitting elements V of the laser drying unit 56.

As a result of the execution of the above process, a correction amount A1 for compensating for a deviation of the laser light emission amount of each laser light emitting element V is obtained.

When the laser drying unit 56 emits laser light later, each laser light emitting element V is supplied with a current obtained by correcting the predetermined current value (reference current value) using the correction amount ΔI for it, whereby the deviation of the laser light emission amount of each laser light emitting element V will fall within the predetermined range.

If the judgment to the effect that the density detected by the density sensor S does not fall within the allowable range has been made at step S40 for many laser light emitting elements V, a message to that effect may be displayed on the display 64 or communicated to the user by a sound to urge the user to perform maintenance of the laser drying unit 56.

As described above, in this exemplary embodiment, non-uniformity of laser light emission amounts of the laser light emitting elements V of the laser drying unit 56 is compensated for by detecting it in the form of unevenness of densities of a laser-light-illuminated portion R0.

As a result, non-uniformity of laser light emission amounts of the laser light emitting elements V of the laser drying unit 56 can be recognized without the need for incorporating emission amount sensors or the like for directly measuring laser light emission amounts of the laser light emitting elements V, respectively.

Exemplary Embodiment 7

In the inkjet recording apparatus 12 according to the sixth exemplary embodiment, non-uniformity of laser light emission amounts of the laser light emitting elements V is compensated for by determining a correction amount ΔI for each laser light emitting element V is determined using the reference current value. In a seventh exemplary embodiment, a supply current vs. density characteristic is calculated for each laser light emitting element V and a supply current for realizing a target density is calculated for each laser light emitting element V.

Like the inkjet recording apparatus 12 according to the sixth exemplary embodiment, an inkjet recording apparatus 12 according to this exemplary embodiment may have the same configuration (operation excluded) as the inkjet recording apparatus 12 according to any of the first to fifth exemplary embodiments.

Figure 22:
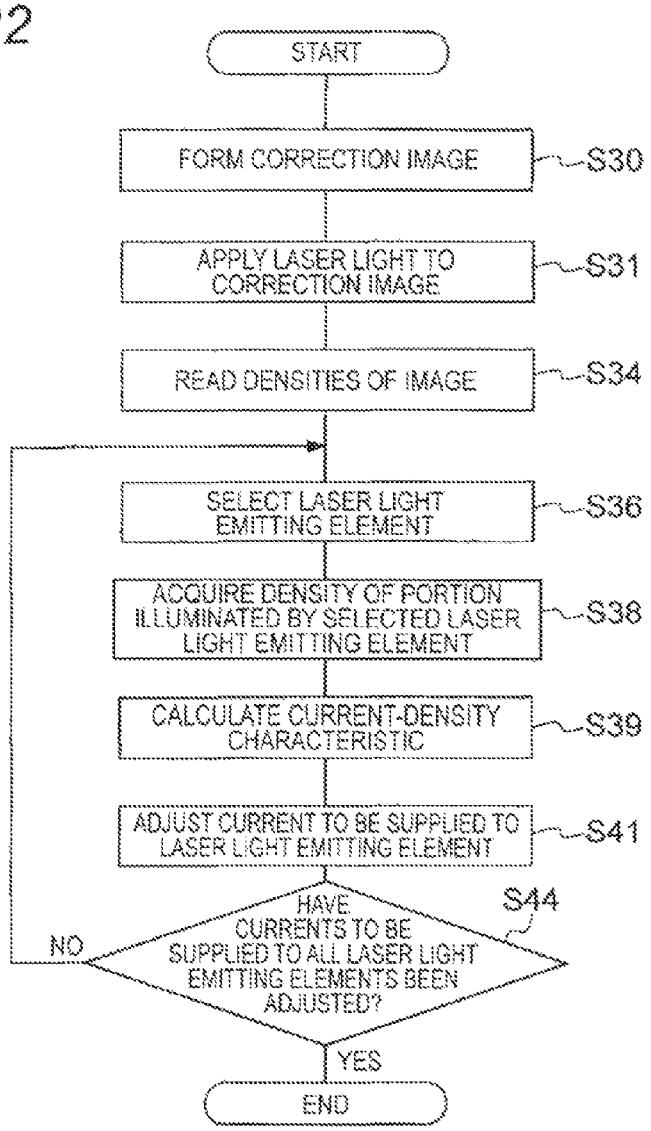
FIG. 22 is a flowchart of a program for calculating currents to be supplied to infrared laser light emitting elements which is used in a seventh exemplary embodiment.

FIG. 22 is a flowchart of a program for calculating currents to be supplied to the laser light emitting elements V which is run by the CPU 70A of the computer 70 at a time other than some time in an image forming period, such as a start of a job of the inkjet recording apparatus 12. The process of FIG. 22 is different from that of FIG. 20 in that steps S31, S39, and S41 replace steps S32, S40, and S42, respectively.

At step S31, the CPU 70A causes the laser drying unit 56 to apply laser light to the correction image R that was formed on the sheet P at step S30. This is done by supplying plural reference currents (e.g., A1, A2, and A3) sequentially to all the laser light emitting elements V of the laser drying unit 56. It is assumed that the plural reference current values are stored in, for example, a predetermined storage location of the nonvolatile memory 70D.

Figure 23:
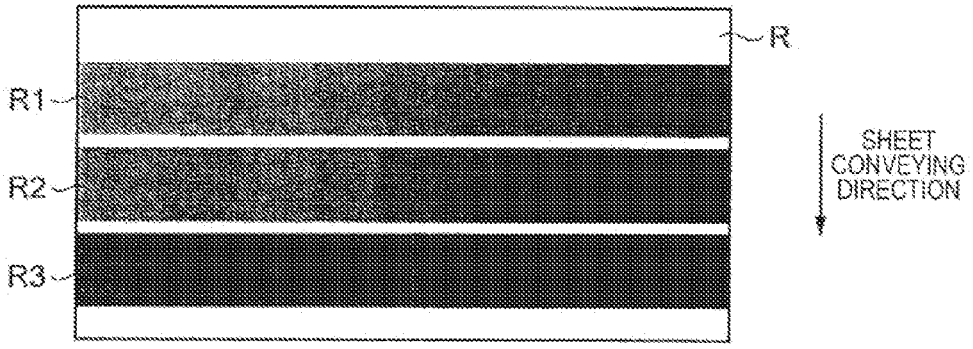
FIG. 23 is a schematic diagram illustrating densities of laser-light-illuminated portions of a correction image in the seventh exemplary embodiment.

FIG. 23 shows the correction image R as subjected to step S31. As shown in FIG. 23, a laser-light-illuminated portion R1 illuminated with laser light emitted from the laser light emitting elements V when supplied with the reference current A1, a laser-light-illuminated portion R2 illuminated with laser light emitted from the laser light emitting elements V when supplied with the reference current A2, and a laser-light-illuminated portion R3 illuminated with laser light emitted from the laser light emitting elements V when supplied with the reference current A3 are formed in the correction image R.

As in the case of the laser-light-illuminated portion R0 of the sixth exemplary embodiment, the laser-light-illuminated portions R1-R3 have densities that are different than the other portion of the correction image R. Furthermore, since the different reference currents were supplied to the laser light emitting elements V in forming the laser-light-illuminated portions R1-R3, the densities of the laser-light-illuminated portions R1-R3 are different from each other.

At step S34, the CPU 70A controls the density reading sensor 58 so that it reads densities of at least one line of each of the laser-light-illuminated portions R1-R3 in the width direction, and acquires densities of each of the laser-light-illuminated portions R1-R3 read by the respective density sensors S of the density reading sensor 58. The acquired densities of each of the laser-light-illuminated portions R1-R3 are stored in, for example, a predetermined storage location of the RAM 70C as a current-density table so as to be correlated with the respective density sensors S. That is, the densities, read by the density sensors S, of each of the laser-light-illuminated portions R1-R3 are correlated with the respective laser light emitting elements V that applied laser light to portions whose densities have been read by the density sensors S.

Figures 24, 25, 26:
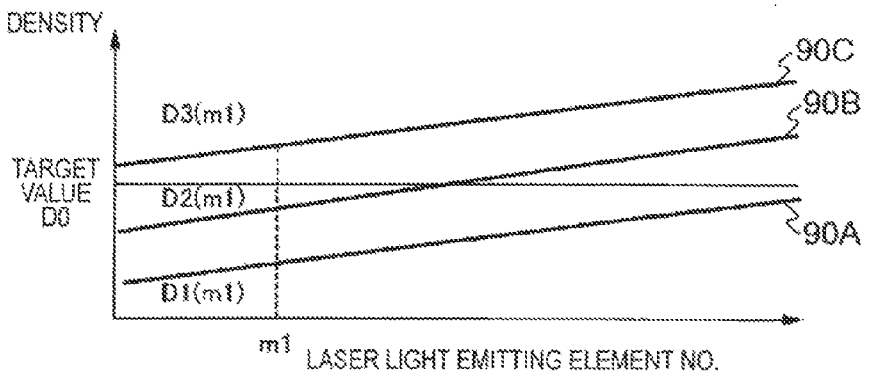
FIG. 24 shows an example current-density table used in the seventh exemplary embodiment.
FIG. 25 is a graph of example density distributions of respective laser-light-illuminated portions of a correction image in the seventh exemplary embodiment.
FIG. 26 shows an example supply current table used in the seventh exemplary embodiment.

FIG. 24 shows an example current-density table. For example, the current-density table is a table in which numbers of the respective laser light emitting elements V are arranged in the table horizontal direction and reference current values supplied to the respective laser light emitting elements V are arranged in the table vertical direction. The table contains a density that was read by the density sensor S corresponding to each combination of a number of a laser light emitting element V and a reference current value.

FIG. 25 is an example graph in which the current-density table of FIG. 24 is expressed in the form of density distributions of the respective laser-light-illuminated portions R1-R3. In FIG. 25, curves 90A, 90B, and 90C represent density distributions of the respective laser-light-illuminated portions R1, R2, and R3, that is, density distributions obtained when the correction image R was illuminated with laser light emission amounts corresponding to reference current values A1, A2, and A3, respectively.

Curves 90A, 90B, and 90C are examples; in this exemplary embodiment, it is assumed that the density acquired by the density sensor corresponding to the laser light emitting element V of the density reading sensor 58 increases linearly as the number of the laser light emitting element V increases (linear density distribution). In actuality, however, density distributions may be nonlinear.

At step S38, the CPU 70A acquires, from the current-density table, the densities of the respective laser-light-illuminated portions R1-R3 that were read by the density sensor S corresponding to the laser light emitting element V selected at step S36.

At step S39, a laser light emitting element density characteristic representing a relationship between the supply current and the density is calculated for the laser light emitting element V selected at step S36. A laser light emitting element density characteristic of each laser light emitting element V by applying a known interpolation technique such as the least squares method or the Lagrange method to combinations of a reference current value for a laser light emitting element Vm1 having a number m1 and a corresponding density, (A1, D1(*m*1)), (A2, D2(*m*1)), and (A3, D3(*m*1)).

At step S41, the CPU 70A calculates a supply current that needs to be supplied to the laser light emitting element V concerned to give a target density $D_0$ to an image formed on a sheet P on the basis of the laser light emitting element density characteristic obtained at step S39, and stores the calculated supply current value in, for example, a predetermined storage location of the nonvolatile memory 70D.

FIG. 26 shows an example supply current table which is generated as a result of execution of the process of FIG. 22 and contains supply current values to be supplied to the respective laser light emitting elements V to obtain the target density $D_0$. Although the table of FIG. 26 contains the supply current values for the one target density $D_0$, a supply current table may be generated which contains sets of supply current values for plural target densities.

In forming an image by ejecting ink droplets onto a sheet P in response to an image formation request received from the user, if a target image density is equal to the density $D_0$, the computer 70 sets the supply current values for the laser light emitting elements V1, V2, . . . , Vm at $A_0(1), A_0(2), \ldots, A_0(m)$, respectively.

If the judgment to the effect that the densities detected by the density sensors S do not fall within allowable ranges predetermined for the respective laser-light-illuminated portions R1-R3 has been made at step S38 for many laser light emitting elements V, a message to that effect may be displayed on the display 64 or communicated to the user by a sound to urge the user to perform maintenance of the laser drying unit 56.

As described above, in this exemplary embodiment, a laser light emitting element density characteristic is calculated for each laser light emitting element V of the laser drying unit 56 on the basis of a relationship between the plural supply current values for the laser light emitting element V and deviated densities of laser-light-illuminated portions corresponding to the respective supply current values. And a supply current value that needs be supplied to the laser light emitting element V to obtain a target image density is determined on the basis of the calculated laser light emitting element density characteristic.

As a result, as in the sixth exemplary embodiment, non-uniformity of laser light emission amounts of the laser light emitting elements V of the laser drying unit 56 can be recognized without the need for incorporating emission amount sensors or the like for directly measuring laser light emission amounts of the laser light emitting elements V, respectively.

Although in the sixth and seventh exemplary embodiments a correction image R is formed in the K color, the color of the correction image R is not limited to the K color and may be another ink color such as Y, M, or C. However, since the density reading sensitivity to the Y color of the density reading sensor 58 is lower than the sensitivities to other colors, using the Y color as the color of a correction image R is not preferable. The use of the K color is preferable.

In the sixth and seventh exemplary embodiments, densities of a laser-light-illuminated portion(s) is read by the density reading sensor 58 which is provided in the inkjet recording apparatus 12. Alternatively, for example, densities of a laser-light-illuminated portion(s) may be read by a density reading device such as a scanner that is connected to a communication line (not shown). In this case, for example, a current-density table as shown in FIG. 24 may be received through the communication line I/O 60 and stored in a predetermined storage location of the RAM 70C.

Exemplary Embodiment 8

In the exemplary embodiments described so far, rather than a carbon heater which has been used conventionally, the laser drying unit 56 incorporating the plural laser light emitting elements V is employed to dry an image formed on a sheet P.

In the drying of an image using a carbon heater, the image is dried by blowing a hot wind over the entire image formation surface of a sheet P. Therefore, no problems occur even if the carbon heater is attached at a position that is deviated from a predetermined attachment position by, for example, a length corresponding to about one ink droplet.

In contrast, where an image is dried using the laser drying unit 56, the laser light illumination range of each laser light emitting element V of the laser drying unit 56 is narrower than the hot wind blowing range of the carbon heater. Furthermore, as described in the first to fifth exemplary embodiments, the laser light illumination timing may be controlled in units of a length corresponding to one ink droplet.

In this case, if the correspondence between the nozzles N of the head array 30 and the laser light emitting elements V of the laser drying unit 56 is fixed (e.g., the laser light emitting element V1 emits light when an ink droplet is ejected from the nozzle N1 of the head array 30), a situation may occur that laser light of a predetermined emission amount is not applied to an ink droplet ejected from each nozzle N if a positional deviation occurs in the width direction between the nozzles N and the laser light emitting elements V due to an error of the attachment positions of the head array 30 and the laser drying unit 56, vibration, or the like.

For example, to adjust the nozzle positions of the Y-color ink head 32 and the M-color ink head 32 in the width direction, a technique is employed frequently that lines are formed from the nozzles N of each ink head 32 so as to extend in the conveying direction, positional deviations in the width direction between the lines are read visually or using the density reading sensor 58, and the positional deviations in the width direction between the nozzles N are compensated for on the basis of the reading results.

However, unlike in the above compensation of positional deviations of the ink head 32, even if laser light beams are emitted from the laser drying unit 56, no visible traces of laser light illumination are formed on a sheet L and hence positional deviations in the width direction between the nozzles N and the laser light emitting elements V do not become apparent.

In view of the above, an eighth exemplary embodiment provides an inkjet recording apparatus 12 in which positional deviations in the width direction between the nozzles N of the head array 30 and the laser light emitting elements V of the laser drying unit 56 are compensated for by forming a laser light illumination trace on a sheet P utilizing the above-described characteristic that the optical densities of an image are changed when the image is illuminated with laser light. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 27:
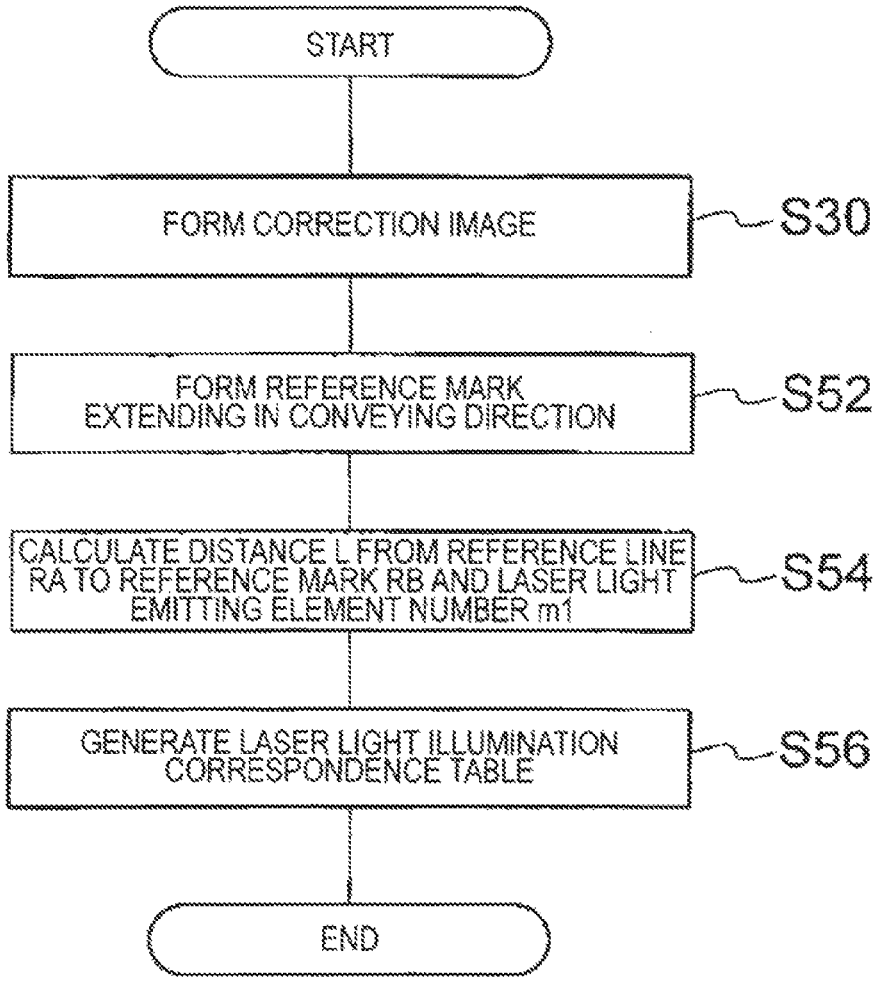
FIG. 27 is a flowchart of a program for compensating for positional deviations in the width direction between nozzles and infrared laser light emitting elements which is used in an eighth exemplary embodiment.

FIG. 27 is a flowchart of a program for compensating for positional deviations in the width direction between the nozzles N and the laser light emitting elements V which is run by the CPU 70A of the computer 70 at a time other than some time in an image forming period, such as a start of a job of the inkjet recording apparatus 12.

Figure 28:
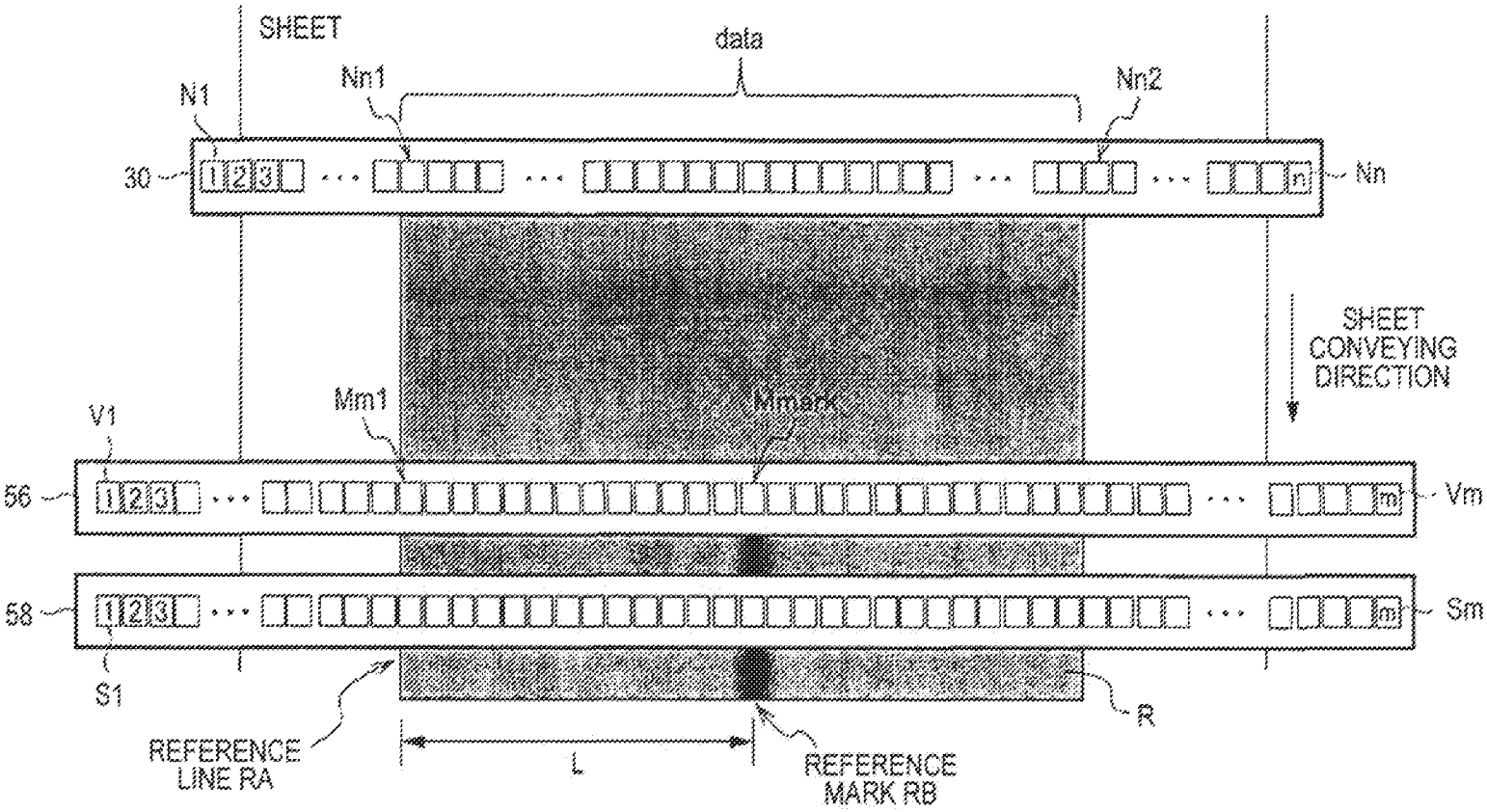
FIG. 28 is a schematic diagram illustrating positional relationships between a correction image, the head array, the laser drying unit, and the density reading sensor in the eighth exemplary embodiment.

First, at step S30, as in the sixth and seventh exemplary embodiments, a K-color correction image R having an intermediate density is formed on a sheet P. As shown in FIG. 28, this is done by causing individual nozzles N from a nozzle Nn1 having a nozzle number n1 to a nozzle Nn2 having a nozzle number n2 to eject ink droplets (n1<n2). It is assumed that the number of nozzles N from the nozzle Nn1 to the nozzle Nn2 is equal to "data." It is also assumed that the nozzle numbers of the nozzles N to eject ink droplets to edges, to extend in the conveying direction, of a correction image R are stored in, for example, a predetermined storage location of the nonvolatile memory 70D in advance.

The nozzle number of one of the nozzles to eject ink droplets to edges, to extend in the conveying direction, of a correction image R is particularly called an image write start nozzle number. In this exemplary embodiment, the smaller nozzle number n1 is employed as the image write start nozzle number. An edge, formed by the nozzle having the image write start nozzle number (in this exemplary embodiment, nozzle Nn1) so as to extend in the conveying direction, of a correction image R is particularly called a reference line RA.

It is desirable that the nozzle numbers n1 and n2 be set so as to have as large a difference as possible. This is to make the correction image R as long as possible in the width direction.

At step S52, the CPU 70A causes a laser light emitting element V having a predetermined laser light emitting element number (reference laser light emitting element number) of the laser drying unit 56 to apply laser light to the correction image R for a predetermined time, whereby a reference mark RB is formed so as to extend in the conveying direction. The reference mark RB is a laser light illumination trace of the laser light emitting element V. The reference laser light emitting element number Nmark is set so that the reference mark RB is formed in the correction image R.

At step S54, a distance L in the width direction between the reference line RA which was formed at step S30 and the reference mark RB which was formed at step S52 is calculated.

To this end, first, the CPU 70A controls the density reading sensor 58 so that it reads densities of at least one line, extending in the width direction, of the correction image R, acquires the densities of the correction image R read by the respective density sensors S of the density reading sensor 58, and stores the acquired densities in, for example, a predetermined storage location of the RAM 70C.

Figure 29:
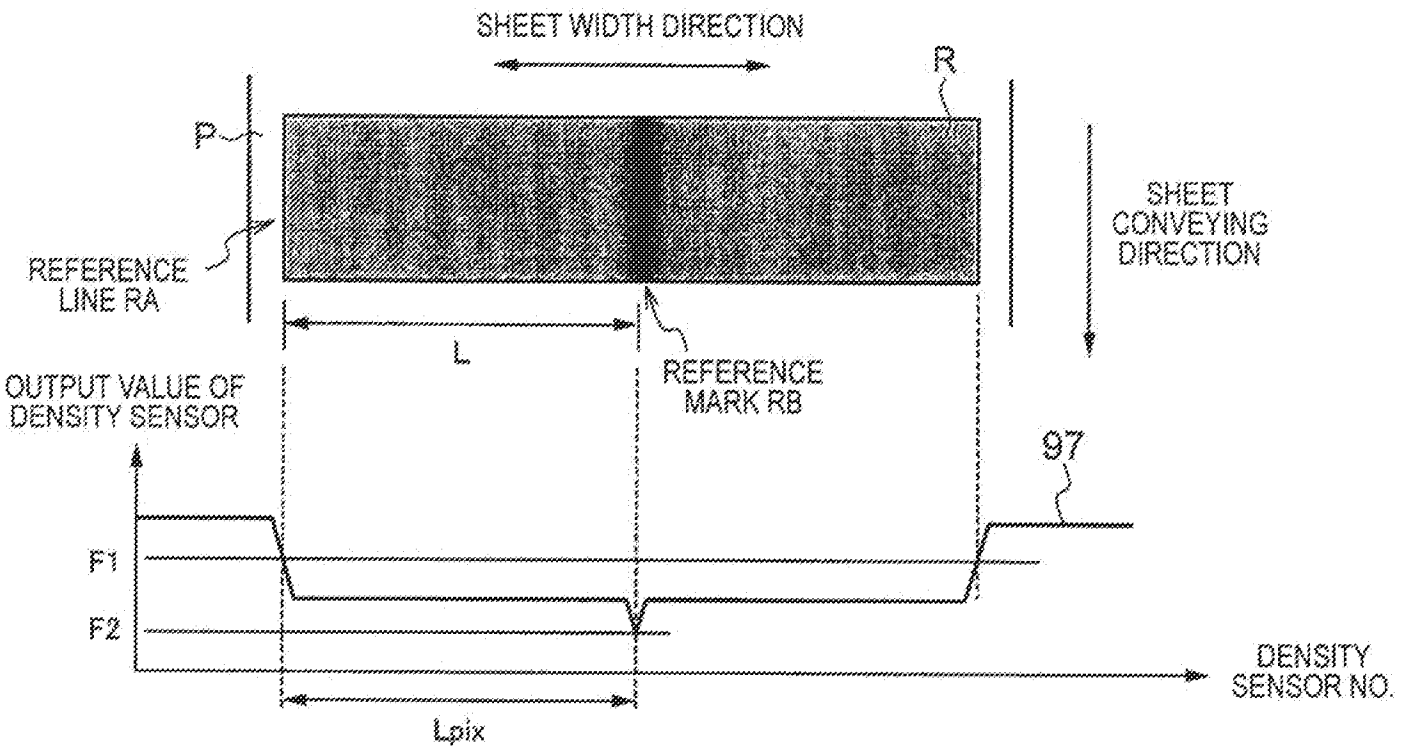
FIG. 29 is a schematic diagram showing a density distribution of a correction image used in the eighth exemplary embodiment.

FIG. 29 shows a density distribution of the correction image R in the width direction.

In the graph shown in FIG. 29, the horizontal axis represents the density sensor number and the vertical axis represents the output value (density) of the density sensor S. In the graph shown in FIG. 29, the density decreases as the output value of the density sensor S increases.

As shown in FIG. 29, curve 97 represents a density distribution which crosses a predetermined threshold value F1 at the position of the reference line and reaches a predetermined threshold value F2 at the position of the reference mark RB. The threshold values F1 and F2 are stored in, for example, a predetermined storage location of the nonvolatile memory 70D in advance, and the number of density sensors S from a density sensor S located at the position where the density varied from below to above the threshold value F1 to a density sensor S located at the position where the density varied from above to below the threshold value F2 is calculated as Lpix.

If the resolution of the density reading sensor 58, that is, the number of density sensors S existing per inch in the width direction, is represented by Rscan (dpi: dots per inch), the distance L (mm) is calculated according to Equation (1):

$$L = L\text{pix} \times 25.4/R\text{scan} \quad (1)$$

Using the distance L calculated according to Equation (1), a laser light emitting element number m1, to apply laser light to ink droplets ejected from the nozzle Nn1, of the laser drying unit 56 is calculated according to Equation (2):

$$m1 = M\text{mark} - L \times R\text{laser}/25.4$$

$$= M\text{mark} - L\text{pix} \times R\text{laser}/R\text{scan} \quad (2)$$

where Rlaser is the laser light illumination resolution (dpi) of the laser drying unit 56, that is, the number of laser light emitting elements V existing per inch in the width direction. If the calculated laser light emitting element number m1 is not a natural number, it is converted into a natural number by, for example, rounding it off, up, or down.

At step S56, the CPU 70A generates a laser light illumination correspondence table in which the nozzles N of the head array 30 and laser light emitting elements V of the laser drying unit 56 are correlated with each other using, as a reference, the laser light emitting element number m1 corresponding to the nozzle Nn1 that was calculated at step S54, and stores the generated laser light illumination correspondence table in, for example, a predetermined storage location of the nonvolatile memory 70D. FIG. 30 shows an example laser light illumination correspondence table in a case that the nozzle resolution Rhead and the laser light illumination resolution Rlaser are the same.

After the generation of the laser light illumination correspondence table, the computer 70 acquires numbers of laser light emitting elements V to illuminate ink droplets by referring to the laser light illumination correspondence table and controls the laser drying unit 56 so that those laser light emitting elements V emit laser light. For example, image information of an original image contains ejecting position information to the effect that an ink droplet should be ejected from the nozzle Nn1, after an ink droplet is ejected from the nozzle Nn1, the ink droplet is illuminated with laser light that is emitted from the laser light emitting element Vm1 having the laser light emitting element number m1.

As described above, in this exemplary embodiment, a reference mark RB is formed in a correction image R by causing the laser light emitting element V having a reference laser light emitting element number Mmark to emit laser light, and a distance L from the reference mark RB to a reference line RA is calculated on the basis of a density distribution of the correction image R. A laser light emitting element number m1 corresponding to the nozzle Vn1 having an image write start nozzle number n1 is determined, and a laser light illumination correspondence table is generated in which the nozzles N and laser light emitting elements V are correlated with each other. Thus, positional deviations in the width direction between the nozzles N and the laser light emitting elements V are compensated for.

As a result, positional deviations in the width direction between the nozzles N and the laser light emitting elements V can be compensated for unlike in the case where the correspondence between the nozzles N of the head array 30 and the laser light emitting elements V of the laser drying unit 56 is fixed.

Exemplary Embodiment 9

In the eighth exemplary embodiment, positional deviations in the width direction between the nozzles N of the head array 30 and the laser light emitting elements V of the laser drying unit 56 are compensated for. However, there also exist timing deviations which occur between ejecting of ink droplets from the nozzles N of the head array 30 and laser light illumination of the droplets due to, for example, a delay from issuance, to the laser drying unit 56, of an instruction to start laser light illumination to actual laser light illumination (i.e., positional deviations in the conveying direction between the nozzles N and the laser light emitting elements V of the laser drying unit 56).

In view of the above, a ninth exemplary embodiment provides an inkjet recording apparatus 12 in which positional deviations in the conveying direction between the nozzles N and the laser light emitting elements V are compensated for. In the following, a description will be made of how the inkjet recording apparatus 12 works.

Figure 31:
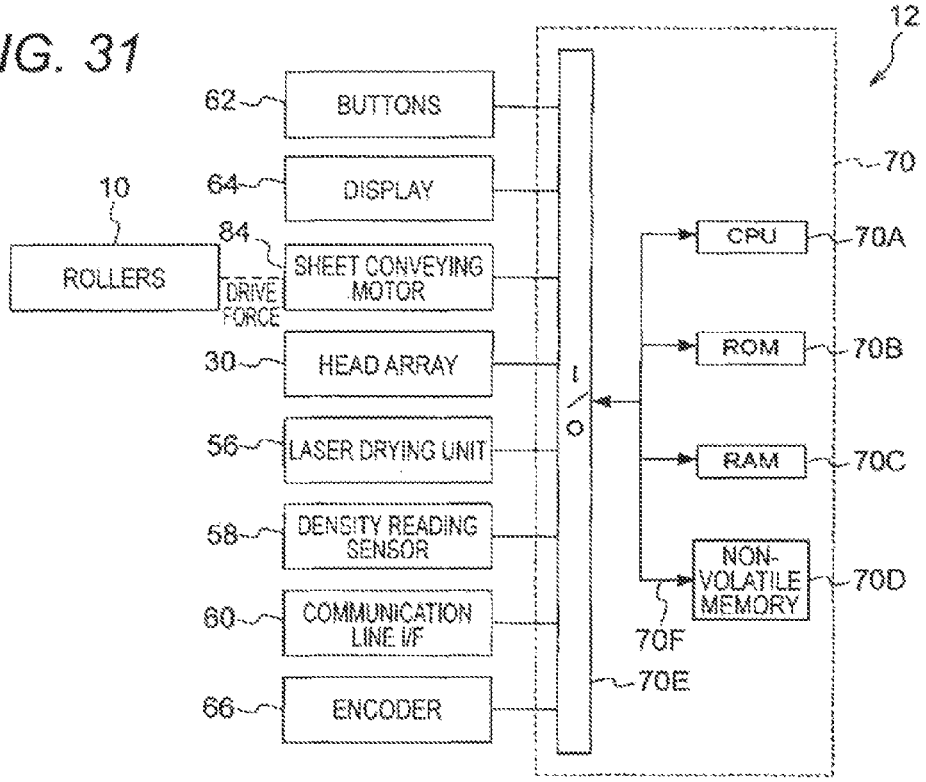
FIG. 31 is a block diagram showing the configuration of an essential part of an electrical system of an inkjet recording apparatus according to a ninth exemplary embodiment.

The inkjet recording apparatus 12 according to this exemplary embodiment may have basically the same configuration (operation excluded) as the inkjet recording apparatus 12 according to any of the exemplary embodiments described so far. However, in this exemplary embodiment, the drive roll 24 (see FIG. 2) is equipped with an encoder 66 which outputs pulses in a number corresponding to a rotation angle of the encoder 66 and which is connected to the I/O 70E as shown in FIG. 31. That is, the encoder 66 outputs pulses as a sheet P is conveyed and the number of pulses that are output from the encoder 66 indicates a conveyance distance of the sheet P.

Figure 32:
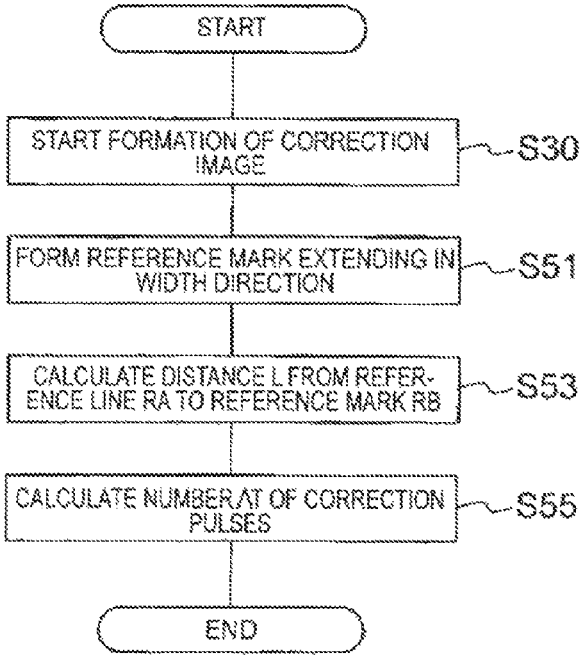
FIG. 32 is a flowchart of a program for compensating for positional deviations in the conveying direction between the nozzles and the infrared laser light emitting elements which is used in the ninth exemplary embodiment.

FIG. 32 is a flowchart of a program for compensating for positional deviations in the conveying direction between the nozzles N and the laser light emitting elements V which is run by the CPU 70A of the computer 70 at a time other than some time in an image forming period, such as a start of a job of the inkjet recording apparatus 12.

First, at step S30, as in the eighth exemplary embodiment, formation of a K-color correction image R having an intermediate density on a sheet P is started.

At step S51, the CPU 70A causes the laser light emitting elements V of the laser drying unit 56 to apply laser light to the correction image R being formed with such timing that the sheet P has been conveyed by a predetermined distance by rotation of the drive roll 24 after the nozzles N started ejecting ink droplets onto the sheet P to form the correction image R.

Figure 33:
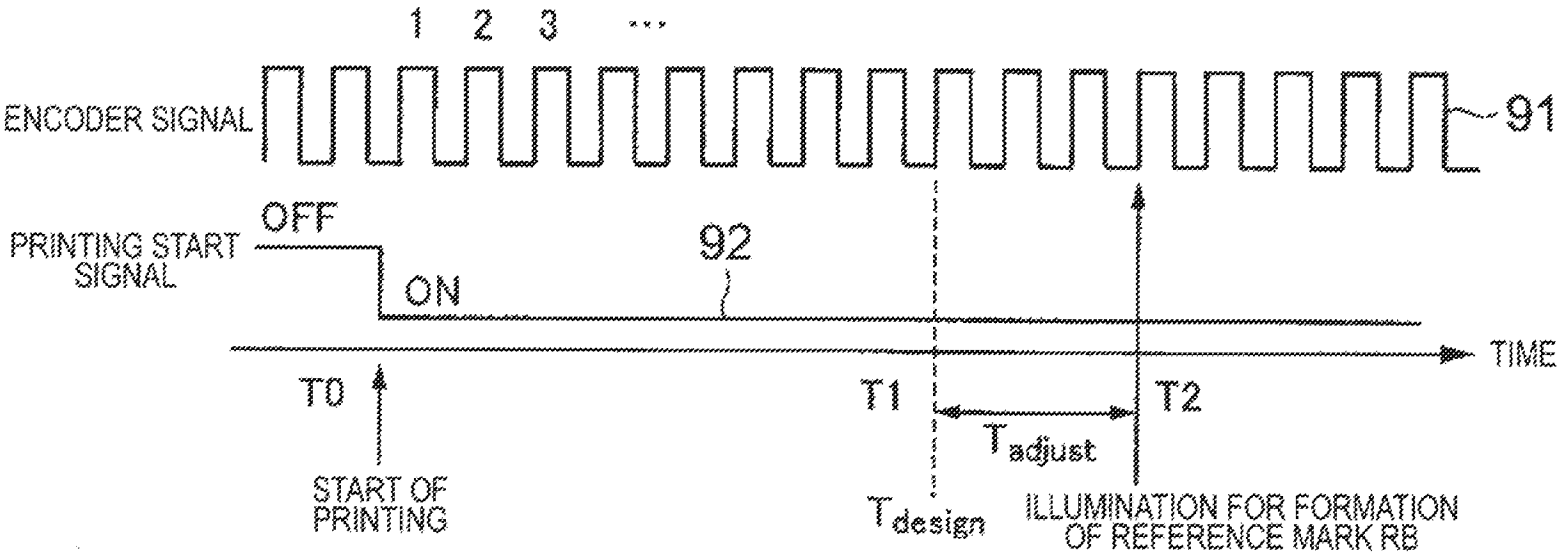
FIG. 33 is a schematic diagram illustrating laser light illumination timing in the ninth exemplary embodiment.

FIG. 33 illustrates timing with which the laser light emitting elements V emit laser light after a start of ejecting of ink droplets from the nozzles N. At a start of formation of a correction image R on the sheet P being conveyed, the CPU 70A is informed that at time T0 a printing start signal 92 for the head array 30 was turned on and ejecting of ink droplets from the nozzles N was started. The CPU 70A measures, from time T0, the number of pulses included in an encoder signal 91 supplied from the encoder 66 as the sheet P is conveyed. When the measured number of pulses has reached a predetermined number, the CPU 70A controls the laser drying unit 56 so that the laser light emitting elements V emit laser light.

The predetermined number of pulses is the number of pulses that are output from the encoder 66 (a design number of pulses, Tdesign; corresponds to a design distance Ldesign (mm) between the head array 30 and the laser drying unit 56) plus the number of pulses (the number of delay pulses, Tadjust) corresponding to a delay distance Ladjust. The predetermined number of pulses is referred to as the number of pulses for a start of reference mark illumination.

The reason why the delay distance Ladjust is added to the design distance Ldesign is as follows. If laser light beams are emitted with such timing (time T1) that the number of pulses has reached the design number Tdesign of pulses that corresponds to the design distance Ldesign in a state that positional deviations in the conveying direction exist between the nozzles N and the laser light emitting elements V, the correction image R may not be illuminated with the laser light beams.

Therefore, the laser light illumination time is delayed from time T1 by a time corresponding to the number Tadjust of delay pulses by adding the delay distance Ladjust to the design distance Ldesign so that the correction image R is illuminated with laser light beams reliably at time T2. The design number Tdesign of pulses and the number Tadjust of delay pulses are stored in, for example, a predetermined storage location of the nonvolatile memory 70D in advance.

Let the diameter of the drive roll 24 represented by Droll (mm), the thickness of a sheet P by Dpaper (mm), and the number of pulses that are output from the encoder 66 (the resolution of the encoder 66) per rotation of the drive roll 24 by Renc (pulses per revolution). Then the design number Tdesign of pulses and the number Tadjust of delay pulses are calculated according to Equations (3) and (4), respectively:

$$T\text{design}=\text{Round}(2\Theta enc\times L\text{design}/(D\text{roll}+D\text{paper}),0) \quad (3)$$

$$T\text{adjust}=\text{Round}(2\Theta enc\times L\text{adjust}/(D\text{roll}+D\text{paper}),0) \quad (4)$$

where Θenc=2π/Renc and Round(x, 0) is an operator of converting parameter x into a natural number by rounding it down. Alternatively, parameter x may be converted into a natural number by rounding it off or up.

Figure 34:
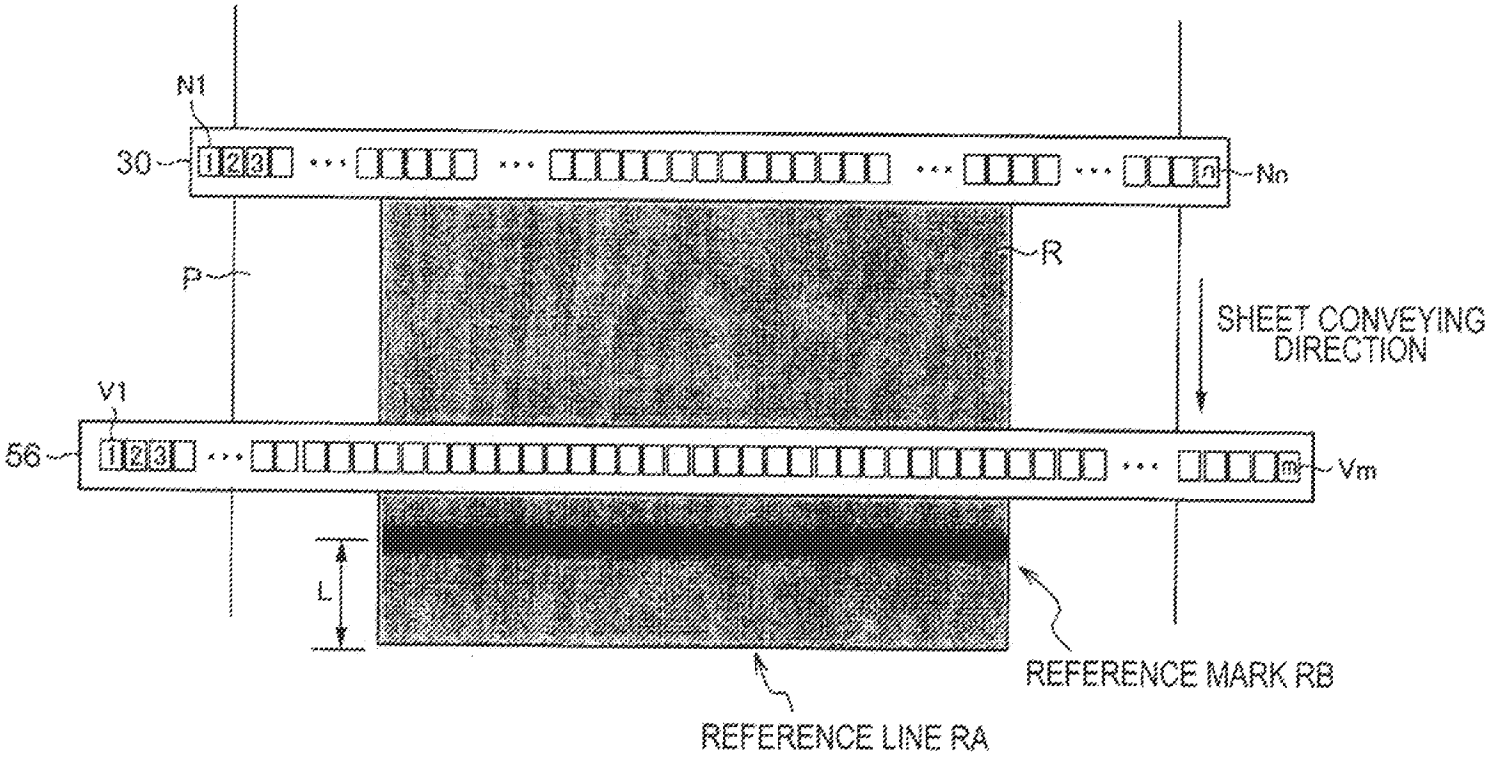
FIG. 34 is a schematic diagram showing a correction image as subjected to laser light illumination in the ninth exemplary embodiment.

FIG. 34 shows the correction image R to which laser light beams were applied from the laser light emitting elements V of the laser drying unit 56 at time T2.

At step S51, laser light beams are applied to the correction image R from the laser light emitting elements V of the laser drying unit 56, a reference mark RB is formed so as to extend in the width direction unlike the reference mark RB which is formed at step S52 in the eighth exemplary embodiment. In this exemplary embodiment, the edge, located on the downstream side in the conveying direction and extending in the width direction, of the correction image R is employed as a reference line RA. In other words, the reference line RA is the edge of the correction image R that is located at the write start position of the correction image R and extends parallel with the reference mark RB.

At step S53, a distance L between the reference line RA formed at step S30 and the reference mark RB formed at step S51 is calculated. To this end, densities of the entire correction image R are read by the density reading sensor 58. A distance L is calculated on the basis of a density distribution in the conveying direction.

Figure 35:
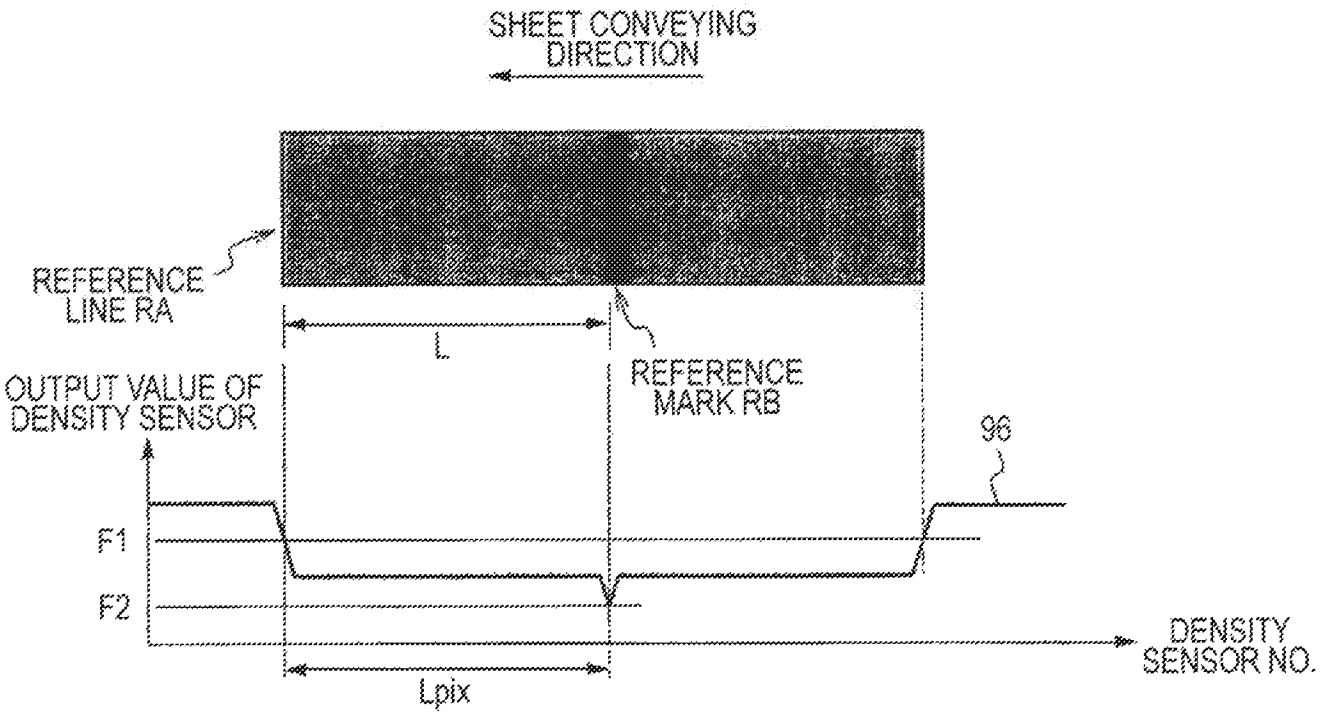
FIG. 35 is a schematic diagram showing a density distribution of a correction image used in the ninth exemplary embodiment.

FIG. 35 shows an example density distribution in the conveying direction of the read-out correction image R. In the graph shown in FIG. 35, the horizontal axis represents the reading position number (corresponds to the density sensor number) and the vertical axis represents the output value (density) of the density sensor S.

Since curve 96 in FIG. 35 representing a density distribution exhibits the same tendency as curve 97 in FIG. 29, the number Lpix of density sensors S is calculated in the same manner as at step S54 in FIG. 27 (eighth exemplary embodiment) and a distance L is calculated according to Equation (1) after calculating the number Lpix of density sensors S.

At step S55, the CPU 70A calculates the number ΔT of correction pulses which corresponds to a difference ΔL between the distance L calculated at step S53 and the design length Ldesign plus the delay distance Ladjust, and corrects the number of pulses for a start of reference mark illumination using the number ΔT of correction pulses.

Since the distance L from the reference line RA to the reference mark RB in the direction perpendicular to the reference mark RB should already incorporate the difference ΔL, the distance L calculated at step S53 is given by Equation (5):

$$L=L\text{design}+L\text{adjust}+\Delta L \quad (5)$$

That is, ΔL is given by Equation (6):

$$\Delta L=L-(L\text{design}+L\text{adjust}) \quad (6)$$

On the other hand, ΔL is given by Equation (7):

$$\Delta L=R\times\Theta enc\times\Delta T \quad (7)$$

where R=(Droll+Dpaper)/2.

Thus, ΔT is calculated according to Equation (8):

$$\Delta T=\text{Round}(2\Delta L/\{(D\text{roll}+D\text{paper})\Theta enc,\}0) \quad (8)$$

The number ΔT of correction pulses corresponding to the difference ΔL can thus be calculated.

Positional deviations in the conveying direction between nozzles N and the laser light emitting elements V can be suppressed by causing the laser drying unit 56 to emit laser light beams when the number of pulses that has been measured from turning-on of the printing start signal 92 has reached Tdesign−ΔT.

As described above, in this exemplary embodiment, as in the eighth exemplary embodiment, the predetermined laser light illumination timing of the laser drying unit 56 is corrected by forming a reference mark in a correction image R, calculating a distance from a reference mark RB to a reference line RA on the basis of a density distribution of the correction image R, and calculates a positional deviation in the conveying direction between nozzles N and the laser light emitting elements V in the form of the number of pulses.

In each of the eighth and ninth exemplary embodiments, a from a reference position RA to a reference mark RB is calculated by reading a density distribution of a correction image R by the density reading sensor 58, the method for calculating a distance L is not limited to this method. Since a reference mark RB is different in density from a correction image R, a distance L may be measured visually using a ruler or the like.

Figure 36:
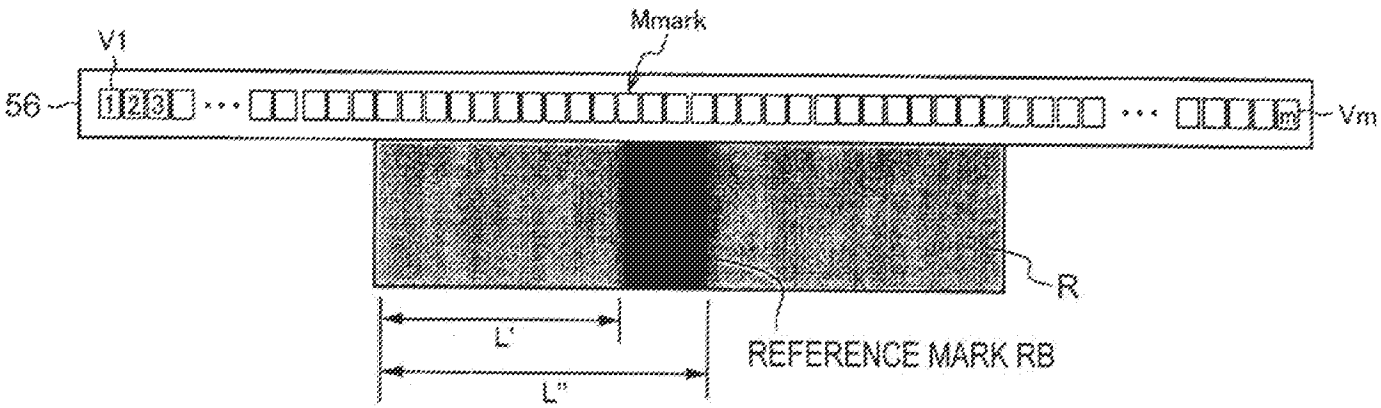
FIG. 36 is a schematic diagram showing another type of reference mark formed in the eighth exemplary embodiment.

In the eighth exemplary embodiment, a reference mark RB is formed by applying laser light to a correction image from a laser light emitting element VMmark having a reference laser light emitting element number Mmark. Alternatively, as shown in FIG. 36, a reference mark RB may be formed by causing plural laser light emitting elements V to emit laser light. In this case, a distance from a reference line RA to a position where the density of a correction image varies, such as a distance L' or L", may be employed as the distance from the reference line RA and the reference mark RB.

In this case in which a reference mark RB is formed by causing plural laser light emitting elements V to emit laser light, the length of the reference mark RB in the width direction is longer than in a case in which a reference mark RB is formed by causing a single laser light emitting element V to emit laser light. An advantage is therefore expected that the position of a reference mark RB can be determined easily even with a density reading sensor 58 having a lower resolution.

A similar concept relating to formation of a reference mark RB is applicable to the formation of a reference mark RB in the ninth exemplary embodiment. That is, the length of a reference mark RB in the conveying direction may be increased by causing the laser light emitting elements V of the laser drying unit 56 to apply laser light to a correction image R for a longer time at step S51 in FIG. 32.

Although in the eighth and ninth exemplary embodiments a correction image R is formed in the K color, the color of the correction image R is not limited to the K color and may be another ink color such as Y, M, or C. However, since the density reading sensitivity to the Y color of the density reading sensor 58 is lower than the sensitivities to other colors, using the Y color as the color of a correction image R is not preferable. The use of the K color is preferable.

It goes without saying that eighth and ninth exemplary embodiments may be combined together to compensate for positional deviations between the nozzles N and the laser light emitting elements V in both of the width direction and the conveying direction.

Exemplary Embodiment 10

In the exemplary embodiments described so far, rather than a carbon heater which has been used conventionally, the laser drying unit 56 incorporating the plural laser light emitting elements V is employed to dry an image formed on a sheet P.

In the conventional method of drying an image using a carbon heater, the image is dried by blowing a hot wind over the entire image formation surface of a sheet P. In this case, if the carbon heater suffers an operation failure as an initial failure or due to deterioration with age or the like, a sheet P is not dried properly over its entire image formation surface and hence degradation in image quality can easily be found through comparison with image quality of a case that the carbon heater operates normally. That is, when the carbon heater has failed, the user can recognize that a certain abnormality has occurred in the inkjet recording apparatus 12. If it is judged that the carbon heater has failed, the carbon heater is replaced in its entirety.

On the other hand, where an image is dried using the laser drying unit 56 as in the first to fifth exemplary embodiments, each of the laser light emitting elements V incorporated in the laser drying unit 56 fails at a higher probability than the laser drying unit 56 as a whole. In this case, it is difficult to determine a laser light emitting element V under operation failure (defective laser light emitting element). Even if a defective laser light emitting element is determined, because of the structure of the laser drying unit 56, it is difficult to replace only the defective laser light emitting element. However, since the laser drying unit 56 is much more expensive than each laser light emitting element V, the replacement of the laser drying unit 56 itself results in increase in the running cost of the inkjet recording apparatus 12.

In view of the above, a 10th exemplary embodiment provides an inkjet recording apparatus 12 in which a defective laser light emitting element is determined by forming laser light illumination traces on a sheet utilizing the above-described characteristic that the optical densities of an image are changed when the image is illuminated with laser light and the laser light illumination amount of a portion that should be illuminated by the defective laser light emitting element is corrected by adjusting the laser light emission amount of laser light emitting elements V around the defective laser light emitting element. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 37:
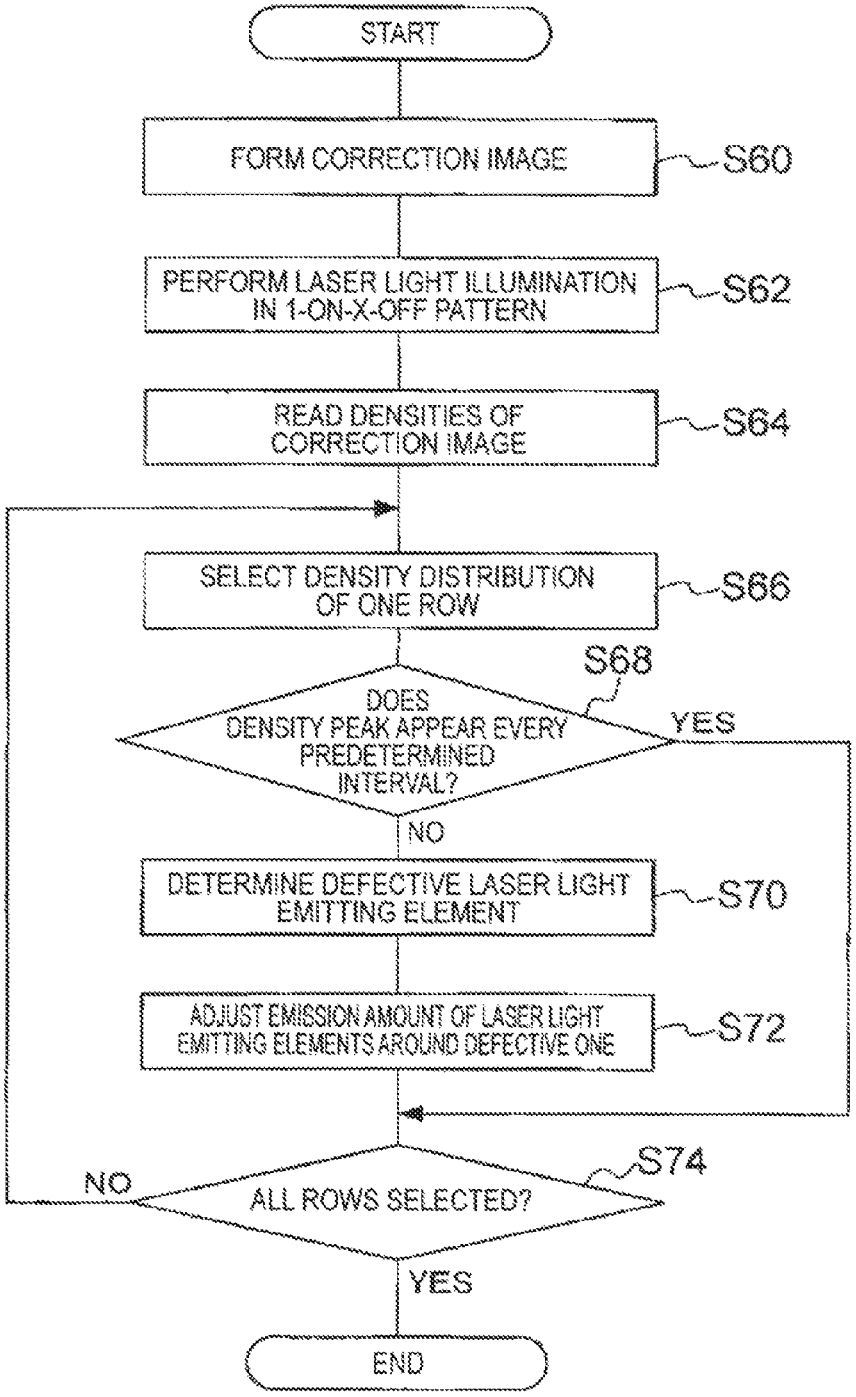
FIG. 37 is a flowchart of a correction program for correcting the laser light emission amount of laser light emitting elements around a defective one which is used in a 10th exemplary embodiment.

FIG. 37 is a flowchart of a laser light emission amounts correction program which is run by the CPU 70A of the computer 70 at a time other than some time in an image forming period, such as a start of a job of the inkjet recording apparatus 12.

First, at step S60, as at step S30 in FIG. 20 (sixth exemplary embodiment), correction image R having an intermediate density is formed on a sheet P by causing the head array 30 to eject, for example, K-color ink droplets onto the sheet P.

At step S62, the CPU 70A controls the laser drying unit 56 so that the laser light emitting elements V of the laser drying unit 56 to apply laser light beams to the correction image R according to a predetermined laser light illumination pattern. The predetermined laser light illumination pattern is stored in, for example, a predetermined storage location of the non-volatile memory 70D in advance, an example of which is a 1-on-X-off illumination pattern.

The 1-on-X-off illumination pattern is an illumination pattern in which the laser light emitting elements V are grouped into groups the members of each of which have the same remainder when their laser light emitting element numbers are divided by X+1 and the groups of laser light emitting elements V emit laser light beams at different time points.

Figure 38:
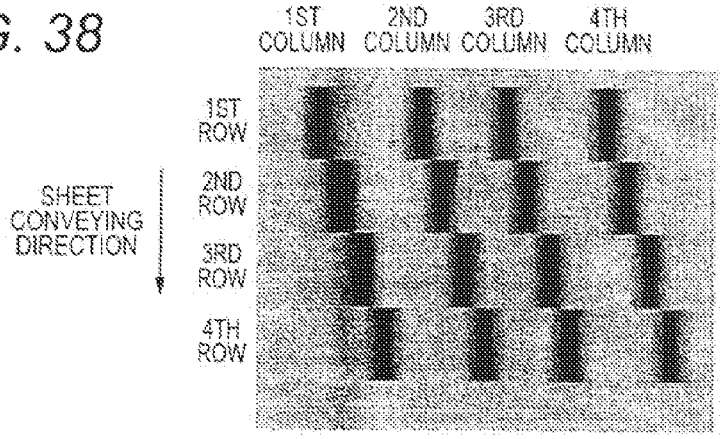
FIG. 38 shows an example correction image formed in a 1-on-3-off illumination pattern used in the 10th exemplary embodiment.

FIG. 38 shows an example correction image R formed in a 1-on-3-off illumination pattern. In this exemplary embodiment, to simplify the description, it is assumed that the laser light emitting element number $m_1$ can take numbers 1, . . . , 16.

Laser light illumination traces of laser light emitting elements V (belonging to a first laser light emitting element group) that correspond to laser light emitting element numbers $m_1$=(1, 5, 9, 13) are formed in a first row. Laser light illumination traces of laser light emitting elements V (belonging to a second laser light emitting element group) that correspond to laser light emitting element numbers $m_1$=(2, 6, 10, 14) are formed in a second row. Laser light illumination traces of laser light emitting elements V (belonging to a third laser light emitting element group) that correspond to laser light emitting element numbers $m_1$=(3, 7, 11, 15) are formed in a third row.

Laser light illumination traces of laser light emitting elements V (belonging to a fourth laser light emitting element group) that correspond to laser light emitting element numbers $m_1$=(4, 8, 12, 16) are formed in a fourth row.

As shown in FIG. 38, where laser light beams are applied to a correction image R from the laser light emitting elements V in the 1-on-3-off illumination pattern, laser light illumination traces are formed so as to be arranged in the predetermined manner without overlapping with each other. Therefore, if the laser drying unit 56 has a defective laser light emitting element which does not emit laser light, resulting laser light illumination traces do not have the regular, predetermined arrangement of the 1-on-3-off illumination pattern shown in FIG. 38. Therefore, the defective laser light emitting element can be determined visually.

Figure 39:
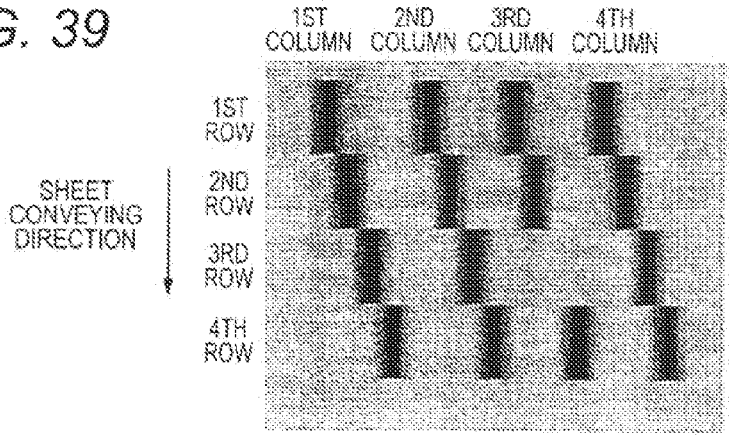
FIG. 39 shows an example correction image which is formed in the 10th exemplary embodiment when the laser drying unit having a defective laser light emitting element emits laser light beams in the 1-on-3-off illumination pattern.

FIG. 39 shows an example correction image R which is formed in a case that the laser drying unit 56 emits laser light beams in the 1-on-3-off illumination pattern and the laser light emitting element V having the laser light emitting element number "I" is a defective one.

In the case of the 1-on-X-off illumination pattern, if a laser light illumination trace is absent at a position having a row number A and a column number B, the laser light emitting element number merror of the defective laser light emitting element is determined according to Equation (9):

$$m\text{error}=(1+X)B-1)+A \tag{9}$$

In the example of FIG. 39, a laser light illumination trace is absent at the third row/third column position, the laser light emitting element number merror is determined to be "11."

As described above, a defective laser light emitting element may be determined visually. However, in this exemplary embodiment, by executing steps to be described below, a defective laser light emitting element is determined on the basis of a density distribution that a correction image R exhibits when illuminated with laser light beams in the 1-on-X-off illumination pattern.

At step S64, the CPU 70A controls the density reading sensor 58 so that it reads densities of sets of laser light illumination traces belonging to the respective laser light emitting element groups in the width direction, that is, on a row-by-row basis (see FIG. 39). The CPU 70A stores the acquired sets of densities (density distributions) corresponding to the respective rows in, for example, a predetermined storage location of the RAM 70C.

At step S66, the CPU 70A selects a density distribution of one row from the density distributions of the respective rows acquired at step S64.

At step S68, the CPU 70A compares the density distribution of one row selected at step S66 with a first standard density profile corresponding to the selected row and judges whether or not the number of peaks of the selected density distribution that have densities higher than or equal to a failure judgment reference value is equal to that of the first standard density profile. The process moves to step S74 if the judgment result is affirmative, and moves to S70 if it is negative.

The first standard density profile is a density distribution of each row of a correction image R that should be obtained when laser illumination has been performed in the 1-on-X-off illumination pattern by the laser drying unit 56 that has only laser light emitting elements V that do not exhibit any operation failure.

Figure 40:
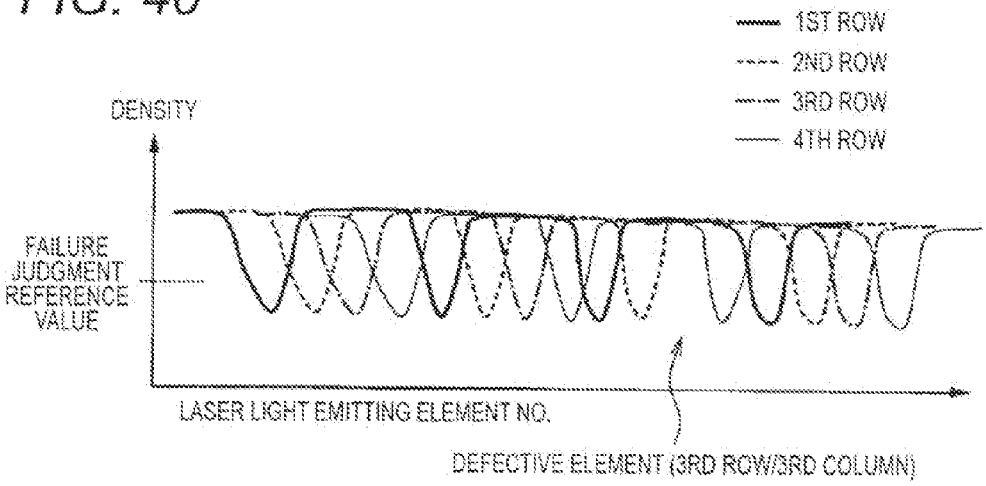
FIG. 40 shows example density distributions of respective rows in the 10th exemplary embodiment.

In the case of the 1-on-3-off illumination pattern, as shown in FIG. 40, each row that is associated with no defective laser light emitting element exhibits a density distribution having four peaks whose densities are higher than or equal to the failure judgment reference value because four laser light emitting elements V arranged in the width direction have emitted laser light beams. The failure judgment reference value is a predetermined reference value to be used for judging that a laser light emitting element V is not defective if a corresponding density is higher than or equal to it. The failure judgment reference value is set on the basis of a result of an experiment using an actual apparatus, a computer simulation, or the like.

On the other hand, where the laser light emitting element V having the laser light emitting element number "11" is a defective one, as shown in FIG. 40 only three peaks appear in the density distribution of the third row.

The vertical axis of FIG. 40 represents the density which decreases as the position goes up on the vertical axis. The first standard density profiles of the respective rows, the information indicating the laser light emitting element groups, and the failure judgment reference value are stored in, for example, a predetermined storage location of the nonvolatile memory 70D in advance.

At step S70, the CPU 70A determines a defective laser light emitting element on the basis of the selected density distribution of one row, the corresponding first standard density profile, and the information indicating the laser light emitting element groups.

More specifically, the CPU 70A determines a peak-absent column in the density distribution of one row selected at step S66 on the basis of a result of comparison between the selected density distribution and the corresponding first standard density profile, determines a defective laser light emitting element by referring to the information indicating the laser light emitting element groups, and stores the number of the determined defective laser light emitting element in, for example, a predetermined storage location of the RAM 70C.

For example, in the density distributions of the respective rows shown in FIG. 40, since no density peak exists at the third row/third column position, it is determined that the defective laser light emitting element is the laser light emitting element V11 which is the third laser light emitting element V of the third laser light emitting element group.

At step S72, the CPU 70A sets the laser light emission amount of the laser light emitting elements (correction laser light emitting elements) V that are adjacent to the defective laser light emitting element in the width direction to a value that is different from a predetermined laser light emission amount by increasing the value of currents to be supplied to them. For example, if the predetermined laser light emission amount is "medium," the CPU 70A sets the laser light emission amount of the correction laser light emitting elements V larger than the predetermined laser light emission amount by setting the laser light emission amount of the correction laser light emitting elements V to "large." The laser light emission amount "medium" means a value of about $1.5\times10^4$ J/m$^2$, for example. The laser light emission amount "large" means a value (e.g., about $3.5\times10^4$ J/m$^2$) which is larger than the value of "medium."

Figure 41A:
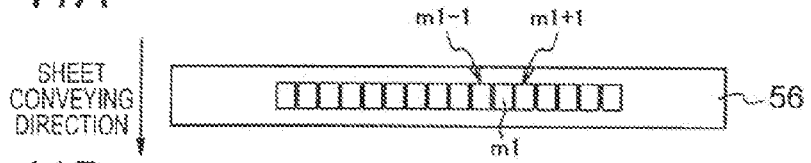
FIGS. 41A, 41B and 41C are schematic diagrams illustrating a laser emission amounts correction method employed in the 10th exemplary embodiment.
Figure 41B:
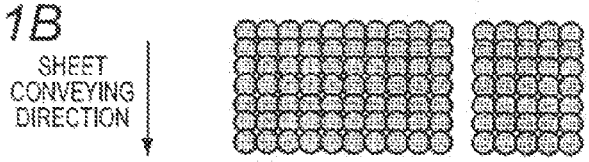
Figure 41C:
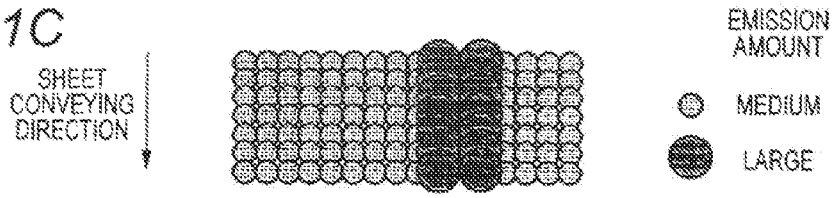

FIGS. 41A-41C illustrate a relationship between the manner correction of the laser light emission amount of correction laser light emitting elements V which is performed at step S72 and their laser light illumination ranges. As shown in FIG. 41A, if a laser light emitting element Vm1 is a defective one, laser light emitting elements Vm1−1 and Vm1+1 are made correction laser light emitting elements V.

In the state that the laser light emission amount of the correction laser light emitting elements V is set at "medium," as shown in FIG. 41B there may occur an event that the region that should be illuminated with laser light by the defective laser light emitting element Vm1 if it were not defective is not illuminated at all or illuminated with a lower illumination amount than the regions that are illuminated by the laser light emitting elements Vm1−1 etc. that operate normally.

In contrast, as shown in FIG. 41C, since the laser light emission amount of correction laser light emitting elements Vm1−1 and Vm1+1 is set to "large," the laser light illumination ranges are enlarged and the region that should be illuminated by the defective laser light emitting element Vm1 if it were not defective comes to be illuminated with laser light.

At step S74, the CPU 70A judges whether or not steps S66-S72 have been executed for the density distributions of all the rows acquired at step S64. The running of the program is finished if the judgment result is affirmative.

On the other hand, if the judgment result is negative, the process returns to step S66 to execute steps S66-S72 for the density distribution of a row that has not been selected yet.

As described above, in this exemplary embodiment, a defective laser light emitting element is determined on the basis of first standard density profiles and density distributions of a correction image R that have been acquired by causing the laser light emitting elements V to emit laser light beams in the 1-on-X-off illumination pattern. And the laser light illumination amount of a region that should be illuminated by the defective laser light emitting element if it were not defective is corrected by controlling the laser light emission amount of the laser light emitting elements V that are adjacent to the defective one.

An advantage is therefore expected that even when a certain laser light emitting element V of the laser drying unit 56 goes defective, deterioration in image quality can be suppressed without replacing the laser drying unit 56 in its entirety.

Although in this exemplary embodiment the 1-on-X-off illumination pattern is employed as the predetermined laser light illumination pattern, any laser light illumination pattern may be employed as long as it makes it possible to determine a defective laser light emitting element uniquely on the basis of how the densities of a correction image R are varied by laser light illumination.

Although in the above description the laser light emitting elements V that are adjacent to a defective laser light emitting element in the width direction are employed as correction laser light emitting elements V (step S72), correction laser light emitting elements V may be determined in another manner.

For example, one of the laser light emitting elements V that are adjacent to a defective laser light emitting element or laser light emitting elements V that are located in a predetermined range around a defective laser light emitting element may be employed as correction laser light emitting elements V.

Figure 42A:
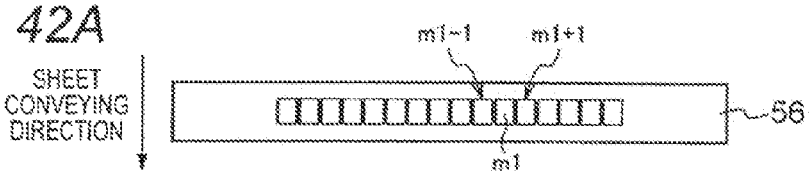
FIGS. 42A, 42B and 42C are schematic diagrams illustrating other laser emission amounts correction methods employed in the 10th exemplary embodiment.
Figure 42B:
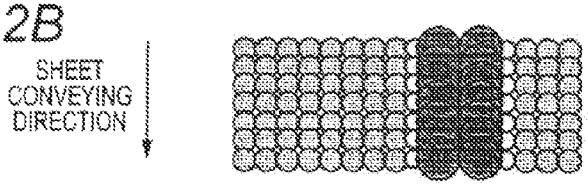

For another example, if a laser light emitting element Vm1 is a defective one (see FIG. 42A), as shown in FIG. 42B adjustments may be made in such a manner that the laser light emission amount of the adjacent laser light emitting elements Vm1−1 and Vm1+1 is set to "large" and that of the laser light emitting elements Vm1−2 and Vm1+2 that are adjacent to the respective laser light emitting elements Vm1−1 and Vm1+1 is set to "small." The laser light emission amount "small" means a value (e.g., about $1.0\times10^4$ J/m$^2$) which is smaller than the value of "medium."

The reason why the laser light emission amount of the laser light emitting elements Vm1−2 and Vm1+2 is set to "small" is as follows. That is, if the laser light emission amount of the adjacent laser light emitting elements Vm1−1 and Vm1+1 were set to "large" and that of the laser light emitting elements Vm1−2 and Vm1+2 were kept at "medium," the regions to be illuminated originally by the laser light emitting elements Vm1−2 and Vm1+2 would receive a larger amount of laser light than the predetermined amount "medium."

Figure 42C:
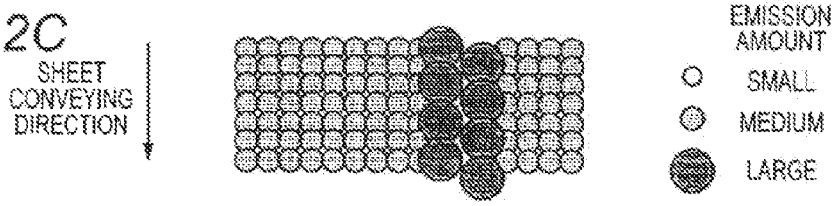
Figure 43:
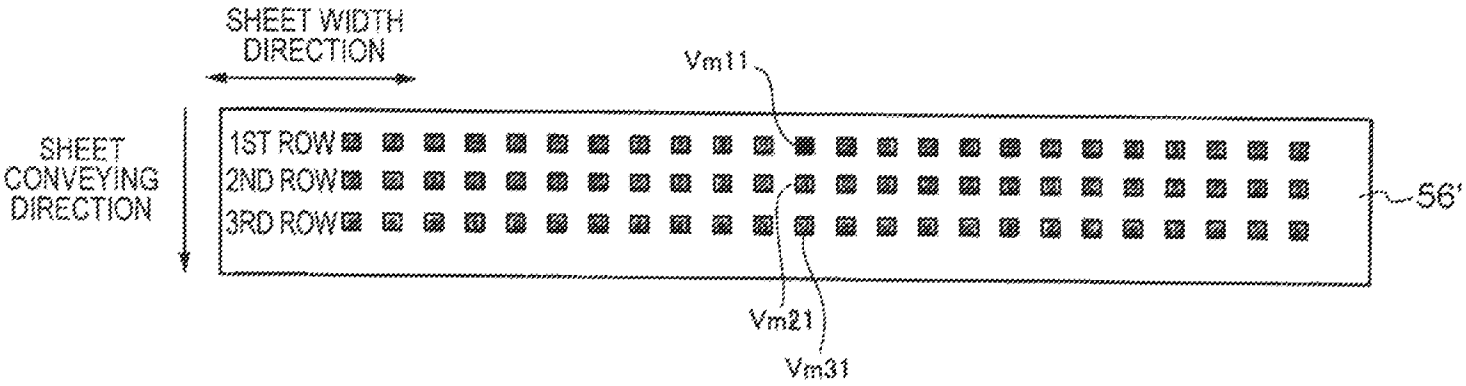
FIG. 43 is a schematic diagram illustrating a laser emission amounts correction method which is employed with a VCSEL in the 10th exemplary embodiment.

To minimize the number of regions that receive a larger amount of laser light than the predetermined amount, as shown in FIG. 42C a control may be made so that the laser light emitting elements Vm1−1 and Vm1+1 emit laser light alternately; that is, the laser light emission amount of one of the laser light emitting elements Vm1−1 and Vm1+1 is set to "large" and that of the other is set to "0."

Where as shown in FIG. 43 a VCSEL 56' in which plural laser light emitting elements V are arranged also in the conveying direction is used instead of the laser drying unit 56, a defective laser light emitting element is determined by causing the laser light emitting elements V of each row to emit laser light beams in the 1-on-X-off illumination pattern.

If a laser light emitting element Vm11 is a defective one, adjustments are made in such a manner that the laser light emission amount of laser light emitting elements Vm21 and Vm31 whose laser light illumination ranges overlap with the laser light illumination range of the laser light emitting element Vm11 is set larger than the predetermined laser light emission amount so that the total laser light emission amount of the laser light emitting elements Vm11, Vm21, and Vm31 remains the same as in the case where each of them emits laser light with the predetermined amount.

More specifically, the laser light emission amount of the laser light emitting elements Vm21 and Vm31 may be set to 1.5 times the predetermined laser light emission amount. Alternatively, adjustments may be made in such a manner that the laser light emission amount of the laser light emitting element Vm21 is set two times the predetermined laser light emission amount whereas that of the laser light emitting elements Vm31 is kept equal to the predetermined laser light emission amount.

Although in this exemplary embodiment a correction image R is formed in the K color, the color of the correction image R is not limited to the K color and may be another ink color such as Y, M, or C. However, since the density reading sensitivity to the Y color of the density reading sensor 58 is lower than the sensitivities to other colors, using the Y color as the color of a correction image R is not preferable. The use of the K color is preferable.

In this exemplary embodiment, densities of a correction image R is read by the density reading sensor 58 which is provided in the inkjet recording apparatus 12. Alternatively, for example, densities of a correction image R may be read by a density reading device such as a scanner that is connected to a communication line (not shown). In this case, for example, the read-out densities of the correction image R may be received through the communication line I/O 60 and stored in a predetermined storage location of the RAM 70C.

Exemplary Embodiment 11

In general, there may occur trouble that ink droplets ejected by a certain nozzle N of the head array 30 do not reach predetermined positions on a sheet P due to an attachment error of the nozzle N, ink clogging, a failure of a piezoelectric element for ejecting ink droplets, or some other reason and what is called a white streak is formed in a region that has not received ink droplets ejected from the nozzle N.

In a situation that such a white streak is formed, if the laser light emitting elements V of the laser drying unit 56 emit laser light beams with the predetermined laser emission amount which maximizes the densities of an image, the permeation of the ink dots into a sheet P is suppressed and hence a white streak may remain on the sheet P.

In view of the above, an 11th exemplary embodiment provides an inkjet recording apparatus 12 in which a nozzle N under operation failure (defective nozzle) of the head array 30 is determined by the same method as described in the 10th exemplary embodiment and the laser light emission amount of the laser light emitting element V corresponding to the defective nozzle is controlled to correct the densities of a region that does not receive ink droplets because of the defective nozzle. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 44:
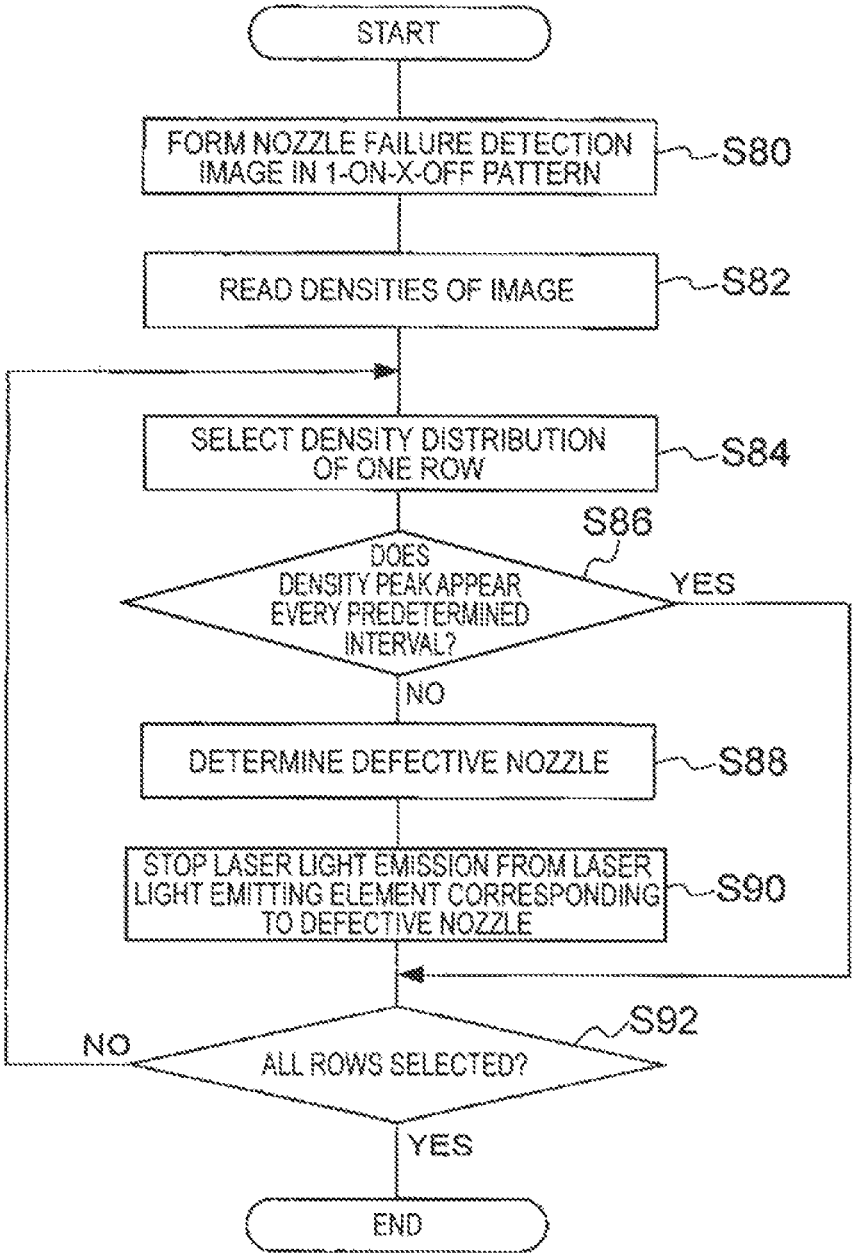
FIG. 44 is a flowchart of a correction program for correcting the laser light emission amount of an infrared laser light emitting element corresponding to a defective nozzle which is used in an 11th exemplary embodiment.

FIG. 44 is a flowchart of a program for correcting the laser light emission amount depending on the operation status a nozzle N of the head array 30 which is run by the CPU 70A of the computer 70 at a time other than some time in an image forming period, such as before a start of a job of the inkjet recording apparatus 12. In the following description, it is assumed that a nozzle N31 having a nozzle number 31 is a defective nozzle.

At step 80, the nozzles N of the head array 30 eject droplets onto a sheet P in a predetermined ink droplets ejecting pattern. The predetermined ink droplets ejecting pattern, which is stored in, for example, a predetermined storage location of the nonvolatile memory 70D in advance, is, for example, the 1-on-X-off ejecting pattern which is similar to the 1-on-X-off illumination pattern described in the 10th exemplary embodiment.

Figure 45:
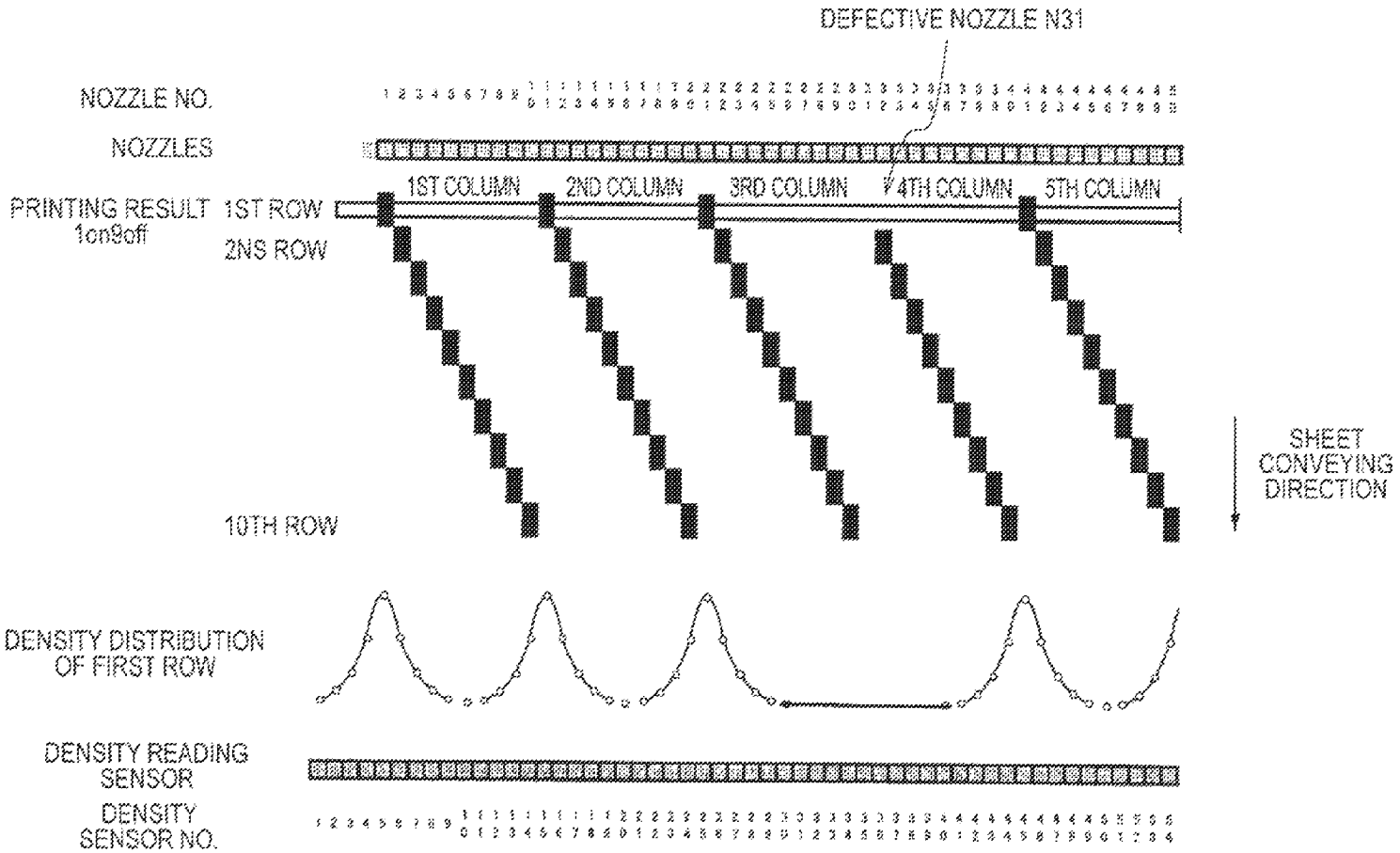
FIG. 45 shows an example image that is formed when ink droplets have been ejected onto a sheet in a 1-on-9-off ejecting pattern in the 11th exemplary embodiment.

FIG. 45 shows an example image that is formed when ink droplets have been ejected onto a sheet P in a 1-on-9-off ejecting pattern. It goes without saying that X of the 1-on-X-off ejecting pattern is not limited to 9 and may be another number. To simplify the description, it is assumed that the number n of nozzles is equal to 50.

As shown in FIG. 45, ink droplets ejected from the nozzles N having nozzle numbers $n_1$=(1, 11, 21, 31, 41) (first nozzle group) are stuck to a sheet P in a first row and ink droplets ejected from the nozzles N having nozzle numbers $n_1$=(2, 13, 23, 33, 43) (second nozzle group) are stuck to the sheet P in a second row. Likewise, ink droplets ejected from the nozzles N of each of the third to 10th nozzle groups are stuck to the sheet P in the corresponding row. Since the nozzle N31 is defective, no ink droplet is stuck to the sheet P at the first low/fourth column position.

As described above, at step S80, the head array 30 is controlled so that the sets of nozzles belonging to the respective nozzle groups eject ink droplets with sequential delays in, for example, the 1-on-9-off ejecting pattern.

At step S82, the CPU 70A controls the density reading sensor 58 so that it reads densities of the ink droplets in the width direction on a nozzle-group-by-nozzle-group basis, that is, on a row-by-row basis (see FIG. 45). The acquired densities of each row (density distribution) are stored in, for example, a predetermined storage location of the RAM 70C so as to be correlated with the respective density sensors S.

At step S84, the CPU 70A selects a density distribution of one row from the density distributions of the respective rows acquired at step S82.

At step S86, the CPU 70A compares the density distribution of one row selected at step S84 with a second standard density profile corresponding to the selected row and judges whether or not the number of peaks of the selected density distribution that have densities higher than or equal to a failure judgment reference value is equal to that of the first standard density profile. The process moves to step S92 if the judgment result is affirmative, and moves to S88 if it is negative.

The second standard density profile is a density distribution of each row of a noise failure detection image that should be obtained when ink droplets are ejected by nozzles N of the head array 30 that do not exhibit any operation failure.

In the case of the 1-on-9-off ejecting pattern (the number n of nozzles: 50), each row that is associated with no defective nozzle exhibits a density distribution having five peaks whose densities are higher than or equal to the failure judgment reference value because five nozzles N arranged in the width direction have ejected ink droplets.

On the other hand, where the nozzle N31 is a defective one, as shown in FIG. 45 only four peaks appear in the density distribution of the first row because absence of a peak in the fourth column.

The second standard density profiles of the respective rows, the information indicating the nozzle groups, and the failure judgment reference value are stored in, for example, a predetermined storage location of the nonvolatile memory 70D in advance.

At step S88, the CPU 70A determines a defective nozzle on the basis of the density distribution of one row selected at step S84, the corresponding second standard density profile, and the information indicating the nozzle groups.

More specifically, the CPU 70A determines a peak-absent column in the density distribution of one row selected at step S84 on the basis of a result of comparison between the selected density distribution and the corresponding second standard density profile, determines a defective nozzle by referring to the information indicating the nozzle groups, and stores the number of the determined defective nozzle in, for example, a predetermined storage location of the RAM 70C.

For example, in the density distributions of the respective rows shown in FIG. 45, since no density peak exists at the first row/fourth column position, it is determined that the defective nozzle is the nozzle N31 which is the fourth nozzle N of the first nozzle group.

At step S90, the CPU 70A determines a laser light emitting element number corresponding to the nozzle number of the defective nozzle determined at step S88 by, for example, referring to a laser light illumination correspondence table as shown in FIG. 30 that was generated in advance by executing the process described in the eighth exemplary embodiment. And the CPU 70A controls the laser drying unit 56 so that the laser light emitting element V (particular laser light emitting element) having the acquired laser light emitting element number does not emit laser light.

Figure 46:
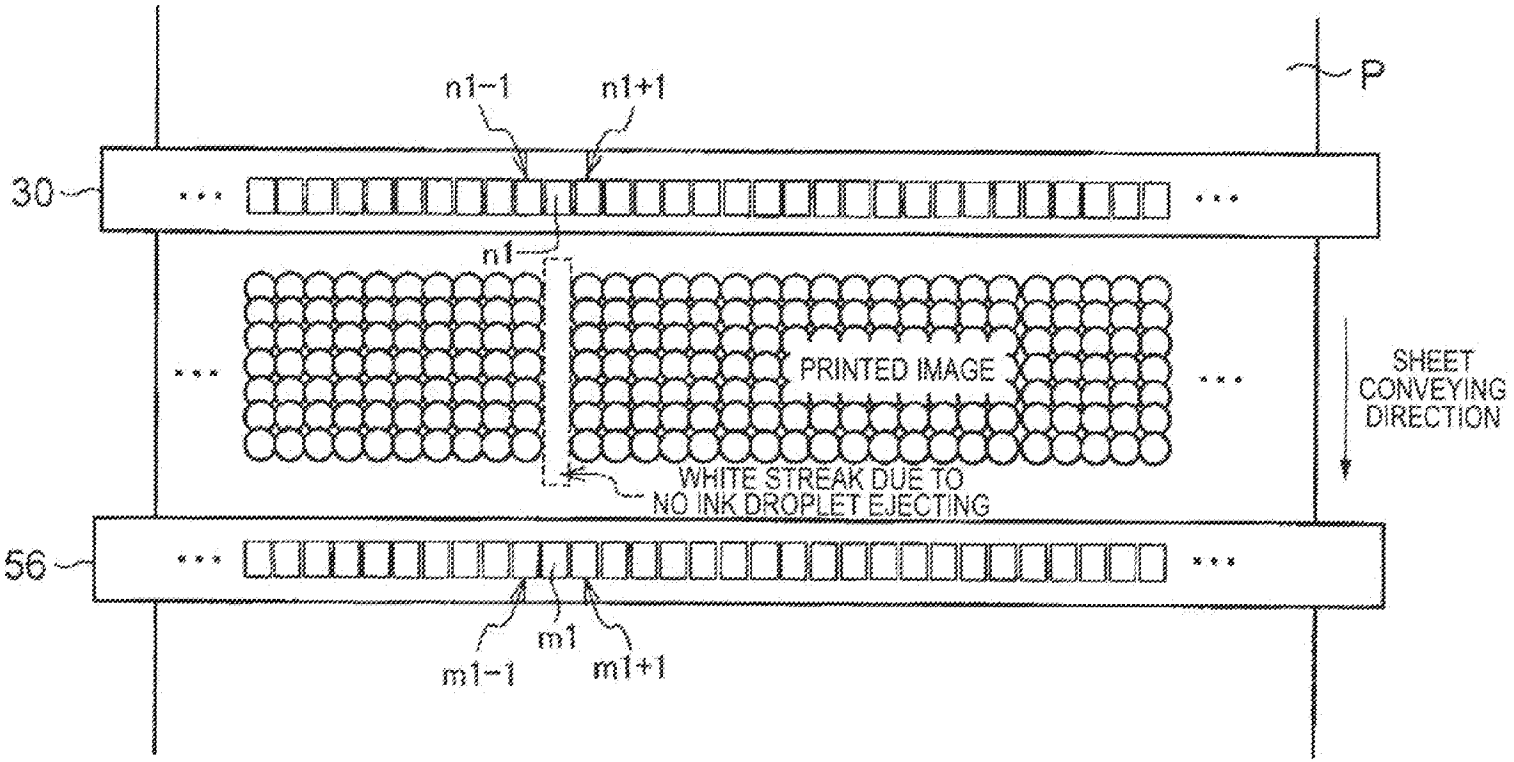
FIG. 46 shows a relationship between a defective nozzle and a particular laser light emitting element in a case that the nozzle resolution of the head array is equal to the laser light illumination resolution of the laser drying unit in the 11th exemplary embodiment.

FIG. 46 shows a relationship between a defective nozzle and a particular laser light emitting element. In FIG. 46, it is assumed that the nozzle resolution of the head array 30 is equal to the laser light illumination resolution of the laser drying unit 56.

A nozzle Nn1 is assumed to be a defective nozzle. A white streak appears downstream of the nozzle Nn1 in the conveying direction because of no ejecting of ink droplets. The current that is supplied to the laser light emitting element Vm1 that corresponds to the nozzle Nn1 is set to 0 so that the laser light emitting element Vm1 does not emit laser light. The laser light emitting elements V other than the laser light emitting element Vm1 apply laser light to the ink droplets with the predetermined laser light emission amount.

In this case, since the drying proceeds more slowly in the white streak portion than in portions that are adjacent to the white streak portion in the width direction, the ink droplets existing in the portions that are adjacent to the white streak portion in the width direction permeates into the sheet P so as to spread to the white streak portion (blooming) as if to hide the white streak. Thus, the white streak becomes less visible to the user.

On the other hand, since the laser light emitting elements V other than the laser light emitting element Vm1 illuminate the ink droplets with the predetermined laser light illumination amount, the ink droplets are fixed to the sheet P.

At step S92, the CPU 70A judges whether or not steps S84-S90 have been executed for the density distributions of all the rows acquired at step S82. The running of the program is finished if the judgment result is affirmative.

On the other hand, if the judgment result is negative, the process returns to step S84 to execute steps S84-S90 for the density distribution of a row that has not been selected yet.

Figure 47A:
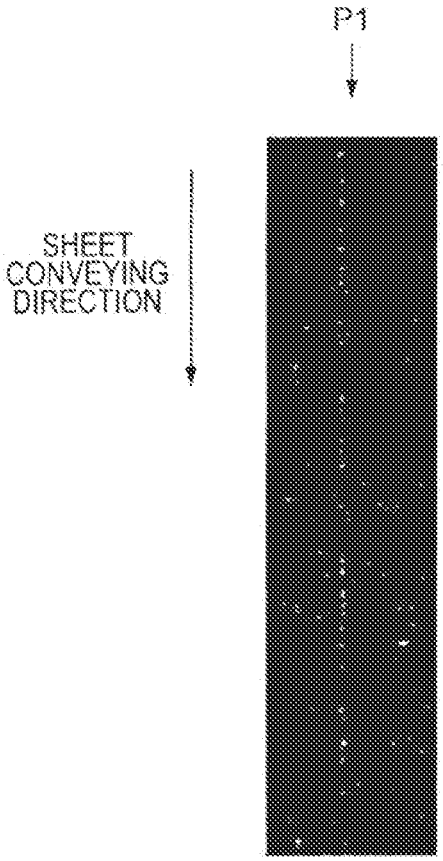
FIGS. 47A and 47B show results of an experiment in which the correction program of the 11th exemplary embodiment was not run and was run, respectively.
Figure 47B:
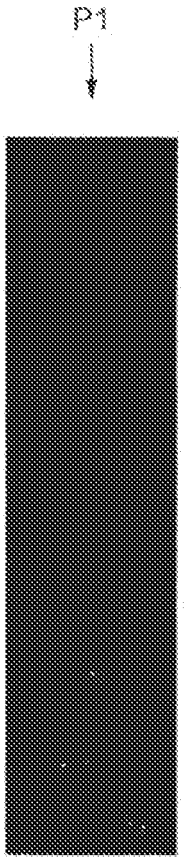

FIGS. 47A and 47B show results of an experiment in which the correction program of this exemplary embodiment was not run and was run, respectively. FIG. 47A shows an image that was obtained when a defective nozzle was found in the head array 30 but the correction program of this exemplary embodiment was not run, that is, laser light beams were emitted from the laser light emitting elements V with the predetermined laser light emission amount. FIG. 47B shows an image that was obtained when laser light was not emitted from the particular laser light emitting element corresponding to the defective nozzle.

Whereas in FIG. 47A a white streak running in the conveying direction is clearly visible (indicated by arrow P1), a white streak in FIG. 47B is less visible than the one in FIG. 47A.

As described above, in this exemplary embodiment, a defective nozzle is determined on the basis of second standard density profiles and density distributions of a nozzle failure detection image which is formed by causing the nozzles N to eject ink droplets in the 1-on-X-off ejecting pattern. And laser light emission from a particular laser light emitting element corresponding to the defective nozzle is prohibited. As a result, a white streak that appears due to the presence of the defective nozzle can be made less visible.

Although in this exemplary embodiment the 1-on-X-off ejecting pattern is employed as the predetermined ink droplets ejecting pattern, any ink droplets ejecting pattern may be employed as long as it makes it possible to determine a defective nozzle uniquely on the basis of how the densities of a nozzle failure detection image are varied by presence of a defective nozzle.

Although in this exemplary embodiment laser light emission from a particular laser light emitting element corresponding to the defective nozzle is prohibited, the manner of control of a particular laser light emitting element (and other ones) is not limited to it. For example, the laser light emission amount of a particular laser light emitting element may be set smaller than the predetermined laser light emission amount. Also in this case, the degree of blooming of ink droplets to a white streak portion becomes higher and hence the white streak portion is made less visible than in the case where the white streak portion is illuminated with the predetermined laser light illumination amount.

It is expected that a white streak is made even less visible by not only setting to 0 (or decreasing) the laser light emission amount of particular laser light emitting element but also decreasing that of laser light emitting elements V located within a predetermined range around the particular laser light emitting element. For example, referring to FIG. 46, the laser light emission amount of the laser light emitting element Vm1 is set to 0 and the laser light emission amount of the laser light emitting elements Vm1−1 and Vm1+1 is set smaller than the predetermined laser light emission amount.

The color of ink droplets that are ejected from the nozzles N to form a nozzle failure detection image is not limited to any color. However, since the density reading sensitivity to the Y color of the density reading sensor 58 is lower than the sensitivities to other colors, the use of the Y color is not preferable. The use of the K color is preferable.

In this exemplary embodiment, densities of a nozzle failure detection image is read by the density reading sensor 58 which is provided in the inkjet recording apparatus 12. Alternatively, for example, densities of a nozzle failure detection image may be read by a density reading device such as a scanner that is connected to a communication line (not shown). In this case, for example, the read-out densities of the nozzle failure detection image may be received through the communication line I/O 60 and stored in a predetermined storage location of the RAM 70C.

Exemplary Embodiment 12

In the 11th exemplary embodiment, when the head array 30 includes a defective nozzle, a white streak is made less visible utilizing blooming of ink droplets by setting the laser light emission amount of a particular laser light emitting element smaller than the predetermined laser light emission amount.

On the other hand, even if the head array 30 does not include a defective nozzle, starting drying of ink droplets before their blooming on a sheet P may produce inkless portions between ink droplets and thereby lower the image quality. Such an event occurs when laser light beams are applied to an image (low-density image) in which the density of ink droplets placed on a sheet P is lower than a predetermined image density because, for example, the nozzle resolution of the head array 30 is lower than a predetermined nozzle resolution or the ink droplets ejecting density corresponding to ejecting position information contained in image information of an original image is lower than a predetermined ink droplets ejecting density.

Figure 48A:
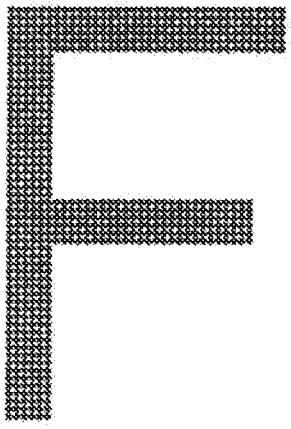
FIGS. 48A, 48B, 48C and 48D are schematic diagrams illustrating influences of application of infrared laser light beams to a low-resolution image.
Figure 48B:
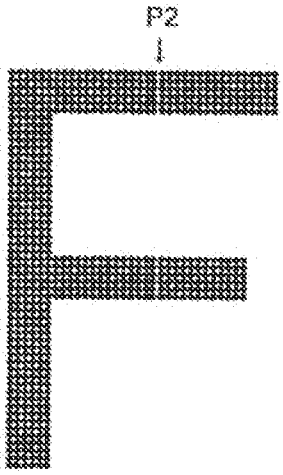

FIGS. 48A and 48B show low-density images that have been subjected to laser light illumination. These images have inkless portions and a white streak (indicated by arrow P2).

On the other hand, if a low-density image is not subjected to laser light illumination, the areas of inkless portions are decreased because of blooming of ink droplets. However, it is difficult to prevent image quality degradation because outlines bloom in a resulting image.

Figure 48C:
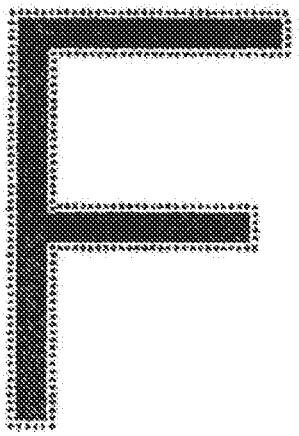

FIG. 48C shows a low-density image that has not been subjected to laser light illumination. Although the areas of inkless portions are decreased, the image suffers blooming of the outline.

A 12th exemplary embodiment provides an inkjet recording apparatus 12 in which if it is judged that an image to be formed on a sheet P is a low-resolution image, the positions and amounts of the laser light illumination by the laser drying unit 56 are controlled so that the areas of inkless portions are decreased and outline blooming is suppressed. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 49:
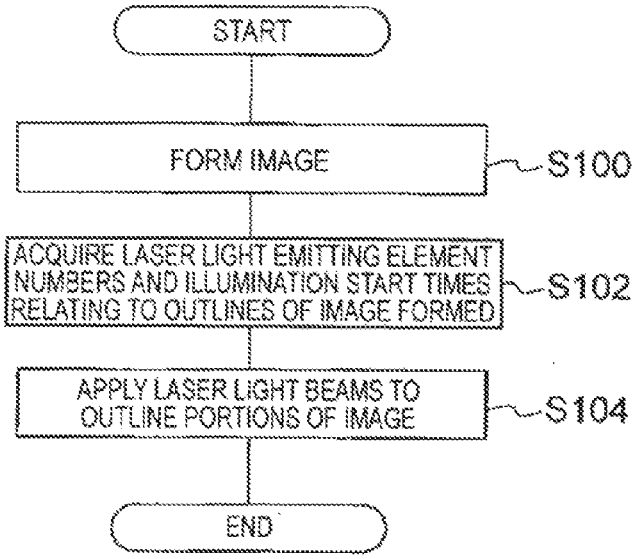
FIG. 49 is a flowchart of a laser light illumination control program used in a 12th exemplary embodiment.

FIG. 49 is a flowchart of a laser light illumination control program which is run by the CPU 70A of the computer 70 if it is judged that an image to be formed on a sheet P is a low-resolution image when, for example, an image formation request is received from the user.

First, at step S100, the CPU 70A forms an image on a sheet P by controlling the sheet supply unit 74, the sheet conveying unit 76, and the image forming unit 78 on the basis of image information of an original image designated by the user.

At step S102, the CPU 70A acquires nozzle numbers of nozzles N that ejected ink droplets that formed outlines of the image (outline formation ink droplets) and also acquires laser light emitting element numbers corresponding to those nozzle numbers by referring to a laser light illumination correspondence table as shown in FIG. 30. Then the CPU 70A stores, in, for example, a predetermined storage location of the RAM 70C, an outline illumination table in which the acquired laser light emitting element numbers and emission start times of the laser light emitting elements V having the laser light emitting element numbers are correlated with each other.

At step S104, referring to the outline illumination table, the CPU 70A causes laser light emitting elements V whose illumination start times have been reached to start applying laser light to the sheet P. Laser light emission times, which are set at times for emission of predetermined numbers of ink droplets, are stored in, for example, a predetermined storage location of the nonvolatile memory 70D. More specifically, the laser light emission times are set at times for emission of ink droplets for formation of outlines.

Figure 48D:
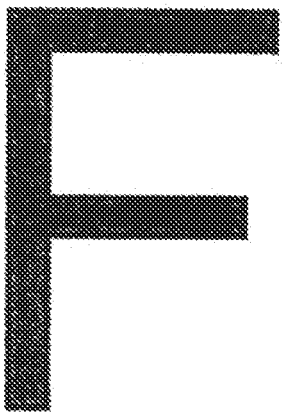

FIG. 48D shows a result of running of the program used in this exemplary embodiment. As shown in FIG. 48D, the density reading sensor 58 does not apply laser light to the ink droplets constituting the portion other than the outline and hence the ink droplets in the region (inside region) surrounded by the outline bloom.

On the other hand, the ink droplets constituting the outline receive laser light beams emitted from the laser drying unit 56 and hence their blooming is suppressed. Furthermore, since these ink droplets are illuminated with laser light beams with such timing that the optical densities of the image are maximized, the density difference between the outline and the inside region is increased. Thus, the outline is emphasized.

As described above, in this exemplary embodiment, whereas ink droplets constituting outlines of image elements are illuminated with laser light beams to suppress their blooming, ink droplets located inside the image elements are not illuminated with laser light to let them bloom. In this manner, the areas of inkless portions such as a white streak are reduced and image quality is enhanced. A further advantage is expected that the energy consumption can be made lower than in a case that the laser light emission amount is not controlled in accordance with portions of an image.

Although in this exemplary embodiment ink droplets located inside image elements are not illuminated with laser light, they may be illuminated with laser light beams with an amount that is smaller than a predetermined value. Even in this case, the effect of reducing the areas of inkless portions is expected because ink droplets bloom more than in the case that the ink droplets are illuminated with laser light beams with the predetermined amount. For example, in a high-speed printing region for which the printing speed is as high as 200 m/min, inside portions of image elements may be illuminated with laser light beams with an amount that is smaller than a predetermined value because it is necessary to shorten the ink droplets drying time.

The laser light emission amount of laser light beams to be applied to droplets constituting outlines may be varied in accordance with the sheet type. For example, for the plain paper sheet in which ink droplets tend to bloom more than in the inkjet-dedicated sheet, the laser light emission amount is larger than for the inkjet-dedicated sheet. However, at an outline where ink droplets of two or more colors are placed adjacent to each other, it is desirable that the laser light emission amount be set larger than a predetermined value irrespective of the sheet type because blooming might otherwise occur at their boundary.

Exemplary Embodiment 13

Figure 50:
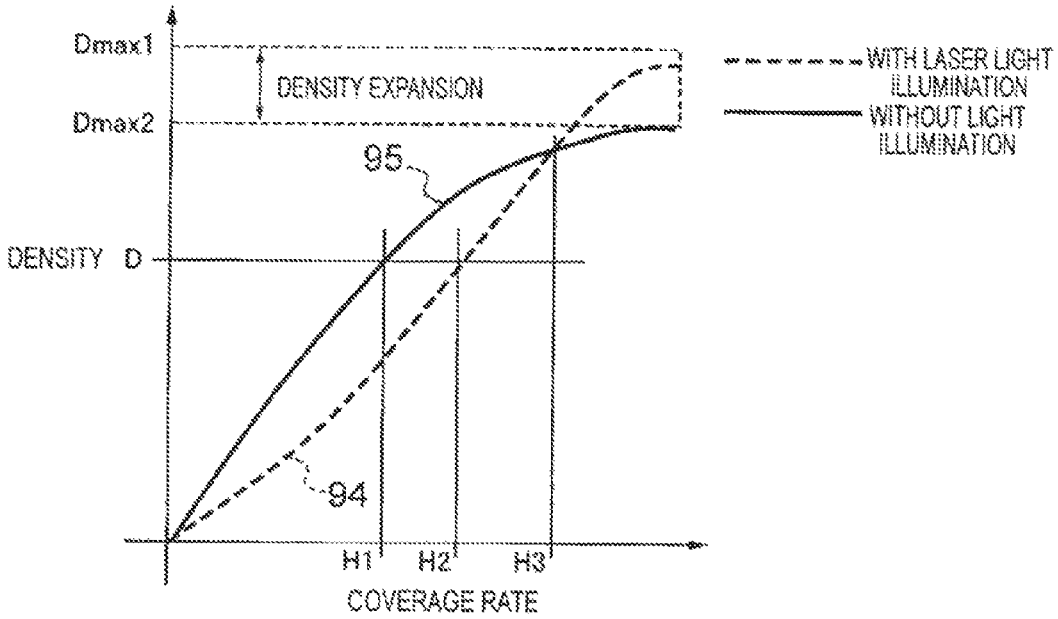
FIG. 50 is a graph showing a relationship between the coverage rate and the image density for two cases that infrared laser light illumination is done and not done.

FIG. 50 is a graph showing a relationship between the coverage rate and the image density for two cases that laser light illumination is done and not done. The vertical axis represents the density (the density increases as the position goes up), and the horizontal axis represents the coverage rate (the coverage rate increases as the position goes rightward). Curve 94 represents a density characteristic with laser light illumination, and curve 95 represents a density characteristic without laser light illumination. The term "coverage rate" means the ratio of the number of positions to which an ink droplet(s) has actually reached to the total number of positions to which an ink droplet(s) can reach in a predetermined area (e.g., 1-inch square area).

FIG. 50 shows a tendency that when the coverage rate is smaller than H3 the density of an image is decreased by illuminating it with laser light and that, conversely, when the coverage rate is larger than H3 the density of an image is increased by illuminating it with laser light.

From another point of view, a certain density D corresponds to different coverage rates, that is, a coverage rate with laser light illumination and a coverage rate without laser light illumination. An image that has a coverage rate H2 and is given the density D with laser light illumination and another image that has a coverage rate H1 and is given the same density D without laser light illumination are different from each other in texture.

The image that has the coverage rate H2 and is given the density D with laser light illumination is higher in graininess and gloss than the image that has the coverage rate H1 and is given the same density D without laser light illumination because the former is larger in the number positions that have received an ink droplet(s) in a unit area and, in addition, blooming of the ink droplets is suppressed by the laser light illumination. Graininess is a measure of roughness of an image; the roughness of an image decreases as its graininess increases.

A 13th exemplary embodiment provides an inkjet recording apparatus 12 in which the texture of an image formed on a sheet P is varied in accordance with the type of the image without varying a specified density of the image by varying the amount of laser light applied to ink droplets. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 51:
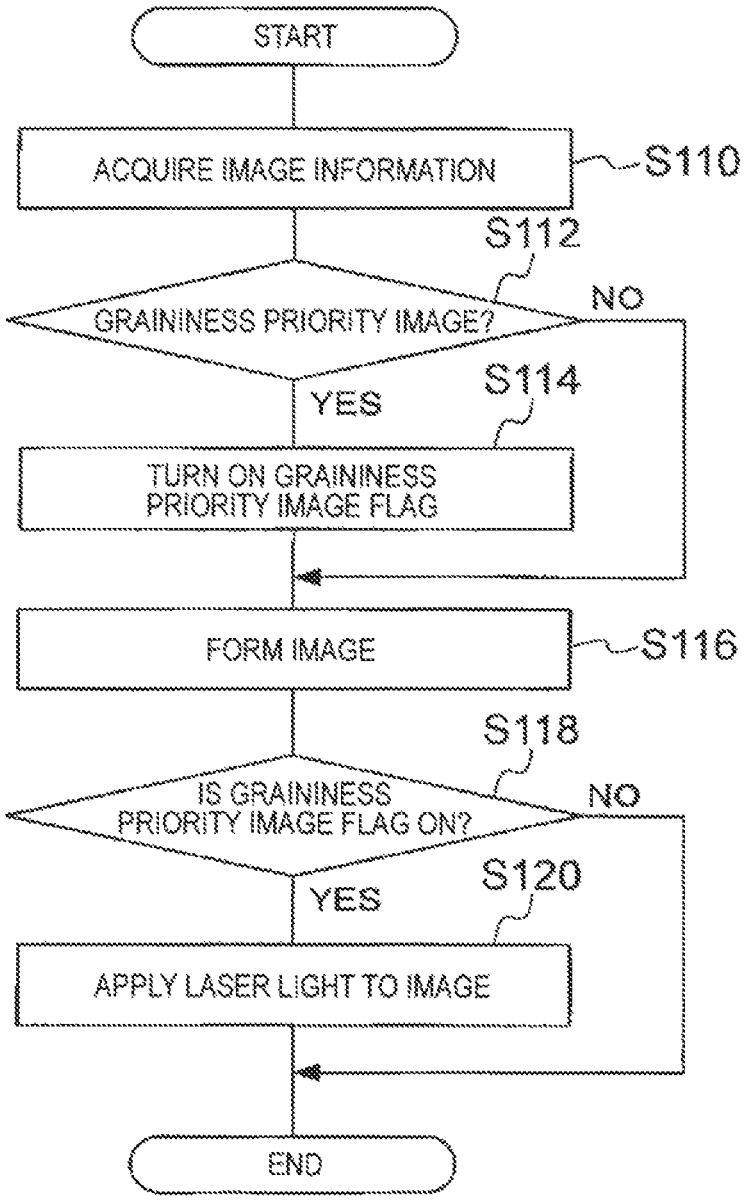
FIG. 51 is a flowchart of a laser light illumination control program used in a 13th exemplary embodiment.

FIG. 51 is a flowchart of a laser light illumination control program which is run by the CPU 70A of the computer 70 when, for example, an image formation request is received from the user.

It is assumed that image information of an original image is received together with the image formation request from, for example, a terminal apparatus (not shown) connected to a communication line (not shown) through the communication line I/F 60 and is stored in a predetermined storage location of the RAM 70C in advance.

First, at step S110, the CPU 70A acquires the image information of the original image from the predetermined storage location of the RAM 70C. At this time, the CPU 70A turns off a graininess priority image flag which is stored in, for example, a predetermined storage location of the RAM 70C.

At step S112, the CPU 70A refers to an image type contained in the image information of the original image acquired at step S110 and judges whether the original image is an image (e.g., photograph) for which priority is given to graininess or an image (e.g., text or graphics) for which priority is not given to graininess. The process moves to step S114 if the judgment result is affirmative, and moves to step S116 if it is negative.

Although at step S112 the CPU 70A acquires image type information from the image information of the original image, the CPU 70A may acquire image type information given by the user through the manipulation display unit 72. If no image type is given by the user and the image information of the original image does not contain an image type, the CPU 70A may determine an image type on the basis of information other than an image type contained in the image information of the original image.

At step S114, the CPU 70A turns on the graininess priority image flag. At step S116, the CPU 70A forms an image on a sheet P by causing the head array 30 to emit ink droplets on the basis of image density information and ink droplet ejecting position information that are contained in the image information of the original image.

In doing so, the CPU 70A determines a coverage rate of the image by, for example, referring to a coverage rate table. The coverage rate table is a table in which coverage rates for realizing each image density for the respective states of the graininess priority image flag, that is, the respective image types, are set according to the graph of FIG. 50. The coverage rate table is stored in, for example, a predetermined storage location of the nonvolatile memory 70D in advance.

Table 6 shows an example coverage rate table.

TABLE 6

| | | State of graininess priority image flag | |
|---|---|---|---|
| | | Off | On |
| Density | D | H1 | H2 |
| | ... | ... | ... |

For example, if the graininess priority image flag is off and the density information of the image indicates a density D, ink droplets are ejected onto the sheet P with a coverage rate H1. If the graininess priority image flag is on and the density information of the image indicates the density D, ink droplets are ejected onto the sheet P with a coverage rate H2 which is larger than H1.

At step S118, the CPU 70A judges whether the graininess priority image flag is on. The running of the program is finished if the judgment result is negative. The process moves to step S120 if the judgment result is affirmative.

At step S120, the CPU 70A controls the laser drying unit 56 so that the laser light emitting elements V of the laser drying unit 56 apply laser light beams having the predetermined emission amount to the image. Then the running of the program is finished.

With the above process, an image of such a type that importance is attached to graininess (e.g., photograph) is illuminated with laser light in such a manner that the coverage rate is set larger than in a case that the image were of such a type that importance is not attached to graininess and should be given the same density.

On the other hand, an image of such a type that importance is not attached to graininess is not illuminated with laser light with the coverage rate set smaller than in a case that the image were of such a type that importance is attached to graininess and should be given the same density.

Table 7 shows results (results-1) of an experiment in which the program of FIG. 51 was run and results (results-2) of a comparative experiment in which images were dried by a carbon heater rather than the laser drying unit 56.

TABLE 7

| | Results-1 | | Results-2 | |
|---|---|---|---|---|
| Ink droplet amount | Small | Small | Small | Small |
| Coverage rate | H1 | H2 | H1 | H2 |
| Laser illumination | Not done | Done | Not done | Not done |
| Density | 0.2 | 0.2 | 0.2 | 0.3 |
| Graininess | Δ | ○ | Δ | Δ |
| Gloss | Low | High | Low | Low |

The ink droplet amount "small" means that the ink droplet amount is smaller than or equal to 4 pl. The graininess "o" means that high graininess with no grain-induced roughness, and the graininess "Δ" means that graininess is lower than the level of "o." Graininess and gloss were evaluated sensorily.

Results-1 indicate that images are obtained that have the same density but are evaluated differently in terms of graininess and gloss depending on whether laser illumination is done or not. On the other hand, in results-2, the difference in coverage rate directly resulted in the difference in density with no difference in each of graininess and gloss.

As such, the experimental results of Table 7 show that two images can be obtained that have the same density but are different in texture.

Although in this exemplary embodiment the laser drying unit 56 does not emit laser light beams if the graininess priority image flag is off, a modification is possible in which at step S120 the laser drying unit 56 emit laser light beams having a smaller amount than the predetermined laser light emission amount. Even in this case, an effect equivalent to the effect of the experimental results of Table 7 can be obtained.

As described above, in this exemplary embodiment, the texture of an image formed on a sheet P is varied without causing a variation from a user-specified density of the image by varying the amount of laser light to be applied to the image in accordance with its type. Thus, an advantage is expected that the quality of an image can be enhanced in accordance with its type.

Exemplary Embodiment 14

In the 13th exemplary embodiment, the texture of an image is varied by varying the amount of laser light to be applied to the image in accordance with its type utilizing the feature that the same density can be obtained for different coverage rates by controlling the amount of laser light to be applied to the image (i.e., the relationship between curves 94 and 95 in FIG. 50).

Attention is now paid to another feature of the relationship between curves 94 and 95 in FIG. 50, that is, whereas the maximum density is equal to Dmax1 when the image is illuminated with laser light, the maximum density is equal to Dmax2 (<Dmax1) when the image is not illuminated with laser light.

A 14th exemplary embodiment provides an inkjet recording apparatus 12 in which the density range is expanded upward from the range that is realized without applying laser light to an image by controlling the laser light emission amount utilizing the above feature. In the following, a description will be made of how the inkjet recording apparatus 12 works.

The inkjet recording apparatus 12 according to this exemplary embodiment may have the same configuration (operation excluded) as the inkjet recording apparatus 12 according to any of the exemplary embodiments described so far.

Figure 52:
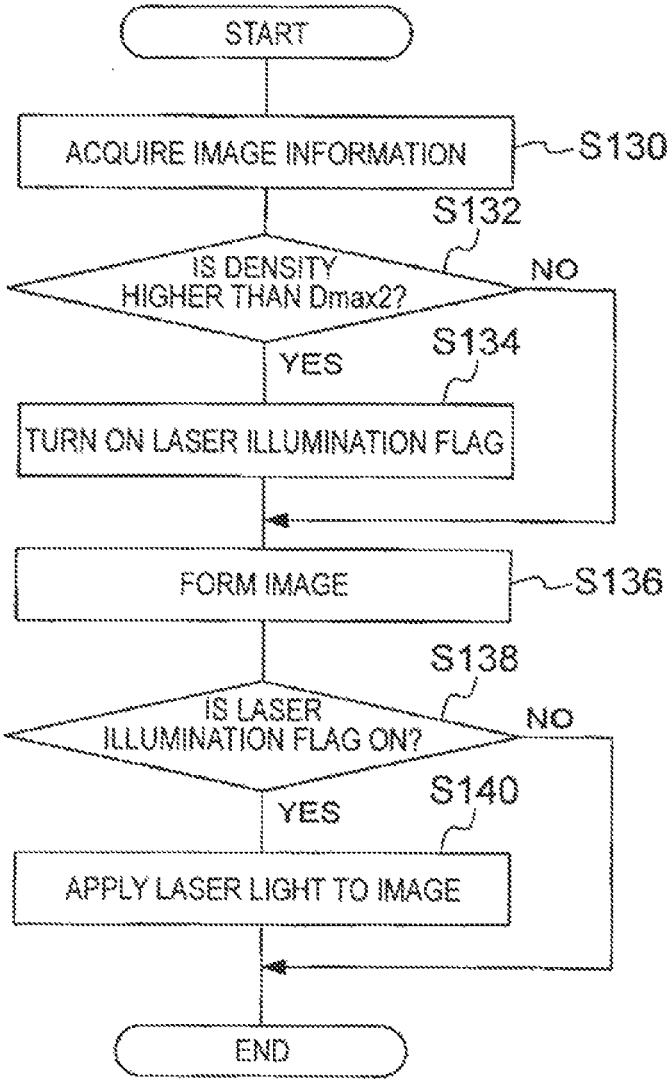
FIG. 52 is a flowchart of a laser light illumination control program used in a 14th exemplary embodiment.

FIG. 52 is a flowchart of a laser light illumination control program which is run by the CPU 70A of the computer 70 when, for example, an image formation request is received from the user.

In this exemplary embodiment, as in the 13th exemplary embodiment, it is assumed that image information of an original image is received together with the image formation request from, for example, a terminal apparatus (not shown) connected to a communication line (not shown) through the communication line I/F 60 and is stored in a predetermined storage location of the RAM 70C in advance.

First, at step S130, the CPU 70A acquires the image information of the original image from the predetermined storage location of the RAM 70C. At this time, the CPU 70A turns off a laser illumination flag which is stored in, for example, a predetermined storage location of the RAM 70C.

At step S132, the CPU 70A refers to image density information contained in the image information of the original image acquired at step S130 and judges whether the image density exceeds Dmax2. The process moves to step S134 if the judgment result is affirmative, and moves to step S136 if it is negative. The value of the density Dmax2 is stored in, for example, a predetermined storage location of the nonvolatile memory 70D in advance.

At step S134, the CPU 70A turns on the laser illumination flag. At step S136, the CPU 70A forms an image on a sheet P by causing the head array 30 to emit ink droplets on the basis of image density information and ink droplet ejecting position information that are contained in the image information of the original image.

In doing so, the CPU 70A determines a coverage rate of the image by, for example, referring to a coverage rate table which is different from the coverage rate table of Table 6 in that the state of the laser illumination flag replaces the state of the graininess priority image flag.

At step S138, the CPU 70A judges whether the laser illumination flag is on. The running of the program is finished if the judgment result is negative. The process moves to step S140 if the judgment result is affirmative.

At step S140, the CPU 70A controls the laser drying unit 56 so that the laser light emitting elements V of the laser drying unit 56 apply laser light beams having the predetermined emission amount to the image. Then the running of the program is finished.

With the above process, a specified density of an image that is higher than the maximum density Dmax2 that is realized without laser light illumination can be realized by expanding the density range upward by applying laser light to the image.

For example, when images are formed on plain paper sheets by running the program of FIG. 52, an increased maximum image density Dmax2 of about 1.4 is obtained with laser light illumination whereas a maximum image density Dmax1 of a case without laser light illumination is equal to about 1.2.

In the 13th and 14th exemplary embodiments, there are no limitations on the type of sheet P and the color of ink droplets.

Exemplary Embodiment 15

The inkjet recording apparatus 12 according to the exemplary embodiments described so far are for forming an image on a cut sheet of the A4 size, for example. A 15th exemplary embodiment provides an inkjet recording apparatus 13 in which images formed on a continuous sheet are dried by laser drying units 56.

Figure 53:
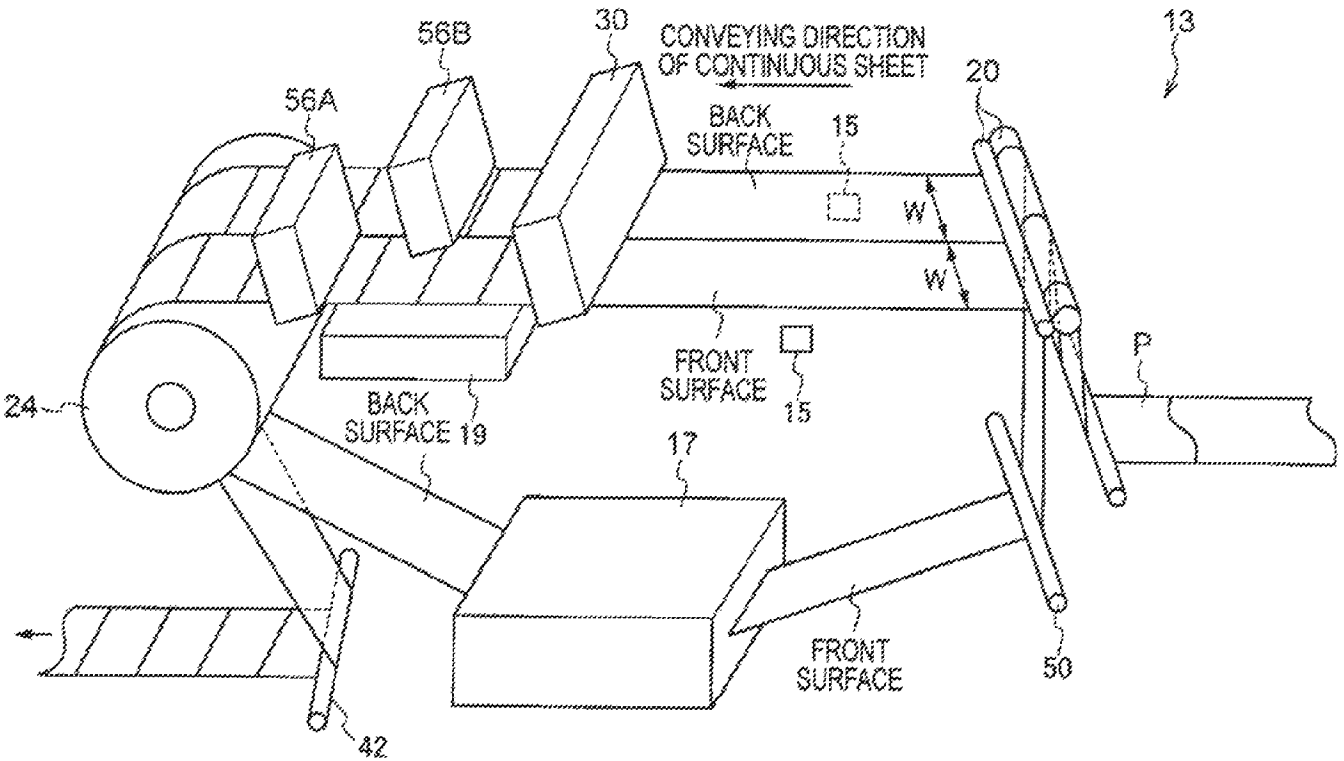
FIG. 53 is a schematic view showing the configuration of an essential part of an inkjet recording apparatus according to a 15th exemplary embodiment.

FIG. 53 is a schematic view showing the configuration of an essential part of the inkjet recording apparatus 13 according to this exemplary embodiment. As shown in FIG. 53, the inkjet recording apparatus 13 according to this exemplary embodiment uses, as a sheet P, a continuous sheet having a width W. As a drive roll 24 rotates, the continuous sheet is conveyed in such a manner that its front surface is opposed to the ink ejecting surface of a head array 30. An image formed by ink droplets ejected onto the front surface of the continuous sheet by the head array 30 is dried by laser light that is emitted from a laser drying unit 56A which is disposed so as to be movable in the conveying direction, whereby the image is fixed on the front surface of the continuous sheet.

The continuous sheet on whose front surface the image has been formed is conveyed to a sheet flipping device 17 with its back surface up, and is flipped by the sheet flipping device 17. After being output from the sheet flipping device 17, the continuous sheet is conveyed with its front surface up, passes a flip roller 50 and a conveyance roller pair 20, and is conveyed in such a manner that its back surface is opposed to the ink ejecting surface of the head array 30. This part of the continuous sheet is conveyed parallel with the part whose front surface is an image forming surface.

An image formed on the back surface of the continuous sheet by the head array 30 is dried by laser light that is emitted from a laser drying unit 56B which is disposed so as to be movable in the conveying direction, whereby the image is fixed on the back surface of the continuous sheet.

After the formation of the images on the front and back surfaces, the continuous sheet is conveyed to a continuous sheet ejection unit (not shown) via an ejection roller 42.

A laser light receiving unit 19 is disposed at such a position as to be opposed to the laser drying units 56A and 56B and to cover the laser light illumination range of the laser drying units 56. The laser light receiving unit 19 receives that part of laser light emitted from the laser drying unit 56A or 56B which passes through the continuous sheet or travels outside the width of the continuous sheet. The laser light receiving unit 19 is configured so that received laser light hardly goes out of it.

Figure 54:
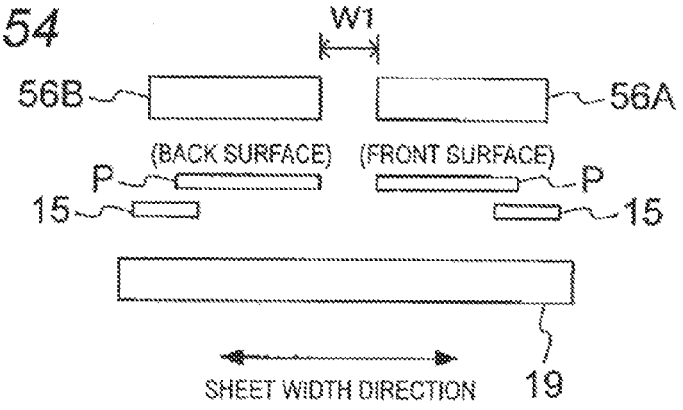
FIG. 54 illustrates positional relationships between a continuous sheet and sheet width sensors used in the 15th exemplary embodiment.

Furthermore, as shown in FIG. 54, plural sheet width sensors 15 for detecting a sheet width of the continuous sheet are disposed under the continuous sheet conveyance path between the conveyance roller pair 20 and the head array 30. Each sheet width sensor 15 detects a position, in the width direction, of an edge, extending in the conveying direction, of that part of the continuous sheet whose front surface or back surface is an image forming surface. The other edge, extending in the conveying direction, of each of the above parts of the continuous sheet is flush with the associated end, in the width direction, of the laser drying unit 56A or 56B. The sheet width sensors 15 are provided to restrict the actual laser light illumination range of each of the laser drying units 56A and 56B to within the continuous sheet.

Figure 55A:
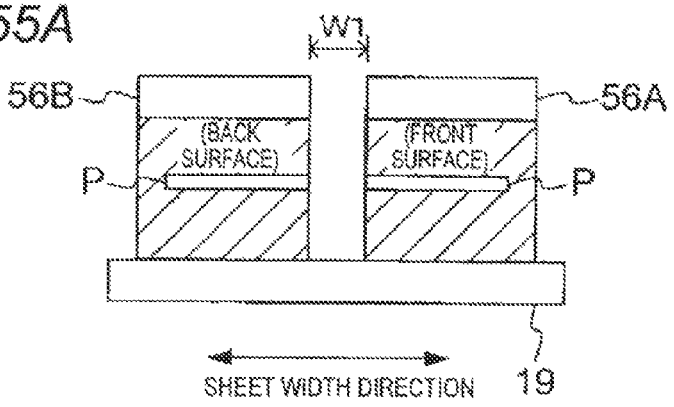
FIGS. 55A and 55B are schematic diagrams illustrating the role of the sheet width sensors used in the 15th exemplary embodiment.
Figure 55B:
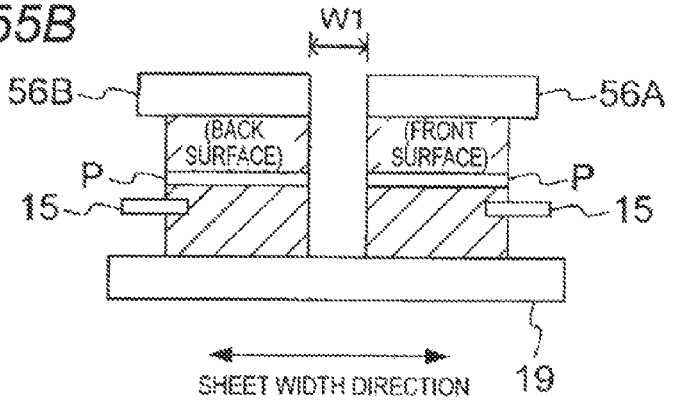

As shown in FIG. 55A, where the sheet width sensors 15 are not provided, if the width of the continuous sheet is unknown, it is necessary to cause all the laser light emitting elements V, arranged in the width direction, of the laser drying unit 56A or 56B to emit laser light beams.

On the other hand, where the width of the continuous sheet is known in advance because of the presence of the sheet width sensors 15, as shown in FIG. 56B it suffices to cause, in accordance with the width of the continuous sheet, only laser light emitting elements V of the laser drying unit 56A or 56B that are necessary to apply laser light to the entire surface of the continuous sheet to emit laser light beams. Controlling the laser drying units 56A and 56B in this manner on the basis of information acquired by the sheet width sensors 15 leads to reduction of the power consumption of the inkjet recording apparatus 13. In addition, since the laser light illumination range is reduced, the temperature increase inside the body of the inkjet recording apparatus 13 is suppressed and the degree of deterioration of the members and devices due to illumination with laser light that travels outside the continuous sheet is lowered.

The laser drying units 56A and 56B are spaced from each other by a distance W1 in the width direction because of a structure-related reason, that is, to allow them to be movable in the conveying direction.

Figure 56:
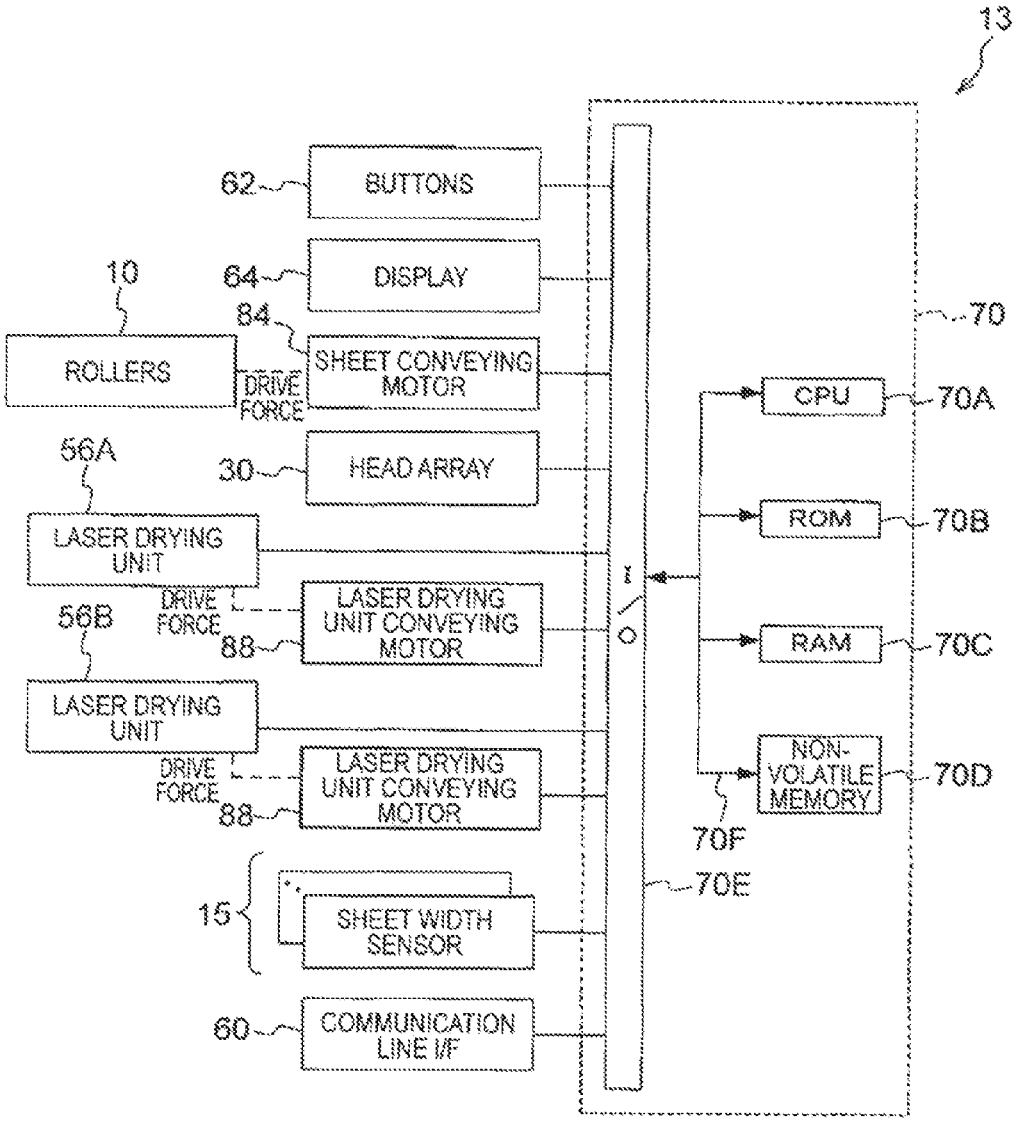
FIG. 56 is a block diagram showing the configuration of an essential part of an electrical system of the inkjet recording apparatus according to the 15th exemplary embodiment.

FIG. 56 is a block diagram showing the configuration of an essential part of an electrical system of the inkjet recording apparatus 13 according to this exemplary embodiment. As shown in FIG. 56, the laser drying units 56A and 56B are driven by respective independent laser drying unit conveying motors 88. The sheet flipping device 17 includes a sheet conveying motor 84 and part of rollers 10.

The above-described image forming scheme in which plural nozzles, arranged in the width direction, of the head array 30 are divided into logical blocks and nozzles belonging to a certain block eject ink droplets onto the front surface of a continuous sheet and nozzles belonging to another block eject ink droplets onto the back surface of the continuous sheet is called an SED (single engine duplex) scheme.

In conventional SED apparatus, a carbon heater or the like is used for image drying and an image is dried by blowing a hot wind over the entire surface of a part, located in a drying area, of a continuous sheet. In this case, even if the front surface and the back surface of the continuous sheet are dried at the same temperature, the densities of respective images formed on the front surface and the back surface may be different from each other.

In view of the above, in this exemplary embodiment, the control program shown in FIG. 6 (first exemplary embodiment) is run for each of the laser drying units 56A and 56B of the inkjet recording apparatus 13.

At step S14 in FIG. 6, the laser drying unit 56 is moved to a position that provides such illumination timing that maximum densities are given to an image formed on a sheet P by referring to the laser light illumination position table of Table 1. In this exemplary embodiment, the laser drying units 56A and 56B are moved to positions that provide such illumination timing that differences between densities of an image formed on the front surface of a continuous sheet and densities of an image formed on its back surface are made smaller.

Sets of positions of the laser drying units 56A and 56B that provide such illumination timing that density differences are made smaller are determined in the form of a density difference correction table for respective combinations of, for example, a printing speed and a type of continuous sheet on the basis of a result of an experiment using an actual apparatus, a computer simulation, or the like, and are stored in, for example, a predetermined storage location of the nonvolatile memory 70D. When the step corresponding to step S14 in FIG. 6 is executed, the positions of the laser drying units 56A and 56B in the conveying direction are determined by referring to the density difference correction table instead of the laser light illumination position table.

As described above, in the SED inkjet recording apparatus 13 according to this exemplary embodiment, the distances between the head array 30 and the laser light illumination position of the laser drying unit 56A for applying laser light to the front surface of a continuous sheet and that of the laser drying unit 56B for applying laser light to the back surface of the continuous sheet are controlled so that the laser drying units 56A and 56B apply laser light to respective images with different timing relationships to adjust their densities. As a result, density differences between the two images are made smaller than in cases that the images are dried by methods other than the laser light illumination.

Figure 57:
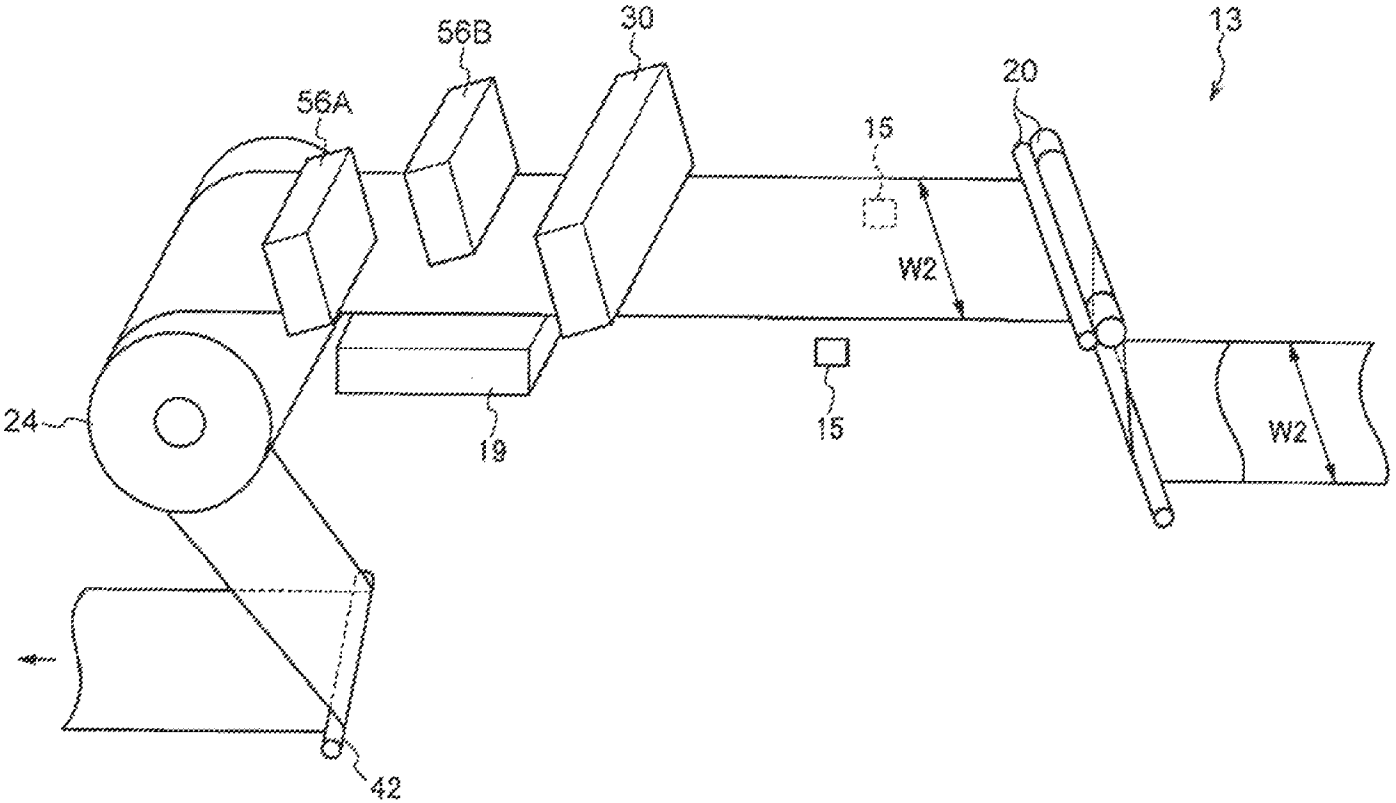
FIG. 57 shows the inkjet recording apparatus 13 according to the 15th exemplary embodiment in a case that a full-width sheet is used.

Next, with reference to FIG. 57, a description will be made of how the laser light illumination by the laser drying units 56A and 56B is controlled in the case where a full-width sheet is used a continuous sheet.

The full-width sheet is a continuous sheet whose width W2 is two times the width W of the continuous sheet shown in FIG. 53. The head array 30 used in this exemplary embodiment cannot form images on the front surface and the back surface of a full-width sheet in parallel, but enables use of a continuous sheet that is wider than a continuous sheet that is used for forming images on the front surface and the back surface in parallel.

A full-width sheet on one surface of which an image has been formed is conveyed from the drive roll 24 to the ejection roller 42 without going through the sheet flipping device 17, and then to the continuous sheet ejection unit (not shown).

Figure 58A:
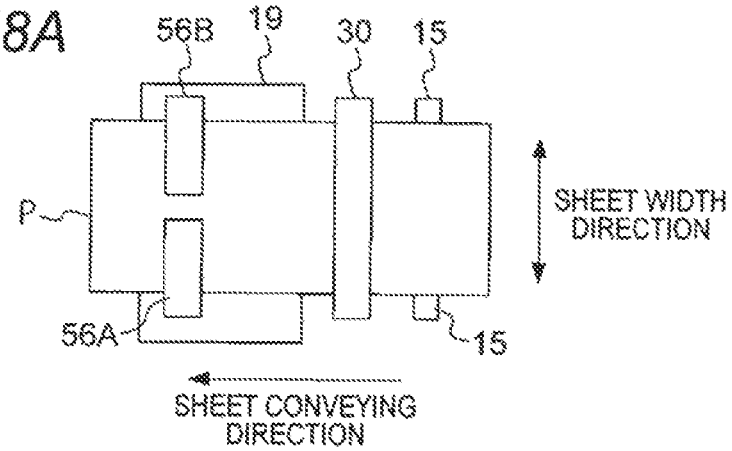
FIGS. 58A, 58B and 58C are schematic diagrams illustrating how infrared laser light is applied to a full-width sheet in the 15th exemplary embodiment.

FIG. 58A shows a laser light illumination show arrangement positions of the laser drying units 56A and 56B as viewed from above the image recording surface of a full-width sheet. In this case, unlike in the case of drying both surfaces of a full-width sheet in parallel, an image formed on only one surface of the full-width sheet needs to be dried. Therefore, the positions of the laser drying units 56A and 56B are controlled so that they are spaced from the head array 30 by the same distance.

Figure 58B:
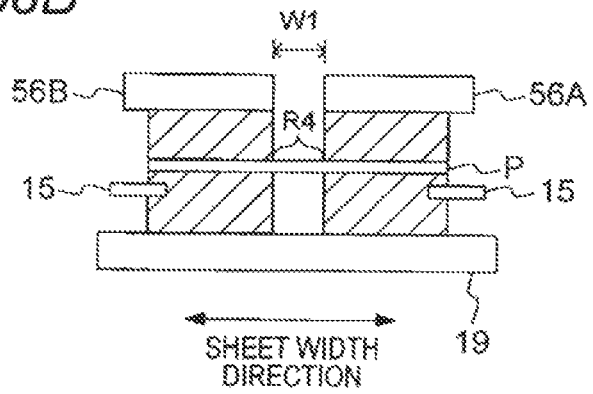

FIG. 58B shows laser light illumination ranges in the case where the laser drying units 56A and 56B are arranged as shown in FIG. 58A. As mentioned above, the laser drying units 56A and 56B are spaced from each other by the distance W1 in the width direction. Therefore, as seen from FIG. 58B, a situation occurs that a full-width sheet is not illuminated with laser light in a region R4.

Figure 58C:
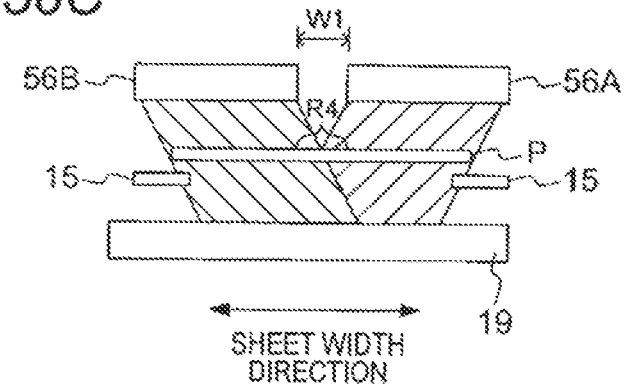

In view of the above, in the inkjet recording apparatus 13 according to this exemplary embodiment, laser light is applied to a full-width sheet in such a manner that the laser light illumination angles of the laser drying units 56A and 56B are controlled in the vertical plane including the width direction. More specifically, as shown in FIG. 58C, the illumination angles of the laser drying units 56A and 56B are controlled in the vertical plane including the width direction so that the laser light illumination ranges of the laser drying units 56A and 56B come into contact with each other in the region R4.

As described above, laser light is applied to the entire surface of a part, located in the drying area, of a full-width sheet by controlling the laser light illumination angles of the laser drying units 56A and 56B in the vertical plane including the width direction. An advantage is thus expected that density unevenness of an image formed on a full-width sheet can be made lower.

Exemplary Embodiment 16

In each of the exemplary embodiments described so far, the densities of an image are adjusted by controlling at least one of the timing, position(s), and illumination amount of the laser light illumination of an image. A 16th exemplary embodiment is directed to ink components that are suitable for laser light illumination.

In conventional image drying methods using a carbon heater or the like, the drying efficiency is lower than in the image drying method using a laser. Therefore, in such conventional image drying methods, the ink components are adjusted so the ink droplets permeate into a sheet P more easily to thereby suppress the degree of transfer of ink to another object after image drying (transfer densities). In drying methods using a hot wind, a mechanical unit for drying is larger than in the drying method using a laser and hence it is difficult to dispose the mechanical unit near the head array 30. It is therefore difficult to dry an image within several hundreds of milliseconds after ejecting of ink droplets.

On the other hand, no specific studies have been made of ink components that are suitable for the image drying method using laser light illumination. In these circumstances, the inventors studied ink components that are suitable for the image drying method using laser light illumination.

Figure 59:
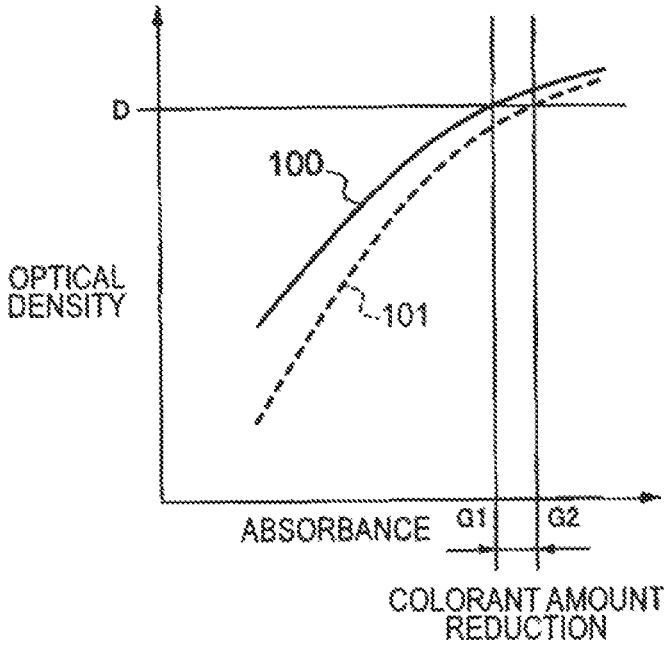
FIG. 59 is a graph showing a relationship between the peak absorbance in a visible range of an ink and the optical density.

FIG. 59 is a graph showing a relationship between the peak absorbance of an ink measured by spectrophotometry in a visible range (400 to 800 nm) using a solution of 2,000-fold dilution and the optical density of an image formed on plain paper using the ink. Curve 100 represents a characteristic that was obtained when images were illuminated with laser light with an illumination amount $2.5\times10^4$ J/m$^2$, and curve 101 represents a characteristic that was obtained without laser light illumination. The time from ejecting of ink droplets to application of laser light to the ink droplets was set at 60 ms.

As seen from FIG. 59, the optical densities of images are increased when they are illuminated with laser light. For example, an ink peak absorbance G1 corresponding to an image with laser light illumination that exhibits a density D is lower than an ink peak absorbance G2 corresponding to an image without laser light illumination that exhibits the same density D.

This is considered due to a phenomenon that when an image is dried by laser light illumination, ink droplets are dried in a shorter time than when it is not illuminated with laser light and hence a colorant is condensed in the vicinity of the surface of plain paper.

That is, to realize the same density, the mass percentage concentration of a colorant contained in ink droplets can be made lower when laser light illumination is done than when not done. This means cost reduction.

To attain a higher optical density with a smaller amount of colorant, it is important to properly adjust the average permeation time of an ink. This is because a longer ink average permeation time allows a larger amount of ink to remain in the vicinity of the surface of plain paper. That is, it is desirable to make the ink average permeation time longer than a predetermined time.

The term "average permeation time" means an average of permeation times measured at 15 ink droplet landing positions, the permeation time being a time that is taken from landing of a droplet on a sheet P to completion of lowering of the ink droplet surface when one-dot line (i.e., a line whose width corresponds to one ink droplet) is formed on the sheet P at a maximum nozzle resolution used in the inkjet recording apparatus 12 with a maximum amount of ink droplet used in the inkjet recording apparatus 12.

It is preferable that inks of colors other than K contain an infrared absorbent. This is because whereas substances that are commonly used as K-color colorants, such as carbon black, have an infrared absorbing property, CMY colorants absorb infrared light much less than carbon black and take long time to dry off.

Examples of the infrared absorbent are cyanine-based compounds, diimonium-based compounds, and aminium-based compounds. More specific examples are KAYASORB IRG-140, KAYASORB IRG-022, and KAYASORB CY-40MC produced by Nippon Kayaku Co., Ltd. and NIR-IM1 and NIR-AM1 produced by Nagase ChmuteX Corporation.

An example content range of the infrared absorbent is 0.01 to 1 mass % with respect to an ink. It is desirable that the content of the infrared absorbent be 0.05 to 0.5 mass %, and it is even desirable that the content of the infrared absorbent be 0.1 t 0.2 mass %.

The inventors studied the wavelength of laser light to be applied to ink droplets taking the components of ink droplets into consideration, and have found that it is desirable to use a wavelength at which absorption by water does not occur in a wavelength range of 800 to 12,000 nm.

When the wavelength of laser light is set at a wavelength at which absorption by water does not occur, laser light is absorbed by the infrared absorbent more efficiently than in a case that a water-absorbable wavelength is used, whereby the drying time of ink droplets is shortened. Furthermore, with an additional measure of suppressing application of laser light to positions other than landing positions of ink droplets, that is, a sheet P itself, an advantage is expected that occurrence of wrinkles due to uneven contraction or expansion of the sheet P when the sheet P is dried and the ink droplets permeate into the sheet P.

The inventors studied how the optical density and the transfer density of an evaluation image (patch image) varies depending on application/non-application of laser light, the patch image being formed by ejecting K-color ink droplets to a 1.5-inch square region at a coverage rate of 100%.

Table 8 shows a result of this experiment.

TABLE 8

| Item | Example | Comparative Example |
|---|---|---|
| Optical density | 1.1 | 0.8 |
| Transfer density | 0.02 | 0.02 |

In Table 8, the optical density was measured after a lapse of 1 hour from the ejecting of ink droplets. The transfer density means an optical density of a patch image transferred to transfer plain paper when the transfer plain paper was placed on and pressed against the surface on which the patch image was formed by applying force of 10 N after a lapse of 30 seconds from the ejecting of ink droplets.

In Example of Table 8, a K-color ink was used whose peak absorbance was 1.0. The amount of each ink droplet was 3.5 pl. The average permeation time of the plain paper was 70 ms. The laser light emission amount was $1.5\times10^4$ J/m$^2$, the printing speed was 60 m/min, and the distance from the ink droplets ejecting position to the laser light illumination position was 60 mm. In Comparative Example of Table 8, the same conditions as in Example were employed except that the distance from the ink droplets ejecting position to the hot wind blowing position of a carbon heater was 500 mm.

In Example, it took 60 ms from the ejecting of ink droplets to the illumination with laser light. In Comparative Example, it took 500 ms from the ejecting of ink droplets to the hot wind blowing. As seen from Table 8, the optical density was higher in Example than in Comparative Example, which is considered due to the above-described phenomenon that when ink droplets were illuminated with laser light, the ink droplets were dried with the colorant condensed in the vicinity of the surface of the plain paper. The reason why Example and Comparative Example exhibited the same transfer density would be that the degree of drying of ink droplets in Comparative Example was made closer to that in Example.

The inventors have obtained a result that if the time from the ejecting of ink droplets onto plain paper to their drying by laser light illumination is set within the average permeation time multiplied by 10, the optical density of an image is made higher when the ink droplets are illuminated with laser light than they are not. It was also found that the transfer density of an image whose optical density is increased by laser light illumination remains the same as that of an image not subjected to laser light illumination.

Based on the above results, the inventors studied ink components that are suitable for the image drying method using laser light illumination as well as an arrangement of the head array 30 and the laser drying unit 56 that is suitable for such ink components.

Figure 60:
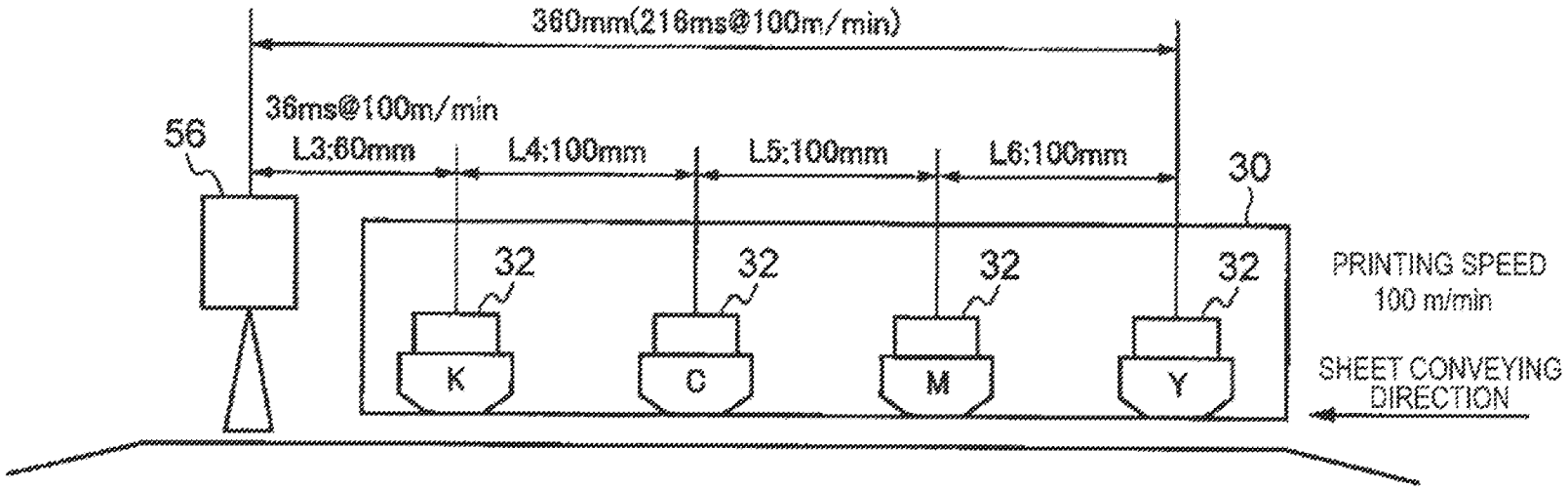
FIG. 60 is a schematic diagram showing a positional relationship between the head array and the laser drying unit in a 16th exemplary embodiment.

FIG. 60 shows a positional relationship between the head array 30 and the laser drying unit 56 of an inkjet recording apparatus 12 according to a 16th exemplary embodiment. As shown in FIG. 60, the laser drying unit 56 is disposed at a position that is spaced from the ink ejecting outlets of the K-color ink head 32 by a distance L3. In the head array 30, for example, the ink heads 32 of the respective colors are arranged in the conveying direction in such a manner that the distance from the ink ejecting outlets of the K-color ink head 32 to those of the C-color ink head 32 is equal to LA, the distance from the ink ejecting outlets of the C-color ink head 32 to those of the M-color ink head 32 is equal to L5, and the distance from the ink ejecting outlets of the M-color ink head 32 to those of the Y-color ink head 32 is equal to L6. More specifically, L3 is set at 60 mm and L4, L5, and L6 are set at 100 mm. The printing speed is set at 100 m/min.

Table 9 shows an example composition of a K-color ink that is suitable for the inkjet recording apparatus 12 that is configured as shown in FIG. 60. Table 10 shows an example composition of chromatic (YMC) inks.

TABLE 9

| K-color components | Mass % |
|---|---|
| Humectant | 43 |
| Colorant | 2 |
| Surfactant | 2 |
| Penetrant | 2 |
| Water | Remainder |

TABLE 10

| Chromatic ink components | Mass % |
|---|---|
| Humectant | 43 |
| Colorant | 2 |
| Surfactant | 2 |
| Penetrant | 1 |
| Water | Remainder |
| Infrared absorbent | 0.1 |

The average permeation time of the K-color ink shown in Table 9 is equal to 100 ms. The average permeation time of the chromatic inks shown in Table 10 is made equal to 250 ms by setting the mass percentage of the penetrant smaller than that of the K-color ink shown in Table 9. This is because the chromatic ink ejecting outlets are more distant from the laser drying unit 56 in the conveying direction than the K-color ink ejecting outlets. As mentioned above, the chromatic inks contain the infrared absorbent.

As seen from Tables 9 and 10, the inks used in this exemplary embodiment do not contain a water-soluble organic solvent for the following reason. As described above, where an image is dried by illuminating it with laser light, ink droplets are dried in a shorter time than in the case that the image is not illuminated with laser light. Therefore, even if the inks do not contain a water-soluble organic solvent, the colorant is condensed in the vicinity of the surface of plain paper to increase optical densities.

Although this exemplary embodiment is directed to the case of using plain paper, the concept of the exemplary embodiment can also be applied to the cases of using other kinds of paper such as inkjet-dedicated paper. In these cases, the average permeation times become different (in general, shorter) than in the case of using plain paper, which can be accommodated by adjusting the arrangement positions of the head array 30 and the laser drying unit 56 in accordance with the average permeation times.

As described above, in this exemplary embodiment, the inventors studied ink components that are suitable for the image drying method using laser light illumination and have found ink components with which an image can be given specified optical densities even if the mass percentage of the colorant contained in each ink is made smaller than in the case of not using laser light. An advantage is therefore expected that optical densities of an image equivalent to those obtained with conventional inks to be used in the case of not using laser light can be realized with inks that are less expensive than the conventional inks.

Although the invention has been described above using the exemplary embodiments, the technical scope of the invention is not restricted to the disclosures of those exemplary embodiments. A variety of modifications and improvements can be made in the exemplary embodiments without departing from the spirit and scope of the invention, and the technical scope of the invention encompasses modes each including such a modification or improvement.

For example, although in each of the exemplary embodiments the described process is implemented by a software configuration, the invention is not limited to such a case. The described process of each exemplary embodiment may be implemented by a hardware configuration or a combination of a software configuration and a hardware configuration. For example, a functional device capable of performing processing that is equivalent to the processing performed by the computer 70 may be produced and used. In this case, it is expected that the processing speed can be made higher than in each exemplary embodiment.

It goes without saying that the laser drying unit 56 used in each exemplary embodiment may be replaced by the VCSEL 56'.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A droplets drying device comprising:

an illuminating unit that applies infrared laser light to droplets that have been ejected onto a recording medium by an ejecting unit that ejects droplets in accordance with an image to be formed; and a control unit that control at least one of timing, a position or positions, and an amount or amounts of application of infrared laser light to the droplets by the illuminating unit in accordance with an attribute that influences image quality of an image formed;

wherein the control unit controls a time to a start of illumination from the ejecting of the droplets onto the recording medium by the ejecting unit to a start of the application of infrared laser light to the droplets on the recording medium by the illuminating unit on the basis of at least one of a type of the recording medium, a printing speed of the image, and a distance from the ejecting unit to the illuminating unit in a conveying direction of the recording medium.

2. The droplets drying device according to claim 1, wherein the control unit controls a position of the application of infrared laser light by the illuminating unit on the basis of the type of the recording medium and the printing speed of the image so that the time to a start of illumination becomes equal to a predetermined time.

3. The droplets drying device according to claim 2, further comprising a moving unit that moves the illuminating unit in the conveying direction, wherein the control unit controls the moving unit on the basis of the type of the recording medium and the printing speed of the image so that the illuminating unit is moved to such a position that the time to a start of illumination becomes equal to the predetermined time.

4. The droplets drying device according to claim 2, wherein:

plural illuminating units are arranged in the conveying direction at positions that are spaced from the ejecting unit by different distances; and the control unit determines an illuminating unit to apply infrared laser light to the droplets on the recording medium from among the plural illuminating units on the basis of the type of the recording medium and the printing speed of the image so that the time to a start of illumination becomes equal to the predetermined time.

5. The droplets drying device according to claim 1, wherein the ejecting unit and the illuminating unit are disposed at predetermined positions; and the control unit controls the printing speed of the image on the basis of the type of the recording medium and the distance from the ejecting unit to the illuminating unit in the conveying direction so that the time to a start of illumination becomes equal to a predetermined time.

6. The droplets drying device according to claim 1, wherein:

plural ejecting units mare ranged in the conveying direction at positions that are spaced from the illuminating unit by different distances; and the control unit determines an ejecting unit to eject droplets onto the recording medium from among the plural ejecting units on the basis of the type of the recording medium and the printing speed of the image so that the time to a start of illumination becomes equal to a predetermined time.

7. A non-transitory computer readable medium storing a program causing a computer to function as the control unit of the droplets drying device according to claim 1.

8. An image forming apparatus comprising:

an image forming unit that forms an image corresponding to image information on a recording medium by ejecting droplets onto the recording medium according to the image information; and the droplets drying device according to claim 1 for drying the droplets on the recording medium.

9. A droplets drying device comprising:

an illuminating unit that applies infrared laser light to droplets that have be ejected onto a recording medium by an ejecting unit that ejects droplets in accordance with an image to be formed;

a control unit that controls at least one of timing, a position or positions, and an amount or amounts of application of infrared laser light to the droplets by the illuminating unit in accordance with an attribute that influences image quality of an image formed;

wherein:

the image is an image having a predetermined intermediate density;

the illuminating unit is such that plural infrared laser light emitting elements are arranged in a width direction of the recording medium, and that an amount of emission of infrared laser light from each of the infrared laser light emitting elements is varied in accordance with a voltage or current supplied to the infrared laser light emitting element; and the control unit controls the magnitude of the voltage or current supplied to each of the infrared laser light emitting elements so that unevenness of densities of respective portions of the image falls within a predetermined range by controlling a supplying unit for supplying the voltage or current to each of the infrared laser light emitting elements, on the basis of unevenness of densities of the respective portions of the image that were illuminated by the respective infrared laser light emitting elements supplied with a predetermined voltage or current from the supplying unit being controlled by the control unit.

10. The droplets drying device according to claim 9, wherein the control unit controls the magnitude of the voltage or current supplied to each of the infrared laser light emitting elements so that a density of an associated portion of the image comes close to a predetermined density by controlling the supplying unit on the basis a density vs. voltage or current characteristic reflecting plural densities of the associated portion of the image that was illuminated with different amounts of infrared laser light by the associated infrared laser light emitting element supplied with different predetermined voltages or currents from the supplying unit being controlled by the control unit.

11. The droplets drying device according to claim 9, further comprising a reading unit that reads densities of the respective portions of the image.

12. The droplets drying device according to claim 9, further comprising a notifying unit that outputs, to the outside, a message for urging maintenance of the illuminating unit if the unevenness of the densities of the respective portions of the image does not fall within the predetermined range.

13. A droplets drying device comprising:

an illuminating unit that applies infrared laser light to droplets that have been ejected onto a recording medium by an ejecting unit that ejects droplets in accordance with a image to be formed;

a control unit that controls at least one of timing, a position or positions, and an amount or amounts of application of infrared laser light to the droplets by the illuminating unit in accordance with an attribute that influences image quality of an image formed;

wherein:

the image is an image having a predetermined intermediate density; and the control unit controls the illuminating unit so that a laser light illumination portion to which infrared laser light has been applied by the illuminating unit is formed in the image, and then controls at least one of a position or positions and timing of application of infrared laser light on the basis of a distance from an edge, extending parallel with a direction of formation of the laser light illumination portion, of the image to the laser light illumination portion.

14. The droplets drying device according to claim 13, wherein:

the ejecting unit has plural nozzles arranged at a predetermined first pitch in a width direction of the recording medium over a length that is greater than or equal to a width of the image;

the illuminating unit has plural infrared laser light emitting elements arranged at a predetermined second pitch in the width direction over a length that is greater than or equal to the width of the image; and the control unit controls the illuminating unit so that a laser light illumination portion is formed in the image in a conveying direction of the recording medium by a predetermined infrared laser light emitting element of the illuminating unit, then determines an end infrared laser light emitting element corresponding to a predetermined ejecting nozzle of the ejecting unit on the basis of the second pitch of the infrared laser light emitting elements and a distance from an edge, formed by droplets ejected by the predetermined ejecting nozzle, of the image to the laser light illumination portion and generates a correspondence table in which the ejecting nozzles and the infrared laser light emitting elements are correlated with each other one to one on the basis of the end infrared laser light emitting element and the predetermined ejecting nozzle, and subsequently applies infrared laser light to the recording medium according to the correspondence table.

15. The droplets drying device according to claim 14, further comprising a reading unit that reads densities of the image, the reading unit having plural density detection elements which are arranged at a predetermined third pitch in the width direction over a length that is greater than or equal to the width of the image, wherein the control unit calculates the distance from the edge of the image to the laser light illumination portion on the basis of the third pitch of the density detection elements and a number of density detection elements from a first density detection element that has detected a predetermined first density which is set as a density of the edge of the image in advance to a second density detection element that has detected a predetermined second density which is set as a density of the laser light illumination portion in advance.

16. The droplets drying device according to claim 13, further comprising a converting unit that converts a movement distance of the recording medium in a conveying direction of the recording medium into a number of pulses, wherein the control unit controls the illuminating unit so that the laser light illumination portion is formed in a width direction of the recording medium, and then adjusts, from predetermined timing, timing of a start of application of infrared laser light to the droplets on the recording medium on the basis of a number of pulses corresponding to a difference between a distance from an edge, extending parallel with the laser light illumination portion and located on a downstream side in the conveying direction, of the image to the laser light illumination portion and a predetermine distance the recording medium is to move in a period from the ejecting of the droplets onto the recording medium by the ejecting unit to a start of the application of infrared laser light to the droplets on the recording medium by the illuminating unit.

17. A droplets drying device comprising:

an illuminating unit that applies infrared laser light to droplets that have been ejected onto a recording medium by an ejecting unit that ejects droplets in accordance with an image to be formed;

a control unit that controls at least one of timing, a position or positions, and an amount or amounts of application of infrared laser light to the droplets by the illuminating unit in accordance with an attribute that influences image quality of an image formed;

wherein:

the image is an image having a predetermined intermediate density;

the illuminating unit has plural infrared laser light emitting elements arranged at a predetermined second pitch in a width direction over a length that is greater than or equal to a width of the image; and the control unit controls the illuminating unit so that the infrared laser light emitting elements apply respective infrared laser light beams to the image in a predetermined illumination pattern, and that a laser light emission amount of at least one infrared laser light emitting element that is adjacent to an infrared laser light emitting element that has been judged defective in terms of infrared laser light emission on the basis of a density distribution of the image obtained by the application of the infrared laser light beams and a predetermined density distribution of the image corresponding to the predetermined illumination pattern is set larger than a predetermined laser light emission amount.

18. The droplets drying device according to claim 17, wherein the predetermined illumination pattern has a set of illumination lines that are shifted sequentially in the width direction.

19. The droplets drying device according to claim 17, further comprising a reading unit that reeds densities of the image, wherein the control unit controls the reading unit to cause it to read a density distribution of the image to which the infrared laser light beams have been applied by the illuminating unit.

20. A droplets dying device comprising:

an illuminating unit that applies infrared laser light to droplets that have been ejected onto a recording medium by an ejecting unit that ejects droplets in accordance with an image to be formed;

a control unit that controls at least one of timing, a position or positions, and an amount or amounts of application of infrared laser light to the droplets by the illuminating unit in accordance with an attribute that influences image quality of an image formed;

wherein:

the ejecting unit has plural ejecting nozzles arranged at a predetermined pitch in a width direction of the recording medium, and forms the image by ejecting droplets in a predetermined ejecting pattern;

the illuminating unit has plural infrared laser light emitting elements which are arrange in the width direction so as to correspond to the respective ejecting nozzles and to thereby apply infrared laser light beams to the droplets ejected by the respective ejecting nozzles; and the control unit controls the illuminating unit so that an amount of infrared laser light emitted from a particular infrared laser light emitting element corresponding to an ejecting nozzle that has been judged defective in terms of droplet ejecting on the basis of a density distribution of an image is made smaller than a predetermined value.

21. The droplets drying device according to claim 20, wherein the control unit controls the illuminating unit so that the particular infrared laser light emitting element is prohibited from emitting infrared laser light.

22. The droplets drying device according to claim 20, wherein the control unit controls the illuminating unit so that infrared laser light emitting elements adjacent to the particular infrared laser light emitting element emit infrared laser light with an amount that is smaller than a predetermined value.

23. The droplets drying device according to claim 20, further comprising a reading unit that reads densities of the image, wherein the control unit determines the particular infrared laser light emitting element on the basis of a density distribution of the image obtained by controlled the reading unit and a predetermined density distribution of the image corresponding to the predetermined ejecting pattern.

24. A droplets drying device comprising:

an illuminating unit that applies infrared laser light to droplets that have been ejected onto a recording medium by an ejecting unit that ejects droplets in accordance with an image to be formed;

a control unit that controls at least one of timing, a position or positions, and an amount or amounts of application of infrared laser light to the droplets by the illuminating unit in accordance with an attribute that influences image quality of an image formed;

wherein:

the control unit controls whether to cause the illuminating unit to apply infrared laser light having a prescribed amount to the droplets on the recording medium on the basis of a type or a density of the image;

the control unit controls the ejecting unit so that it ejects ink droplets onto the recording medium changes an ejecting area ratio of droplets which corresponds to a density of the image on the basis of the type of the image, and controls whether to cause the illuminating unit to apply infrared laser light having the prescribed amount to the droplets on the recording medium;

if the image is such an image that importance is attached to graininess, the control unit sets the ejecting area ratio of droplets ejected by the ejecting unit in accordance with density information of the image larger than an ejecting area ratio of droplets ejected by the ejecting unit in the case where the illuminating unit does not emit infrared laser light, and controls the illuminating unit so that it applies infrared laser light having the predetermined amount to the droplets on the recording medium; and if the image is such an image that importance is attached to expansion of droplets, the control unit sets the ejecting area ratio of droplets ejected by the ejecting unit in accordance with density information of the image smaller than an ejecting area ratio of droplets ejected by the ejecting unit in the case where the illuminating unit emits infrared laser light, and controls the illuminating unit so that it applies infrared laser light having a smaller amount than the predetermined amount to the droplets on the recording medium.

25. The droplets drying device according to claim 24, wherein if the density of the image to be formed on the recording medium is higher than a density corresponding to a maximum ejecting area ratio of droplets ejected by the ejecting unit, the control unit controls the illuminating unit so that it applies infrared laser light to the droplets on the recording medium.

26. A droplets drying device comprising:

an illuminating unit that applies infrared laser light to droplets that have been ejected onto a recording medium by an ejecting unit that ejects droplets in accordance with an image to be formed;

a control unit that controls at least one of timing, a position or positions, and an amount or amounts of application of infrared laser light to the droplets by the illuminating unit in accordance with an attribute that influences image quality of an image formed;

wherein:

the recording medium is a continuous recording medium that is long in its conveying direction;

the illuminating unit is divided into a first illuminating unit for applying infrared laser light to droplets ejected on one recording surface of the continuous recording medium and a second illuminating unit for applying infrared laser light to droplets ejected on the other recording surface of the continuous recording medium; and the control unit controls respective positions of the first illuminating unit and the second illuminating unit on the basis of a type of the continuous recording medium and a printing speed of the image so that times to starts of illumination from the ejecting of the droplets onto the continuous recording medium by the ejecting unit to a start of the application of infrared laser light to the droplets on the one recording surface of the continuous recording medium by the first illuminating unit and to a start of the application of infrared laser light to the droplets on the other recording surface of the continuous recording medium by the second illuminating unit are set to predetermined times, respectively.

* * * * *